US008739489B2

(12) United States Patent
Weber et al.

(10) Patent No.: US 8,739,489 B2
(45) Date of Patent: Jun. 3, 2014

(54) DECKING SYSTEM

(75) Inventors: Tory Weber, Calgary (CA); Brian Boettger, Calgary (CA); Pierre Harvey, Quebec (CA); Stephan Lachevrotiere, Quebec (CA); David Croteau, Quebec (CA); Francois Parenteau, Quebec (CA); Paul Girouard, Calgary (CA); Ken Crockett, Calgary (CA); Derrick Resler, Calgary (CA); Gregg Westergard, Calgary (CA)

(73) Assignee: SIGMA DEK Ltd., Calgary, Alberta (CA)

( * ) Notice: Subject to any disclaimer, the term of this patent is extended or adjusted under 35 U.S.C. 154(b) by 746 days.

(21) Appl. No.: 12/863,217

(22) PCT Filed: Jan. 21, 2009

(86) PCT No.: PCT/CA2009/000041

§ 371 (c)(1),
(2), (4) Date: May 27, 2011

(87) PCT Pub. No.: WO2009/089623

PCT Pub. Date: Jul. 23, 2009

(65) Prior Publication Data

US 2011/0214369 A1 Sep. 8, 2011

Related U.S. Application Data

(60) Provisional application No. 61/021,931, filed on Jan. 18, 2008, provisional application No. 61/113,778, filed on Nov. 12, 2008.

(51) Int. Cl.

| | |
|---|---|
| ***E04B 1/00*** | (2006.01) |
| ***E04B 2/30*** | (2006.01) |
| ***E04B 1/38*** | (2006.01) |
| ***E04H 12/00*** | (2006.01) |
| ***E04H 17/00*** | (2006.01) |

(52) U.S. Cl.
USPC ..... 52/510; 52/289; 52/483.1; 52/650.3; 256/65.14

(58) Field of Classification Search
USPC ..... 52/7, 220.1, 281, 282.2, 283, 289, 52/483.1, 489.1, 506.06, 510, 650.3, 52/655.1, 290, 79.6, 702, 298; 256/65.14
See application file for complete search history.

(56) References Cited

U.S. PATENT DOCUMENTS 1,297,838 A * 3/1919 Haines ..... 256/32
2,939,309 A * 6/1960 Sitton ..... 52/189

(Continued)

FOREIGN PATENT DOCUMENTS

WO WO 9503456 A1 * 2/1995 ..... E04B 1/00

OTHER PUBLICATIONS

U.S. Appl. No. 61/113,778.

(Continued)

*Primary Examiner* — Ryan Kwiecinski
(74) *Attorney, Agent, or Firm* — Ryan W. Dupuis; Kyle R. Satterthwaite; Ade & Company Inc.

(57) ABSTRACT

A decking system comprises a ledger board for mounting on an upright supporting surface, a beam, a plurality of joists for spanning between the ledger board and the beam, and a plurality of deck boards for spanning across the joists in which all of the components can be mounted to one another by interlocking engagement of various connectors so that no additional fasteners are required for assembly. The components are formed of extruded and molded materials which do not require any maintenance. A railing system and a stair system are also provided which similarly connect by interlocking engagement of the components.

13 Claims, 42 Drawing Sheets

(56) References Cited

U.S. PATENT DOCUMENTS

| | | | | |
|---|---|---|---|---|
| 3,914,913 | A * | 10/1975 | Roberts | 52/475.1 |
| 4,019,298 | A | 4/1977 | Johnson, IV | |
| 5,101,737 | A | 4/1992 | Gomez | |
| 5,417,167 | A * | 5/1995 | Sadr | 108/57.19 |
| 5,456,189 | A * | 10/1995 | Belle Isle | 108/57.17 |
| 5,483,773 | A * | 1/1996 | Parisien | 52/73 |
| 5,625,987 | A * | 5/1997 | Zamerovsky | 52/263 |
| 5,950,377 | A | 9/1999 | Yoder | |
| 6,205,722 | B1 * | 3/2001 | Bromley et al. | 52/182 |
| 6,226,941 | B1 * | 5/2001 | Stevens | 52/302.3 |
| 6,314,699 | B1 | 11/2001 | West | |
| 6,745,529 | B2 * | 6/2004 | Beltran | 52/297 |
| 6,766,749 | B2 * | 7/2004 | Lacabanne | 108/56.3 |
| 6,802,267 | B1 * | 10/2004 | Janus | 108/56.1 |
| 6,938,558 | B1 * | 9/2005 | Peres | 108/56.3 |
| 8,256,172 | B2 * | 9/2012 | Benson | 52/220.1 |
| 2002/0194795 | A1 * | 12/2002 | Spite | 52/79.1 |
| 2004/0025464 | A1 * | 2/2004 | Williams | 52/483.1 |
| 2004/0079041 | A1 * | 4/2004 | Bergeron et al. | 52/489.1 |
| 2006/0113441 | A2 * | 6/2006 | Cicenas et al. | 248/219.1 |
| 2008/0272353 | A1 * | 11/2008 | Fattori | 256/19 |
| 2008/0302037 | A1 * | 12/2008 | Brown et al. | 52/289 |
| 2009/0050865 | A1 * | 2/2009 | Napier | 256/37 |
| 2010/0031587 | A1 * | 2/2010 | Weeks | 52/126.6 |
| 2010/0186338 | A1 * | 7/2010 | Rischmueller et al. | 52/650.3 |
| 2011/0203215 | A1 * | 8/2011 | McNamee | 52/650.3 |
| 2011/0225923 | A1 * | 9/2011 | Dueker | 52/650.3 |
| 2012/0317917 | A1 * | 12/2012 | Hawkins et al. | 52/650.3 |

OTHER PUBLICATIONS

U.S. Appl. No. 61/021,931.

* cited by examiner

DECKING SYSTEM

This application claims priority to U.S. provisional application Ser. No. 61/113,778, filed Nov. 12, 2008 and U.S. provisional application Ser. No. 61/021,931, filed Jan. 18, 2008.

FIELD OF THE INVENTION

The present invention relates to a decking system comprising components arranged for interlocking engagement with one another, and more particularly relates to a decking system in which deck boards, joists and beams of the decking system are formed of composite materials arranged for securement to one another wholly by interlocking engagement between the components without additional fasteners being required.

BACKGROUND

A popular form of deck construction for buildings, for example residential houses, involves surface materials formed of various composites which simulate the appearance of a finished wooden deck without requiring painting or other on-going maintenance. Current decking systems of this configuration however generally require conventional wood construction joists and beams and the subsequent awkward manipulation of various mounting clips, nails, screws and the like to secure the deck surface to the joists and beams below.

The following US patents relate generally to various forms of decks and other similar structures. U.S. Pat. No. 5,101,737 belonging to Gomez; U.S. Pat. No. 5,417,167 belonging to Sadr; U.S. Pat. No. 4,019,298 belonging to Johnson, IV; U.S. Pat. No. 6,314,699 belonging to West; U.S. Pat. No. 6,802,267 belonging to Janus; U.S. Pat. No. 5,950,377 belonging to Yoder; and U.S. Pat. No. 3,914,913 belonging to Roberts.

None of the prior art discloses an overall deck system in which all of the components can be manufactured of maintenance free materials and which can be readily assembled without the use of complex or awkward mounting clips and the like which can be very labor intensive.

SUMMARY OF THE INVENTION

According to one aspect of the present invention there is provided a decking system comprising:

a plurality of joists spanning in parallel, spaced apart from one another; and a plurality of deck boards, each spanning in a respective longitudinal direction transversely across the plurality of joists;

each deck board comprising:

a pair of opposed sides extending in the longitudinal direction of the deck board between ends of the deck board;

an upper deck surface spanning between the opposed sides along a top side of the deck board; and a plurality of joist connectors formed in a bottom side of the deck board opposite the upper deck surface, the joist connectors being spaced apart from one another in the longitudinal direction at respective intermediate positions along the deck board between the ends of the deck board;

each joist connector being arranged for interlocking engagement with a respective one of the joists such that each deck board is arranged for sliding movement along the joists in a lateral direction of the deck board which extends between the opposed sides of the deck board transversely to the respective longitudinal direction of the deck board.

By providing deck boards, joists, beams, stairs and railings which are arranged for interlocking engagement with one another all of the various components of a decking system can be readily manufactured of maintenance free materials which can be assembled quickly and without any specialized labour. Furthermore, the use of additional fasteners can be avoided whereby the components of the decking system can be secured relative to one another wholly by the interlocking engagement therebetween.

Each joist may comprise an upper connector spanning a full length of the joist and arranged for interlocking engagement with the joist connector of the deck boards. The upper connector on each joist which is arranged for interlocking engagement with the joist connectors may be formed integrally with the joist. Furthermore, the upper connectors may comprise an upper portion of the joist extending upwardly with increasing lateral dimension transverse to an elongate direction of the respective joist.

Preferably the deck boards are arranged to be secured to the joist wholly by interlocking engagement of the joist connectors.

The joist connectors may support the deck boards on the joists for sliding movement in a direction which is perpendicular to the longitudinal direction of the deck boards.

Each joist may comprise an extruded member having a continuous profile in cross section.

The joist connectors are preferably spaced apart along each deck board by a spacing corresponding to a spacing between floor joists of a building.

Each joist connector may comprise a channel extending through the deck board between the opposed sides at the bottom side of the deck board so as to be arranged for receiving a portion of the respective joists therein. The channel may include a flat base portion oriented substantially parallel to the upper deck surface of the deck board and arranged for mating engagement with a flat top edge of a respective one of the joists. Furthermore, each channel may include side walls which taper inwardly towards one another from a base portion of the channel to a mouth of the channel which is open at the bottom side of the deck board. The channels may be substantially trapezoidal in cross section.

When each channel spans in a lateral direction between a pair of mouths at the opposed outer sides of the deck board, each mouth may increase in dimension in the longitudinal direction of the channel outwardly towards the outer side.

Each end of each deck board may comprise a recess in the bottom side of the deck board which corresponds to only a portion of one of the channels such that each end of each deck board is arranged to overlap only a portion of a respective one of the joists.

Each recess may be formed such that the recesses of two of the deck boards abutted in an end to end configuration have a combined cross section which is substantially identical to the channels.

Each deck board may comprise a protruding portion at the upper deck surface at a first end of the deck board and a recessed portion at the upper deck surface at a second end of the deck board in which the recessed portion is arranged to receive the protruding portion of an adjacent one of the deck boards in an overlapping configuration when the deck boards are mounted in an end to end configuration.

When a first one of the sides of each deck board extends upwardly and inwardly towards the top side of the deck board, a second one of the sides of each deck board preferably extends upwardly and outwardly towards the top side of the deck board so as to be arranged to overlap the first one of the sides of an adjacent one of the deck boards supported alongside the deck board.

Each deck board may comprises a plurality of stiffening members projecting downwardly from the upper deck surface towards the bottom side at respective intermediate locations between the opposite sides of the deck board and between the ends of the deck boards.

The stiffening members may increase in height between the upper deck surface and the bottom side thereof with increasing distance from the joist connectors.

There may be provided a ledger board spanning in a longitudinal direction transversely across a mounting end of each of the plurality of joists such that the plurality of joists are supported on the ledger board at spaced apart positions in the longitudinal direction of the ledger board in which the ledger board comprises a slot extending in the longitudinal direction adjacent a top side of the ledger board which receives a portion of the deck boards therein.

According to a second aspect of the present invention there is provided a decking system comprising:

a plurality of joists spanning in parallel, spaced apart from one another;

a plurality of deck boards, each spanning transversely across the plurality of joists; and a ledger board spanning in a longitudinal direction transversely across a mounting end of each of the plurality of joists such that the plurality of joists are supported on the ledger board at spaced apart positions in the longitudinal direction of the ledger board;

the ledger board comprising:

a first upright side and a second upright side opposite one another and extending in the longitudinal direction of the ledger board between respective ends of the ledger board;

a plurality of joist connectors formed in the first upright side of the ledger board, the joist connectors being spaced apart from one another along the ledger board in the longitudinal direction;

each joist connector being arranged for receiving the mounting end of a respective one of the joists in interlocking engagement therewith.

The ledger board may comprises an extruded member having a substantially continuous profile along a length thereof and the joist connectors may comprise notches formed into the continuous profile transversely to a longitudinal direction of the ledger board.

Each joist connector may mate with the mounting end of the respective one of the joists in interlocking engagement so as to be arranged for relative sliding movement in an upright direction and so as to prevent movement of the respective joist away from the ledger board in a longitudinal direction of the joist.

Each joist connector may comprise a horizontal wall protruding from the first upright side of the ledger board in engagement with a mating surface of the respective joist supported thereon, said horizontal wall of the joist connector being formed integrally with the ledger board. The horizontal wall of each joist connector may be spaced up above a bottom edge of the ledger board, and there may be provided an angular support of material spanning from a bottom of the horizontal wall to the upright side of the ledger board at a position spaced below the horizontal wall.

There may be provided a plurality of preformed fastener holes integrally formed with the ledger board and extending through the ledger board from the first upright side to the second upright side at evenly spaced positions between adjacent ones of the joist connectors.

Each joist preferably comprises an upper flange, a lower flange parallel and opposite to the upper flange, and a web portion spanning between the upper and lower flanges and which is narrower than the upper and lower flanges.

The mounting end of each joist may comprise an overhang portion extending in the longitudinal direction of the joist beyond a remainder of the joist in which each joist connector is arranged to matingly receive the overhang portion of a respective one of the joists therein.

There may be provided a hook portion extending downwardly from the overhang portion in which each joist connector includes a ledge portion arranged to support the overhang portion of the respective joist thereon and which is spaced outwardly from the upright side of the ledger board such that the hook portion is received between the ledge portion and the upright side of the ledger board.

The ledge portion is preferably arranged to support an intermediate portion of the respective joist directly thereon at a location spaced below a top side and above a bottom side of the joist.

Each joist connector may include a resilient sprung retainer member arranged to overlap a portion of the mounting end of the joist received therein so as to be arranged to selectively resist upward sliding movement of the joist relative to the ledger board.

There may be provided an opening below the sprung retainer member arranged to provide access to the retainer member to selectively release the retainer member from the mounting end of the joist.

When both ends of each joist comprise an overhang portion extending in the longitudinal direction of the joist beyond a remainder of the joist in which each joist connector is arranged to matingly receive the overhang portion of a respective one of the joists therein, the overhang portions at opposing ends of each joist are preferably located adjacent opposing top and bottom sides of the joist respectively.

There may be provided a facer board spanning ends of the joists opposite the ledger board in which the facer board is supported on the overhang portions of the joists.

The facer board preferably comprises an extruded member having a continuous profile along a length of the facer board. The facer board may comprises a first portion arranged for interlocking engagement overtop of an upward facing upper surface of the joists and a second portion resiliently sprung relative to the first portion and arranged to be releasably engaged beneath a corresponding downward facing lower surface of the joists.

The ledger board may comprise a horizontal flange member extending in the longitudinal direction of the ledger board along a top side of the ledger board spaced above the joist connectors so as to be arranged to overlap a top side of a portion of the deck boards supported on the joists.

The ledger board may further comprise a plurality of ledger board sections arranged to be joined to one another by interlocking engagement in an end to end configuration.

The ledger board sections may be arranged to be joined to one another by interlocking engagement by relative sliding movement in an interlocking direction which is perpendicular to the longitudinal direction of the ledger board.

There may be provided a retainer member supported on the ledger board sections for sliding movement relative to the ledger board sections in a longitudinal direction of the ledger board is which the retainer member being arranged to retain two adjacent ledger board sections in interlocking engagement with one another when the retainer member is positioned to span across the two adjacent ledger board sections.

According to another aspect of the present invention there is provided a decking system comprising:

a plurality of joists spanning in parallel, spaced apart from one another; and an upper deck surface comprising a plurality of deck boards, each spanning in a respective longitudinal direction transversely across the plurality of joists and being arranged for interlocking engagement with the joists;

a railing comprising a rail member and a plurality of picket members spanning between the rail member and the upper deck surface;

a plurality of lower sockets formed in the upper deck surface receiving bottom ends of the picket members therein respectively;

the bottom end of each picket member being rotatable in the respective lower socket relative to the upper deck surface between a released position in which the picket member is slidable in a longitudinal direction of the picket member into and out of the respective lower socket and a locked position in which the picket member is retained in the lower socket by interlocking engagement between the bottom end of the picket member and the lower socket.

There may also be provided a plurality of upper sockets in the rail member receiving top ends of the picket members respectively therein in which the top end of each picket member is rotatable in the respective upper socket relative to the rail member between a released position in which the picket member is slidable in a longitudinal direction of the picket member into and out of the respective upper socket and a locked position in which the picket member is retained in the upper socket by interlocking engagement between the top end of the picket member and the upper socket.

The upper deck surface may further comprise a facer board spanning ends of the joists which includes a plurality of the lower sockets therein.

The facer board may comprise a lower portion supported on the joists by interlocking engagement and an upper portion arranged to be releasably mounted along a top side of the lower portion, the upper portion including a plurality of the lower sockets formed therein.

The upper deck surface may further comprise an outermost joist spanning parallel to the joists along one end of the upper deck surface in which the outermost joist includes a plurality of the lower sockets formed therein.

When there is provided a ledger board supporting one end of each joist thereon, the outermost joist preferably comprises a lower portion supported on the ledger board by interlocking engagement and an upper portion arranged to be releasably mounted along a top side of the lower portion in which the upper portion includes a plurality of the lower sockets formed therein.

Each of the lower sockets may comprise a pair of diametrically opposed retainer portions arranged for respective interlocking engagement in the locked position with a pair of diametrically opposed retainer portions formed on the bottom end of each picket member.

Each of the upper sockets preferably comprises a pair of diametrically opposed retainer portions arranged for respective interlocking engagement in the locked position with a pair of diametrically opposed retainer portions formed on the top end of each picket member.

There may be provided a readily releasable locking element on the top end of each picket member arranged to retain the picket member in the locked position in an engaged position of the locking element.

According to a further aspect of the present invention there is provided a stair system for use with a deck comprising a plurality of spaced apart joists and a plurality of deck boards spanning transversely across the plurality of joists, the stair system comprising:

a pair of stringers supported parallel and spaced apart from one another to extend between the deck and a lower supporting surface; and a plurality of tread members extending horizontally between the pair of stringers;

the tread members being coupled to the stringers by interlocking engagement therebetween.

The tread members may be supported on the stringers wholly by interlocking engagement therebetween.

Each stringer may comprise a plurality of stringer sections supported in interlocking engagement with one another so as to be arranged for sliding movement relative to one another between an engaged position and a released position.

The stringer sections of each stringer may be arranged to be slidable relative to one another in a vertical direction.

The tread members may interlock with the stringers such that the tread members restrict relative sliding movement between the stringer sections from the engaged position to the released position.

Each tread member may comprise channels in a bottom side thereof arranged to receive a portion of a respective one of the stringers for relative sliding movement in a horizontal direction between a released position and an engaged position in which the tread members are supported on the stringers.

There may be provided a resiliently sprung retainer member arranged to selectively prevent relative sliding movement between each tread member and each of the stringers so as to be arranged to retain the tread members in the engaged position.

There may be provided a railing comprising a rail member and a plurality of picket members supporting the rail member spaced above the stringers in which the tread members include picket apertures formed therein arranged to receive the picket members therethrough such that the picket members prevent relative sliding movement between each tread member and each of the stringers to retain the tread members in the engaged position.

There may be provided a railing comprising a rail member and a plurality of picket members supporting the rail member spaced above the stringers in which the tread members including picket apertures formed therein arranged to support the picket members therein.

When each stringer comprises a plurality of stringer sections supported in interlocking engagement with one another so as to be arranged for sliding movement relative to one another between an engaged position and a released position, there may be provided a joist connector arranged to be connected to one of the joists of the deck in which the joist connector is arranged for interlocking engagement with one of the stringer sections so as to be arranged for sliding movement relative to one another. The joist connector may be coupled in mating connection with the joist so as to be arranged for relative sliding movement along the joist in the longitudinal direction of the joist.

According to another aspect of the present invention there is provided a decking system comprising:

a plurality of joists, each comprising an extruded member having a continuous profile along a length thereof;

a beam comprising an extruded member having a continuous profile along a length thereof, the beam supporting the joists thereon parallel to one another at spaced apart positions along the beam;

an upper deck surface comprising a plurality of deck boards, each spanning in a respective longitudinal direction transversely across the plurality of joists; and a plurality of joist connectors arranged to connect the joists to the beam in interlocking engagement with both the beam and the joists.

The joist connectors may each comprise a pair of lower flanges arranged to receive the beam therebetween for relative sliding movement along the beam and a pair of upper flanges arranged to receive the respective joist therebetween for relative sliding movement along the joist.

The flanges are preferably arranged for resilient clamping the respective component of the system therebetween.

Each joist connector may be arranged to support a level bubble integrally thereon in which the level bubble is arranged to indicate when the beam is supported in a horizontal orientation.

There may be provided a plurality of posts at spaced positions along the beam and a plurality of post connectors supporting the beam on the posts respectively in which each post connector includes a bracket portion arranged for connection to the beam by interlocking engagement therebetween so as to be arranged for relative sliding movement therebetween.

Each post connector may include a bracket portion arranged for connection to the beam and a ball and socket connection between the bracket portion and the post so as to be arranged for relative pivotal movement therebetween.

The joist connectors may be arranged to connect the joists to the beam wholly by interlocking engagement of the joist connectors with both the joists and the beam.

According to a further aspect of the present invention there is provided a structural member for use with a deck comprising a plurality of joists, a beam supporting the joists at spaced apart positions thereon, a ledger board spanning one end of the joists and a plurality of deck boards spanning transversely across the plurality of joists, the structural member comprising:

a main body arranged to provide structural support to the deck; and a level bubble integrally supported on the main body, the level bubble being arranged to indicate when the main body is supported in a horizontal orientation.

There may be provided a receptacle formed on the main body arranged to receive the level bubble therein in a snap fit configuration.

The structural member may comprise a ledger board of the deck; a connector bracket arranged to be secured to the beam; or a joist of the deck. The main body may comprises a molded member having an integrally molded receptacle or groove formed therein and arranged to support the level bubble therein.

Some embodiments of the invention will now be described in conjunction with the accompanying drawings in which:

BRIEF DESCRIPTION OF THE DRAWINGS

FIG. 1 is a perspective view of the decking system.

FIG. 2 is an end elevational view of one of the joists.

FIG. 3 is a perspective view of one of the joists.

FIG. 4 is a perspective view showing a bottom side of one of the decking boards.

FIG. 5 is side elevational view of one of the decking boards.

FIG. 6 is a bottom plan view of one of the decking boards.

FIG. 7 is an end elevational view of one of the decking boards.

FIG. 8 is a perspective view of the ledger board.

FIG. 9 is a perspective view some of the joists supported on the ledger board.

FIG. 10 is a sectional view in a vertical plane along one of the joists connected to the ledger board and supporting a decking board thereon.

FIG. 11 is a front elevational view of the end of the ledger board illustrating one of the intermediate joists and the outermost joist supported thereon.

FIG. 12 is a perspective view of a first mating end of one of the ledger board sections.

FIG. 13 is a perspective view of a second mating end of one of the ledger board sections for mating with the first mating end shown in FIG. 12.

FIG. 14 is a perspective view of a rear side of two ledger board sections coupled together.

FIG. 15 is a perspective view of the outermost joist supported on the end of the ledger board.

FIG. 16 is a perspective view of the facer board supported on the end of one of the joists.

FIG. 17 is a perspective view of a plurality of joists supported on the beam by interlocking joist connectors.

FIG. 18 is a sectional elevational view of the beam supported on a suitable support post.

FIG. 19 is a perspective view of the bracket portion of one of the post connectors.

FIG. 20 is a sectional elevational view of the railing member shown supported on the top end of the pickets.

FIG. 21 is a perspective view of a bottom end of one of the pickets.

FIG. 22 is a sectional view of the outermost joist shown supporting the bottom end of one of the pickets therein.

FIG. 23 is a sectional view of the facer board shown supported on the end of one of the joists and shown supporting the bottom end of one of the pickets therein.

FIG. 24 is a perspective view of a wall mounting bracket of the railing member.

FIG. 25 and FIG. 26 are perspective views of a corner bracket supporting two railing members at right angles relative to one another on a corner post of the decking system.

FIG. 27 is a perspective view of the stair system with some of the components shown removed.

FIG. 28 is a sectional elevational view of the stair system in a vertical plane of the picket members.

FIG. 29 is perspective view of two sections of one of the stringers shown separated from one another.

FIG. 30 is a perspective view showing a bottom side of one of the tread members.

FIG. 31 and FIG. 32 are respective bottom plan and rear elevational views of the tread member of FIG. 30.

FIG. 33 is a perspective view of the railing member shown supported on the top ends of a plurality of pickets of the stair system.

FIG. 34 is a sectional view of the railing member according to FIG. 33.

FIG. 35 is a perspective view of the decking system in a partially assembled configuration.

FIG. 36 is a perspective view of one of the deck boards.

FIG. 37 and FIG. 38 are partly sectional perspective views of the ledger board before and after mounting a joist thereon respectively.

FIG. 39 is a perspective view of a portion of the ledger board.

FIG. 40 is a perspective view of two adjacent modular sections of the ledger board joined together.

FIG. 41 is a partly sectional perspective view of an outermost joist and an intermediate joist supported on the ledger board.

FIG. 42 is an end elevational view of the facer board supported on the ends of the joists.

FIG. 43 is a perspective view of a bottom end of one of the picket members.

FIG. 44 is a perspective view of a top end of one of the picket members.

FIG. 45 is a perspective view of an end of the railing member.

FIG. 46 is a perspective view of the wall mounting bracket of the railing member.

FIG. 47 is a perspective view of the corner bracket for joining two adjacent railing members.

FIG. 48 is a perspective view of the railing member of the stair system.

In the drawings like characters of reference indicate corresponding parts in the different figures.

DETAILED DESCRIPTION

Figure 1:
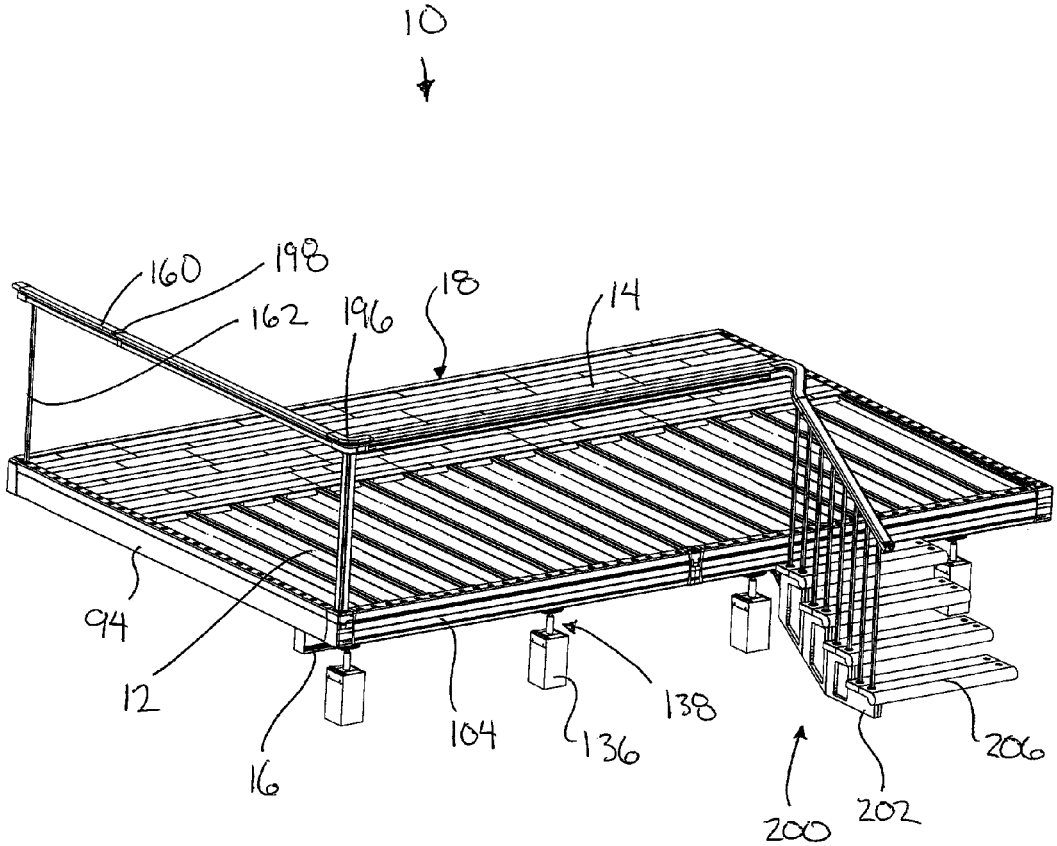
FIGS. 1 through 34 illustrate a first embodiment of the decking system.
Figures 2, 3:
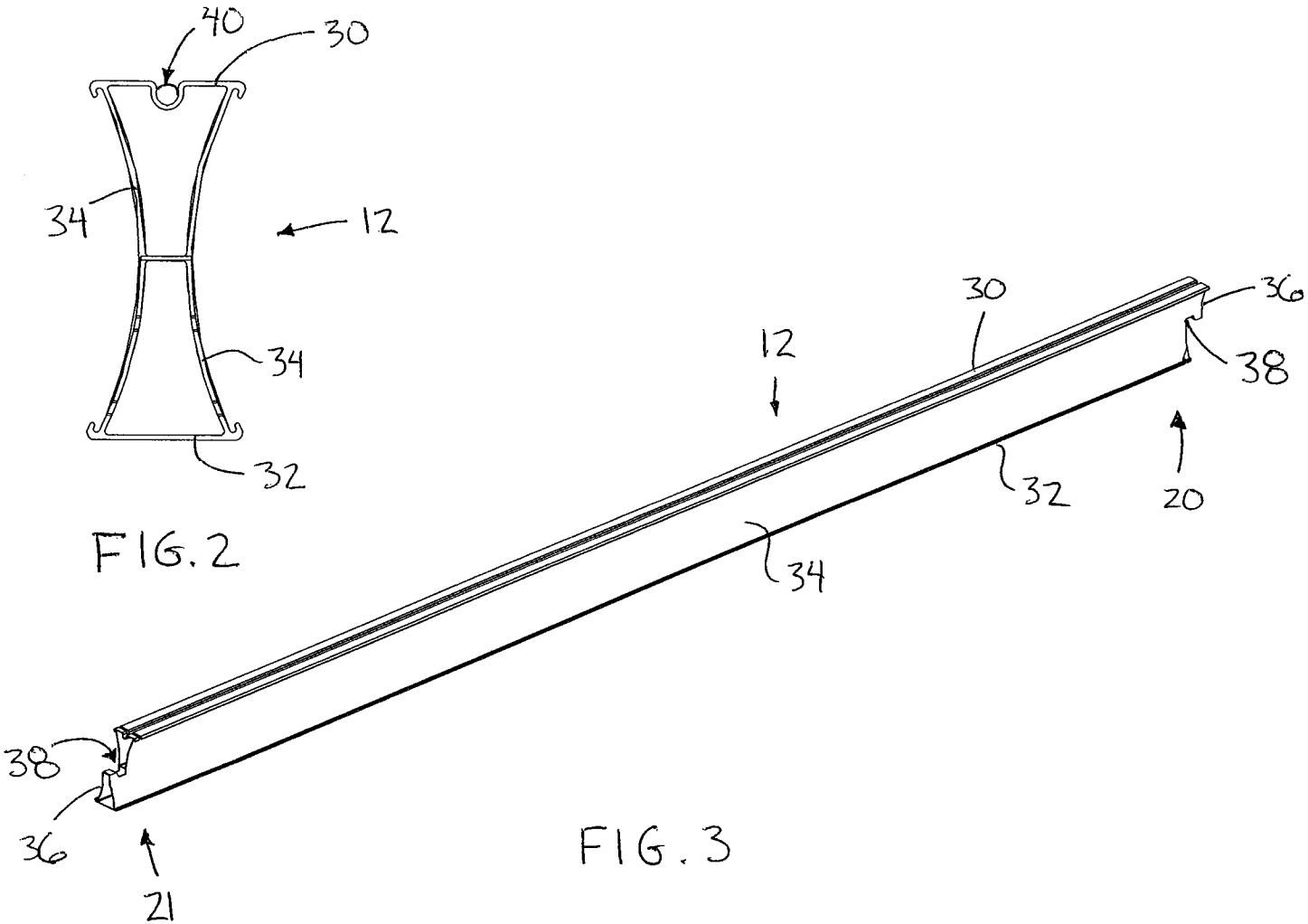
Figure 4:
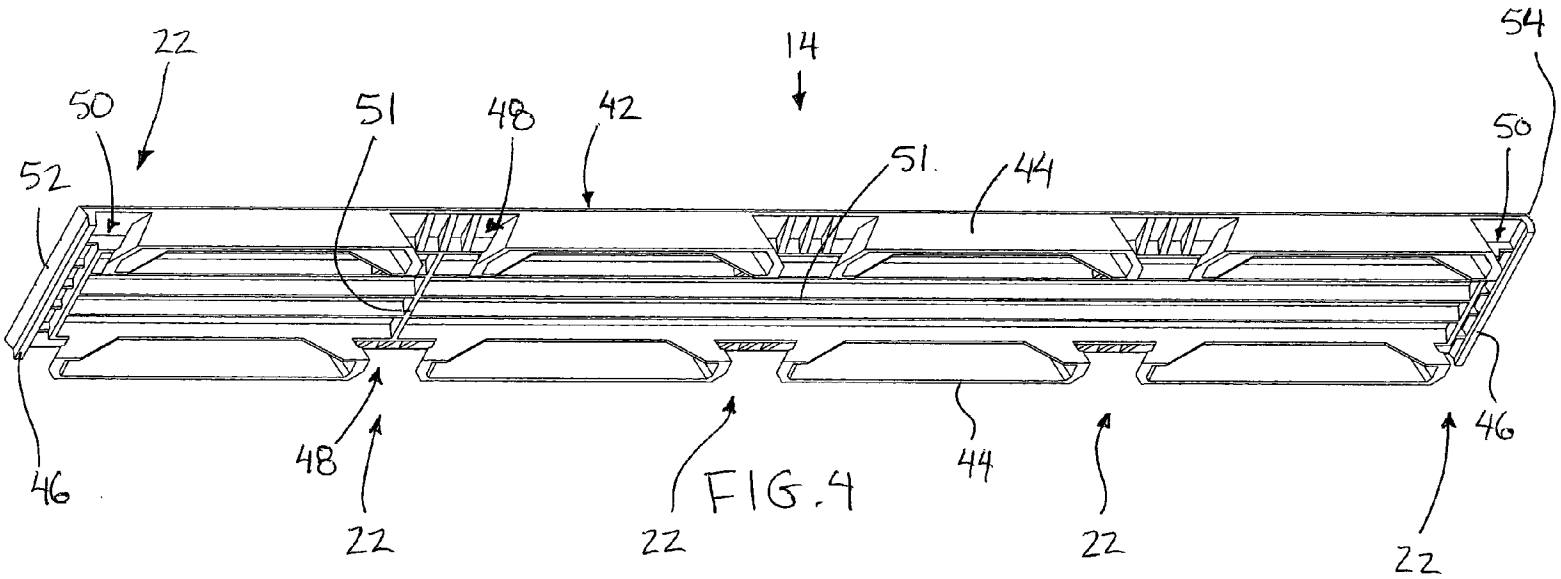
Figure 5:
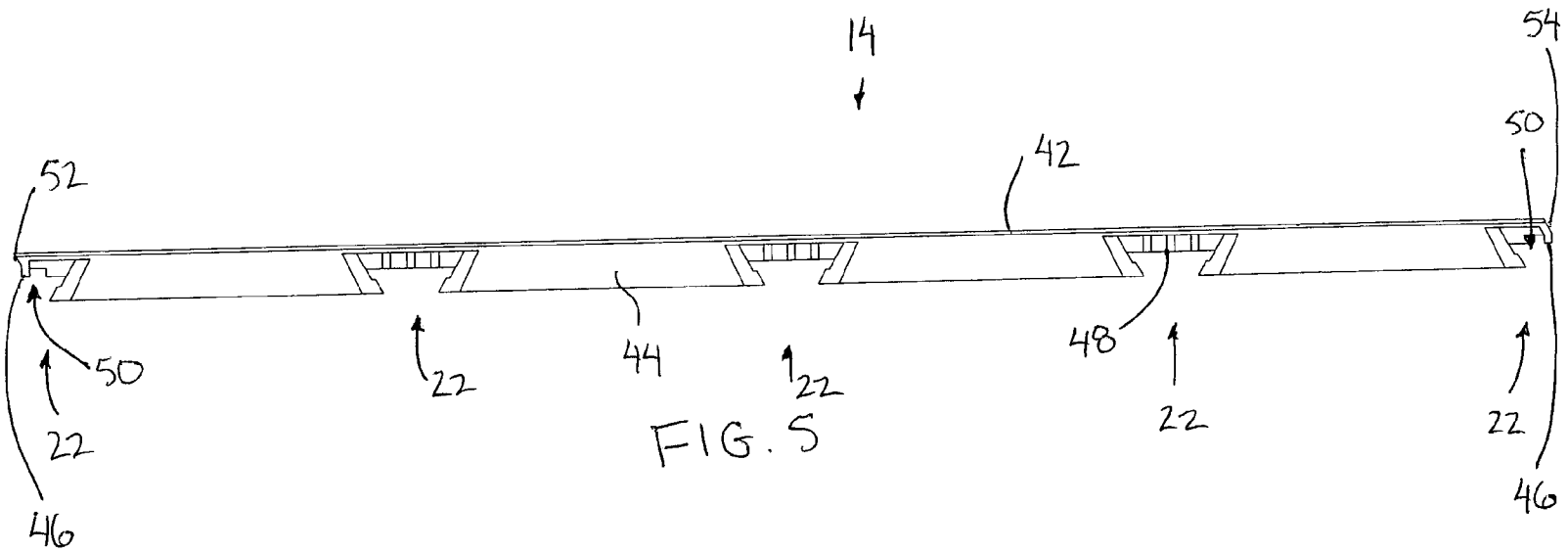
Figure 6:
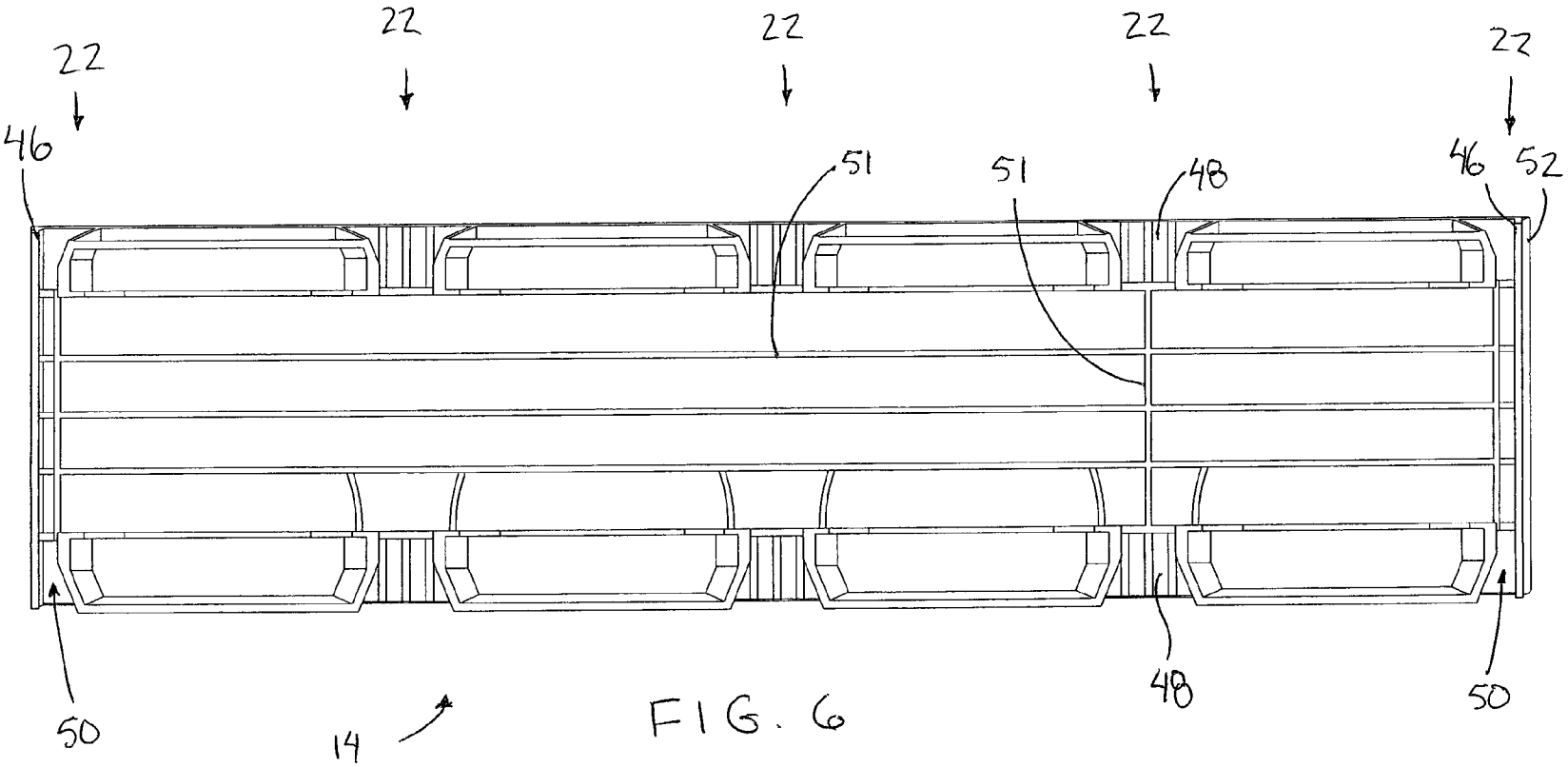
Figure 7:
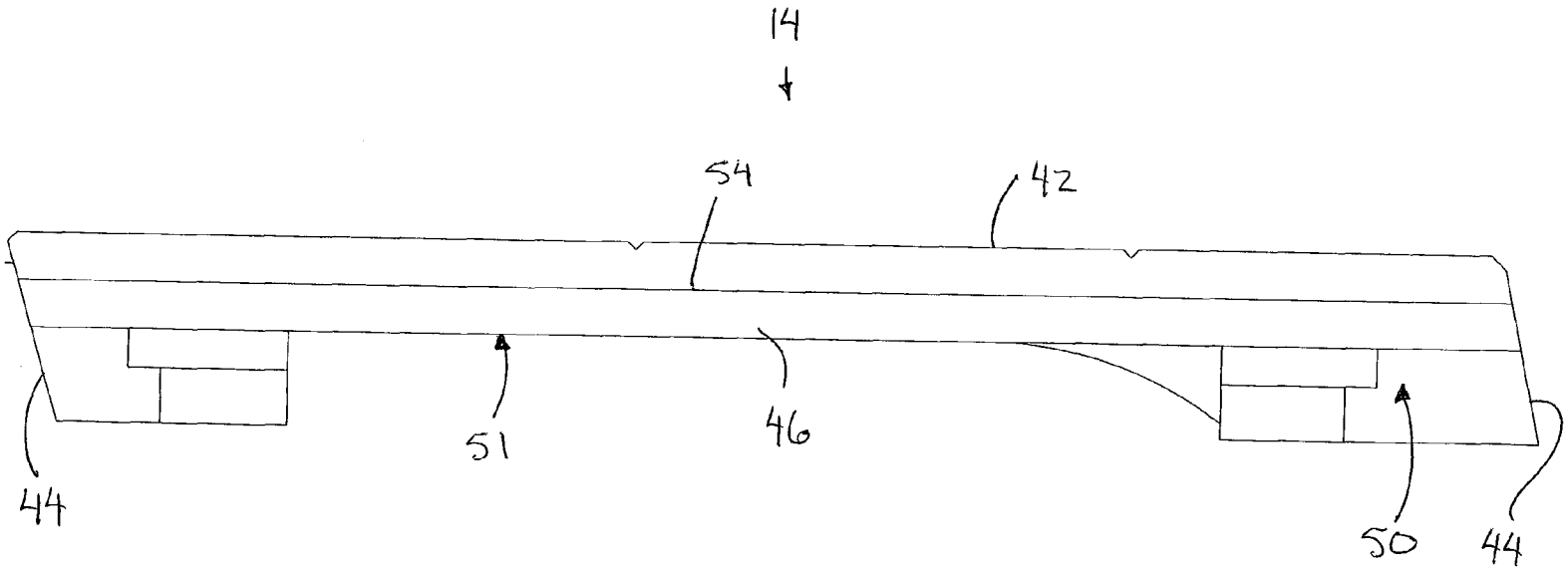
Figure 8:
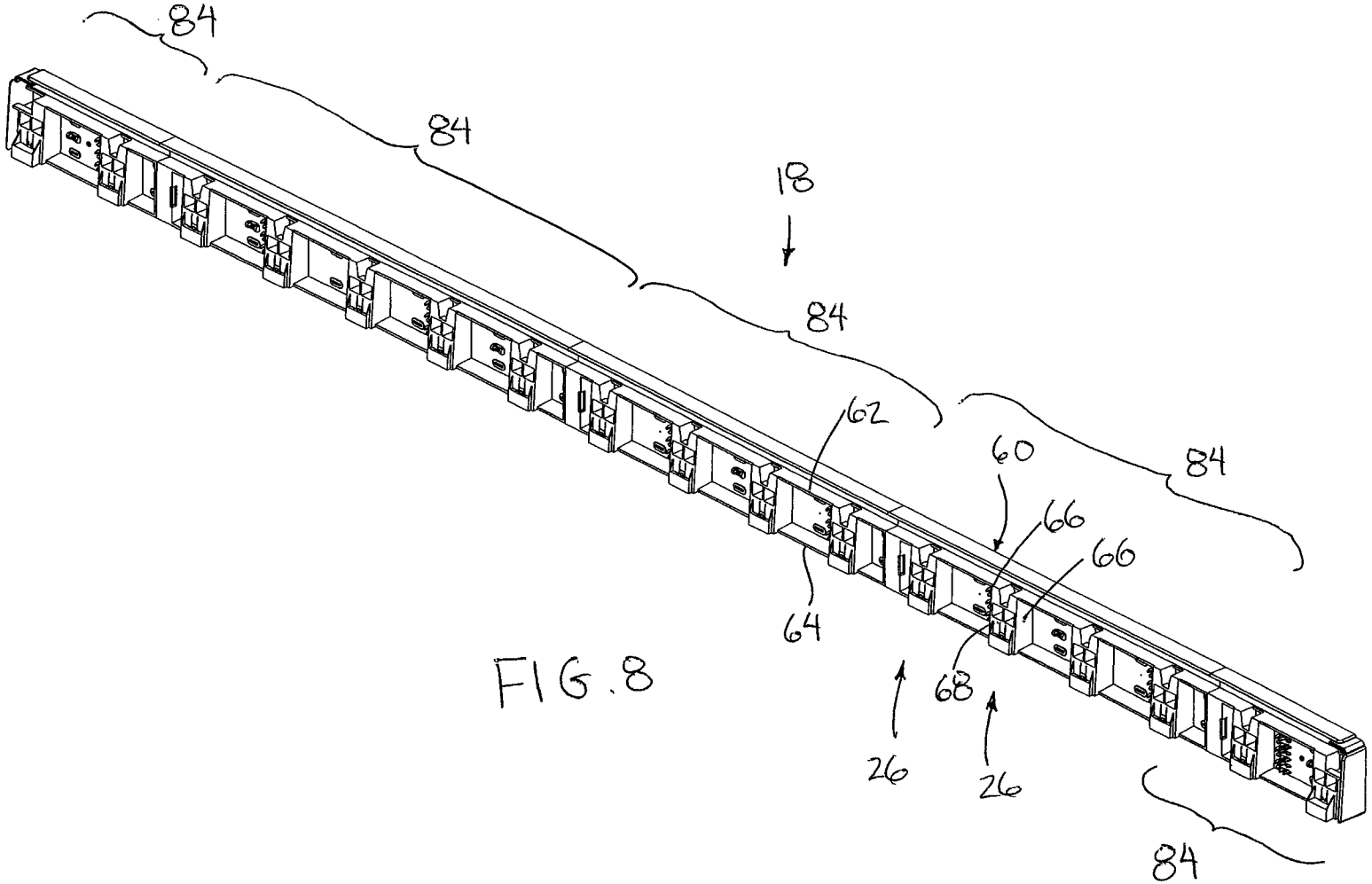
Figure 9:
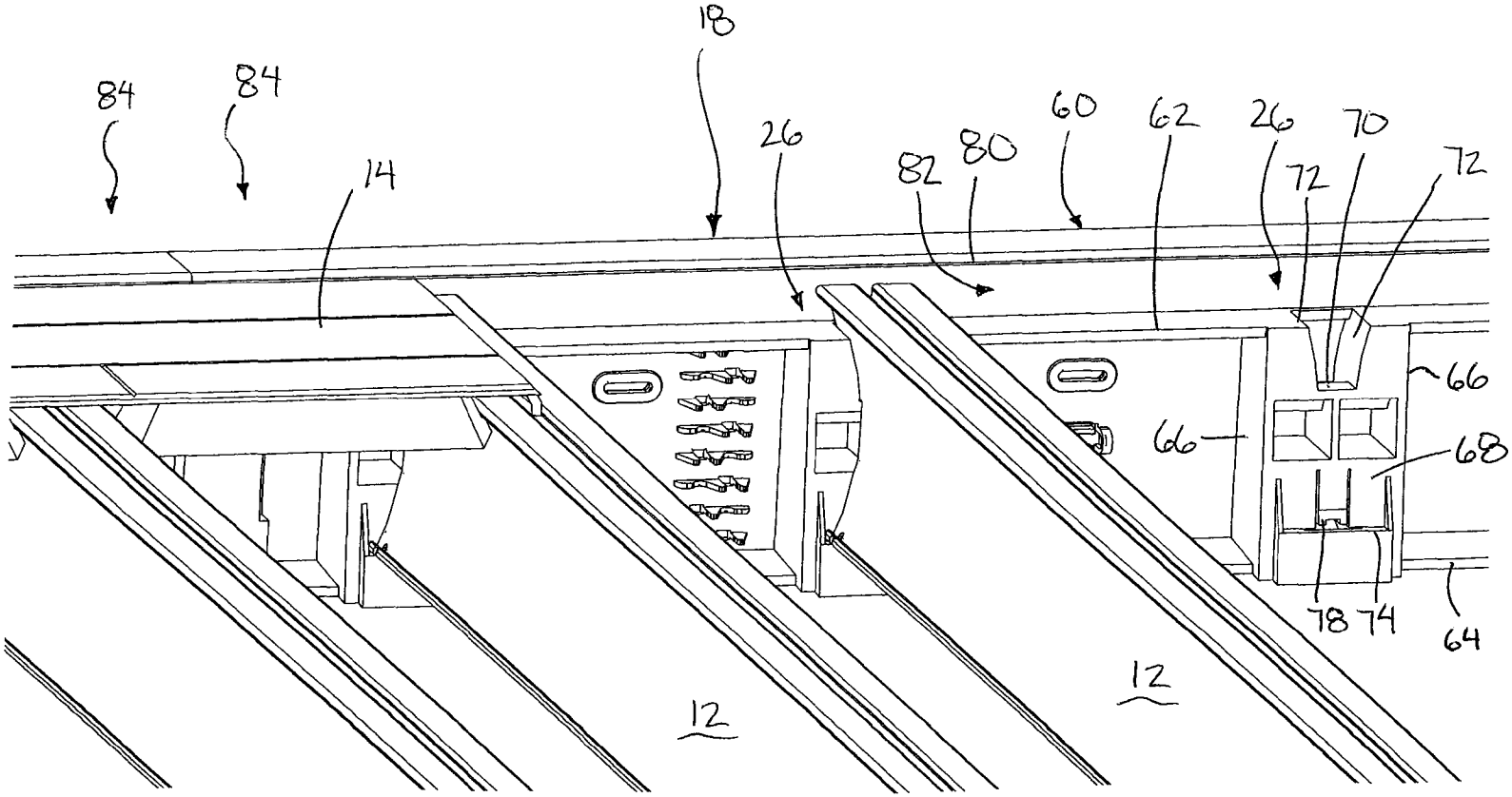
Figure 10:
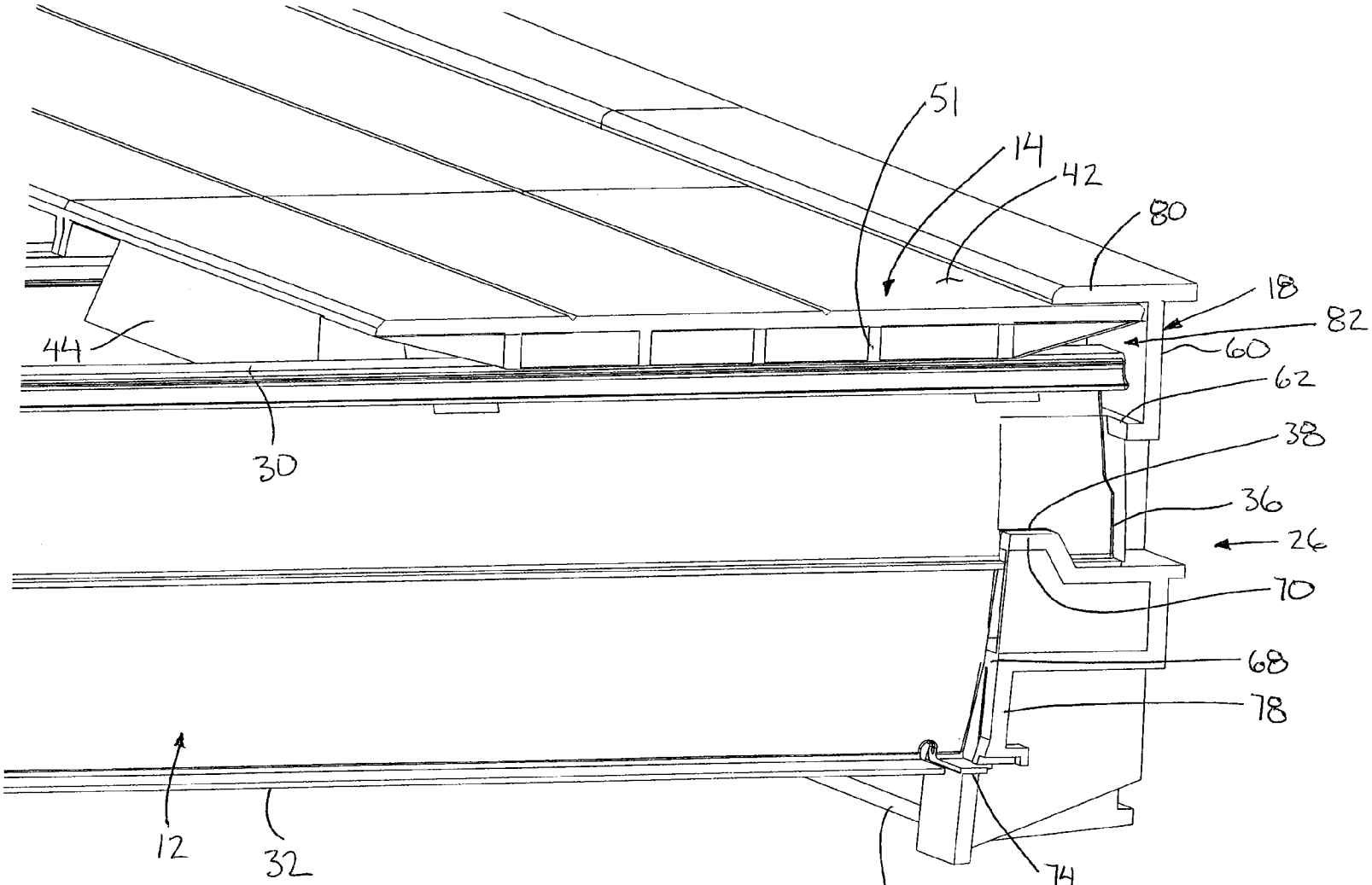
Figure 11:
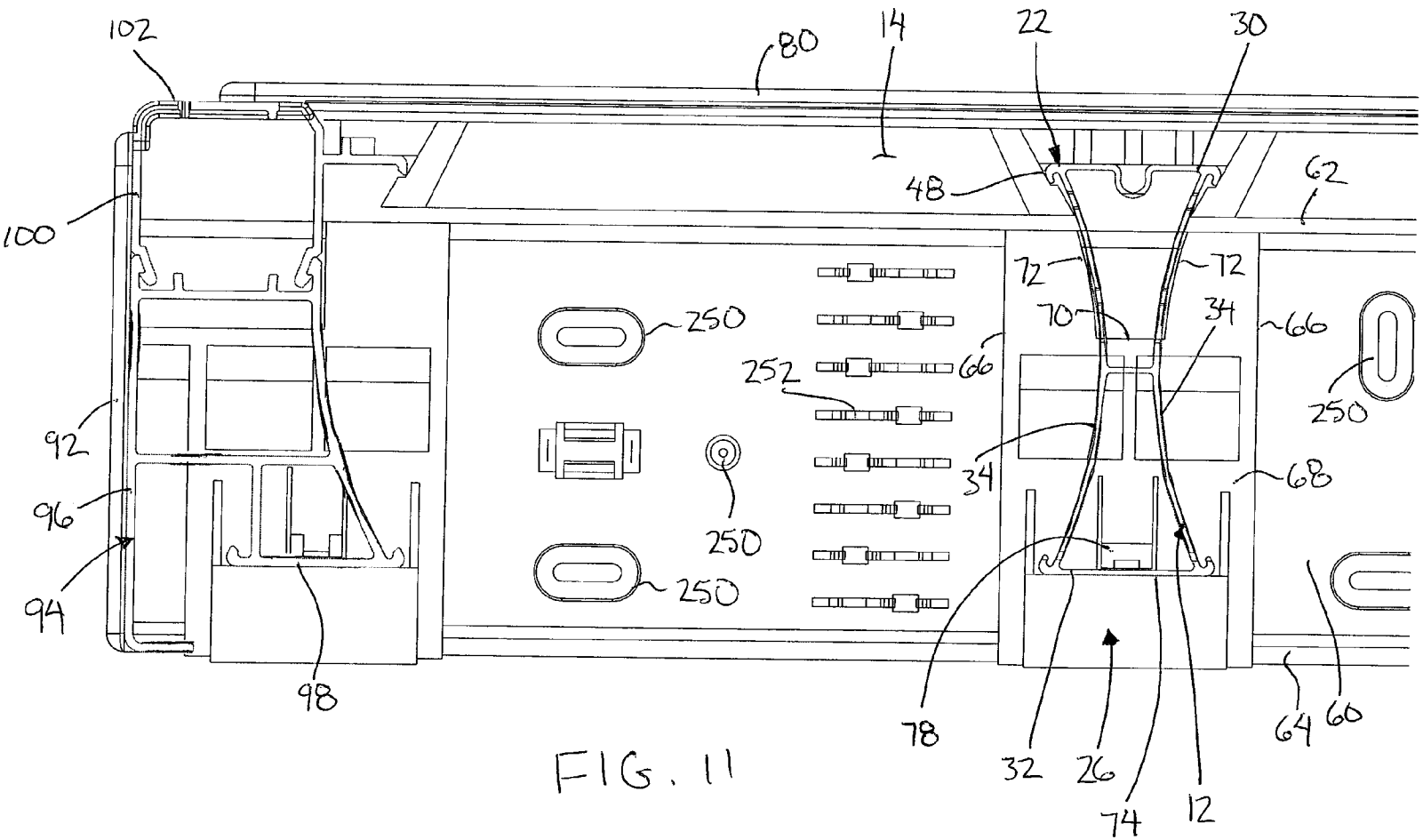
Figure 13:
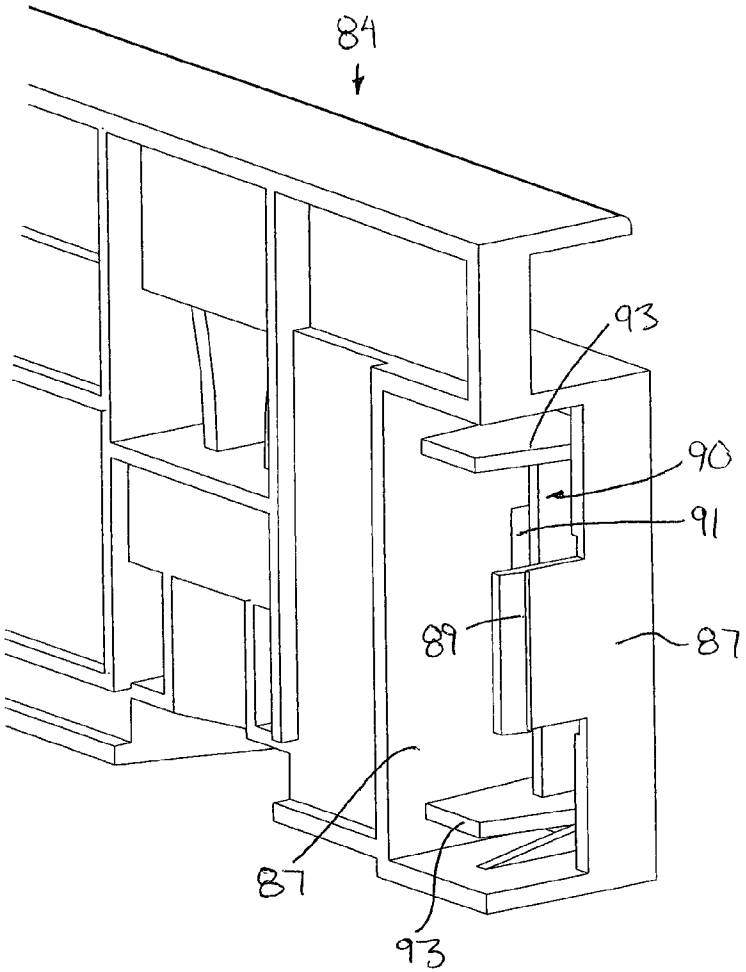
Figure 12:
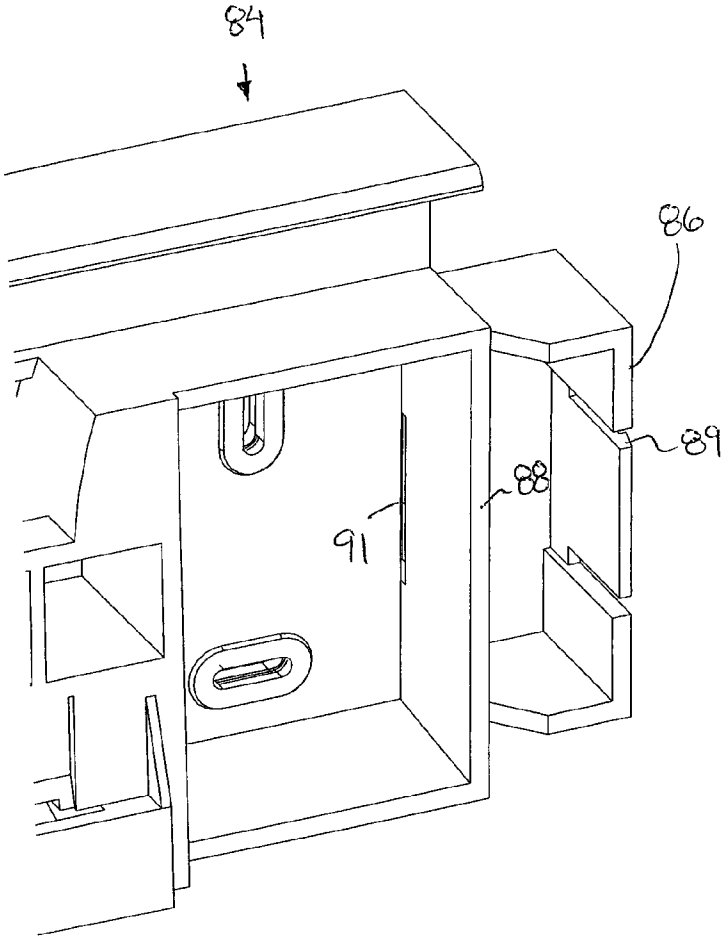
Figure 14:
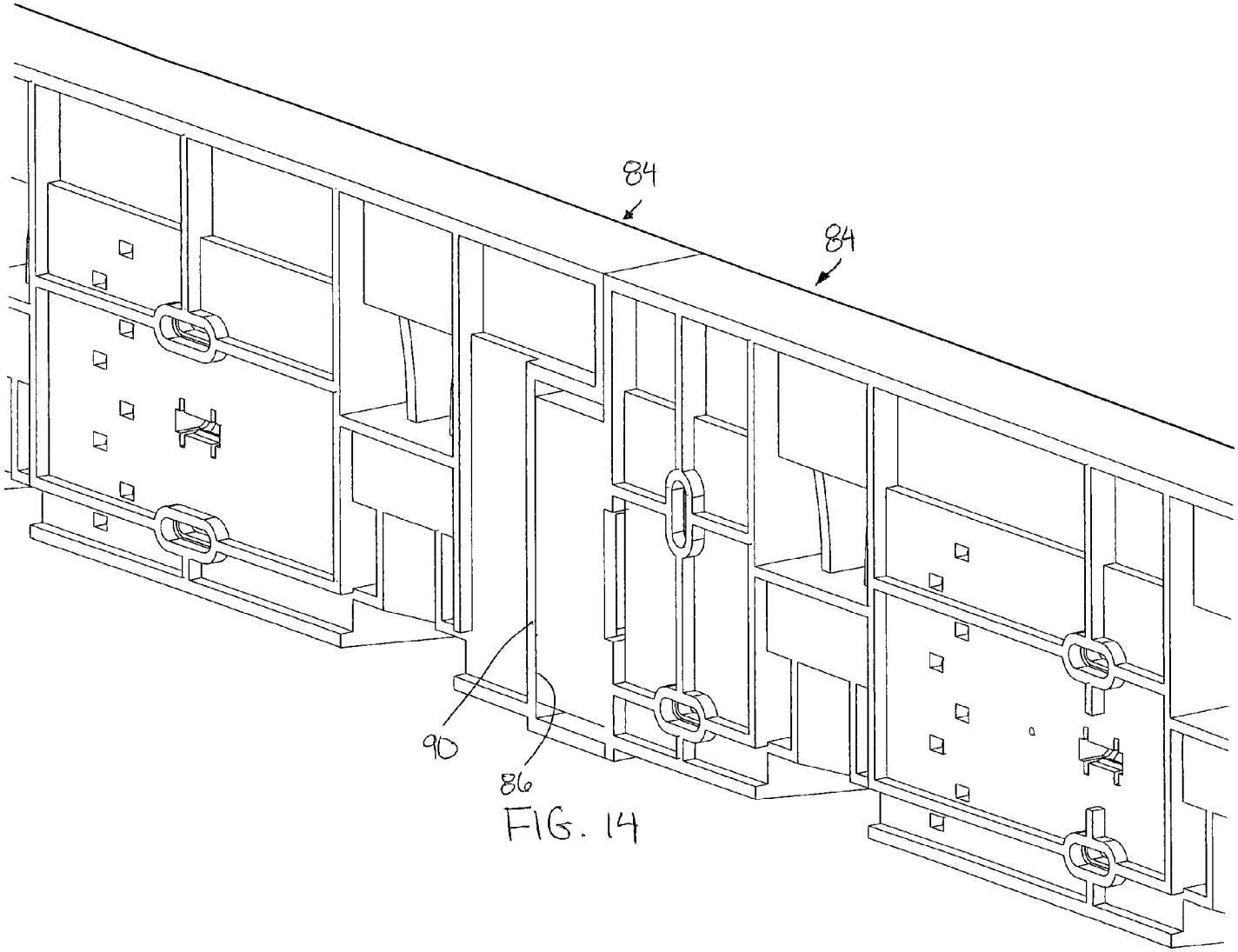
Figure 15:
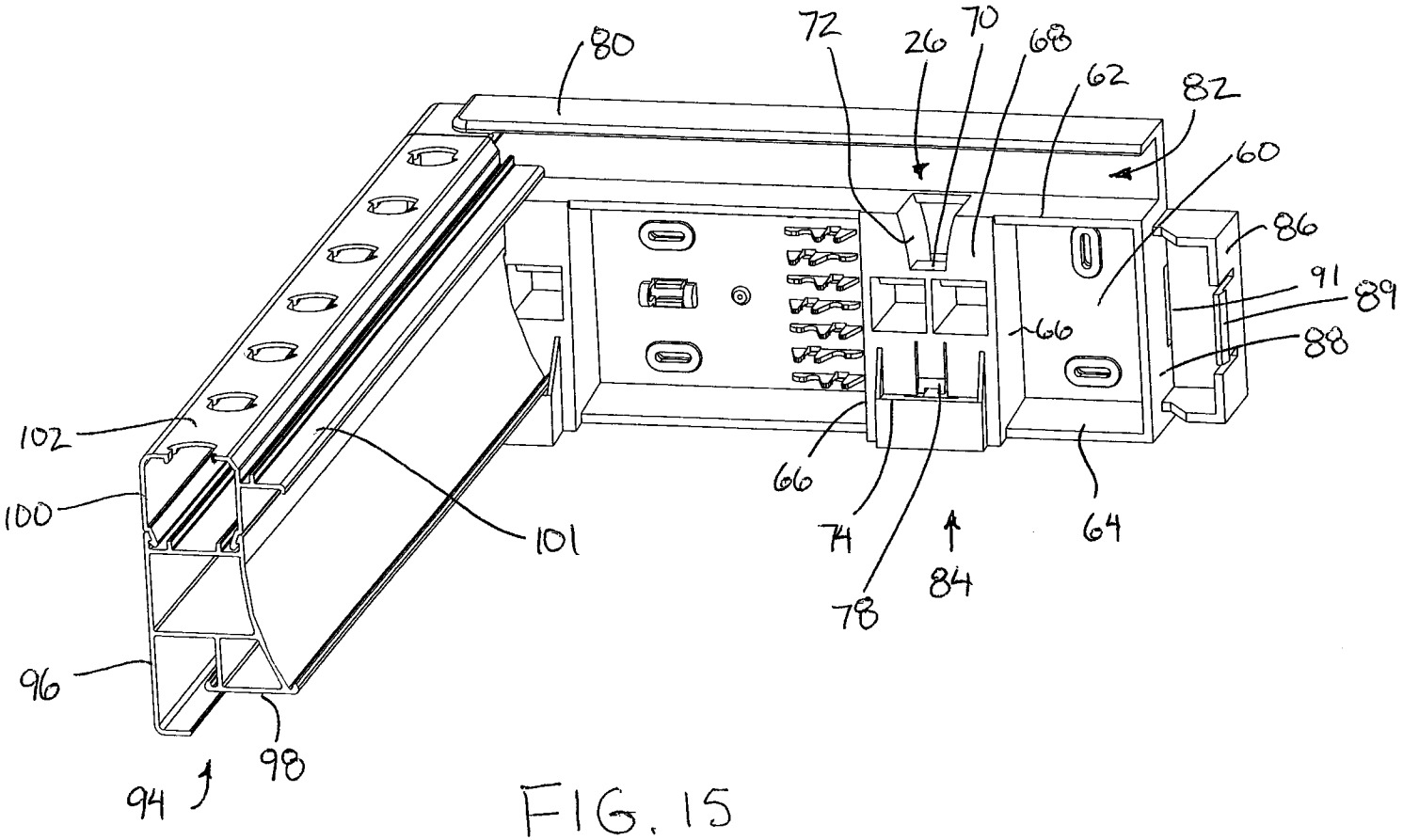
Figure 16:
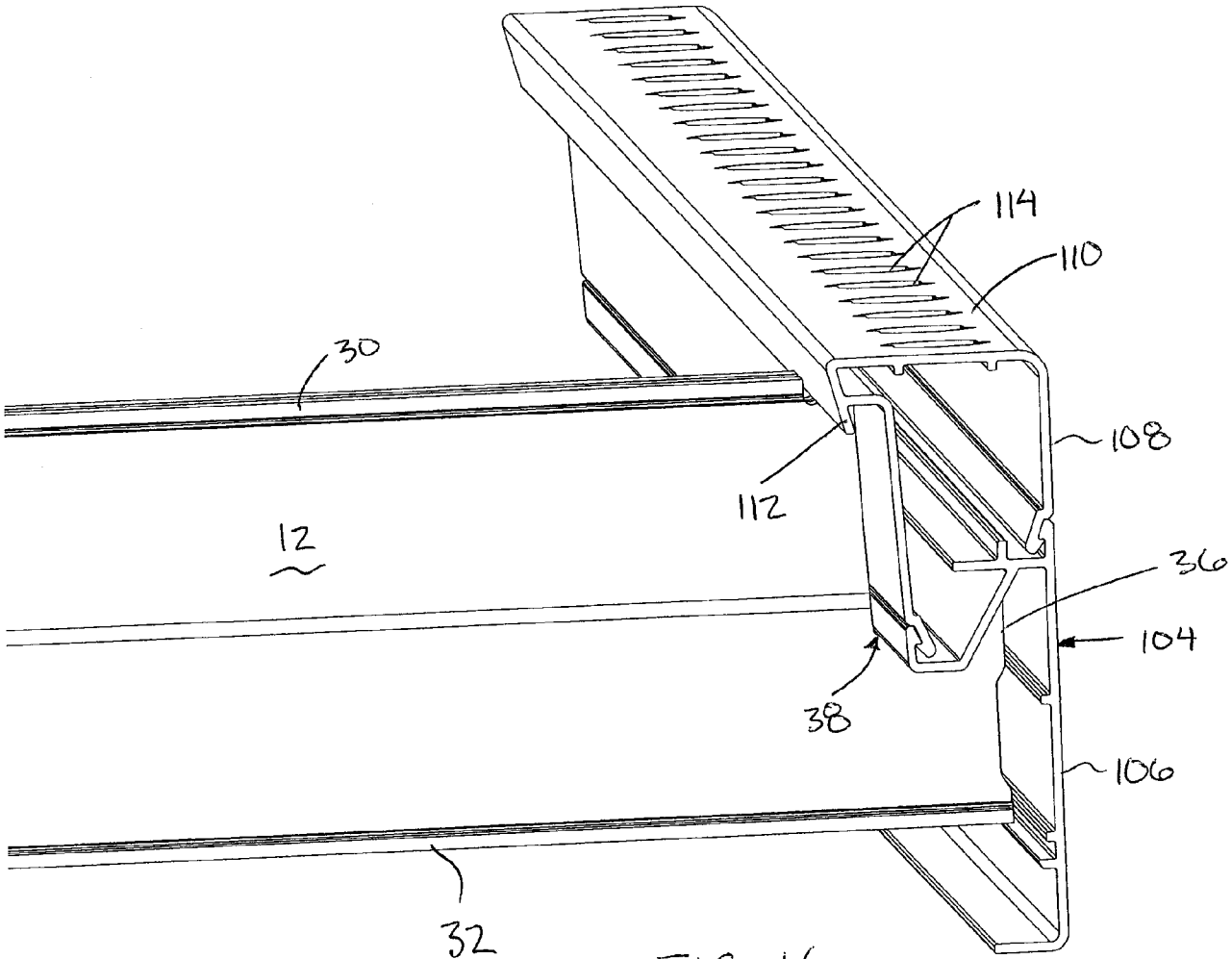
Figure 17:
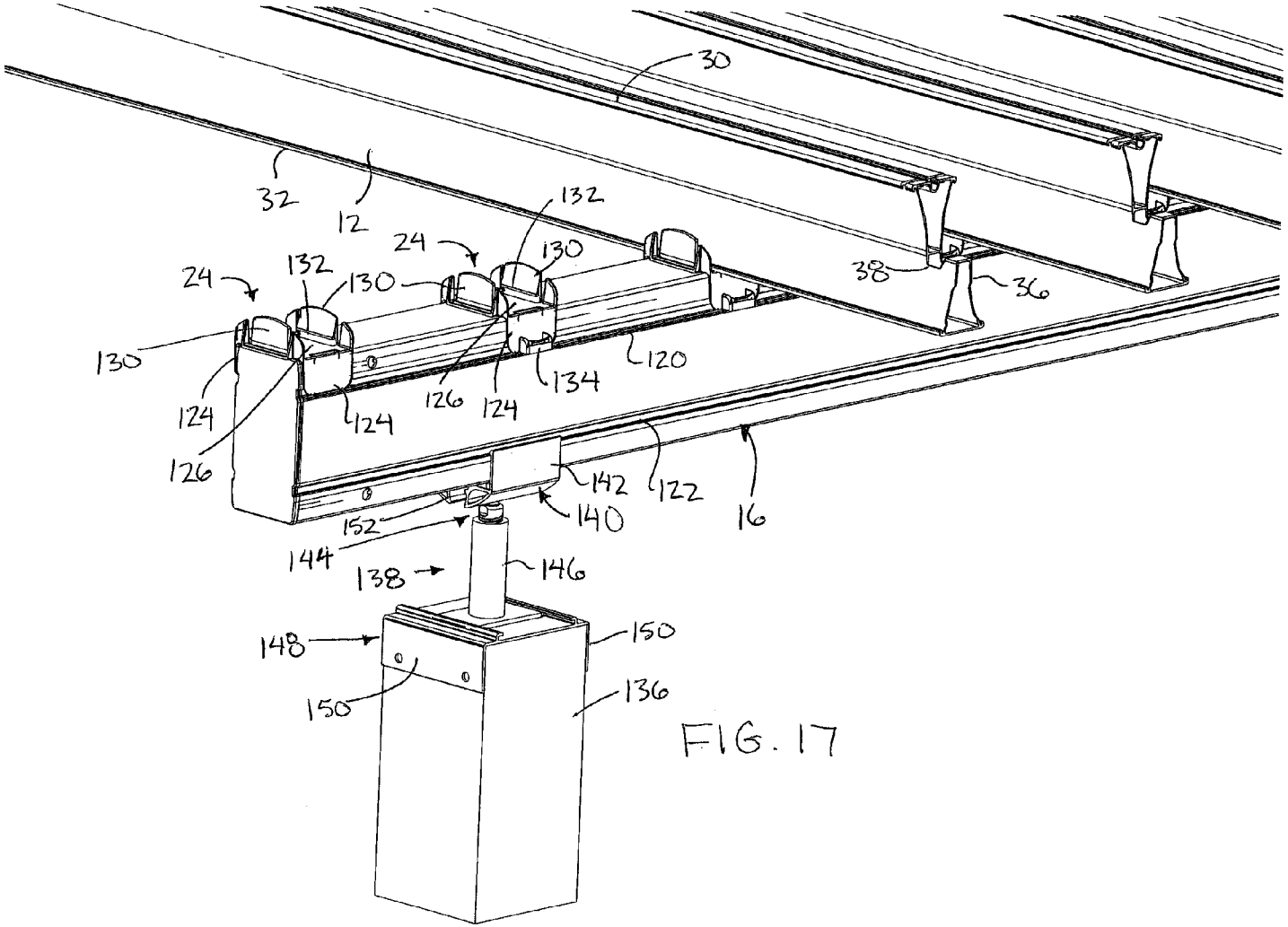
Figure 18:
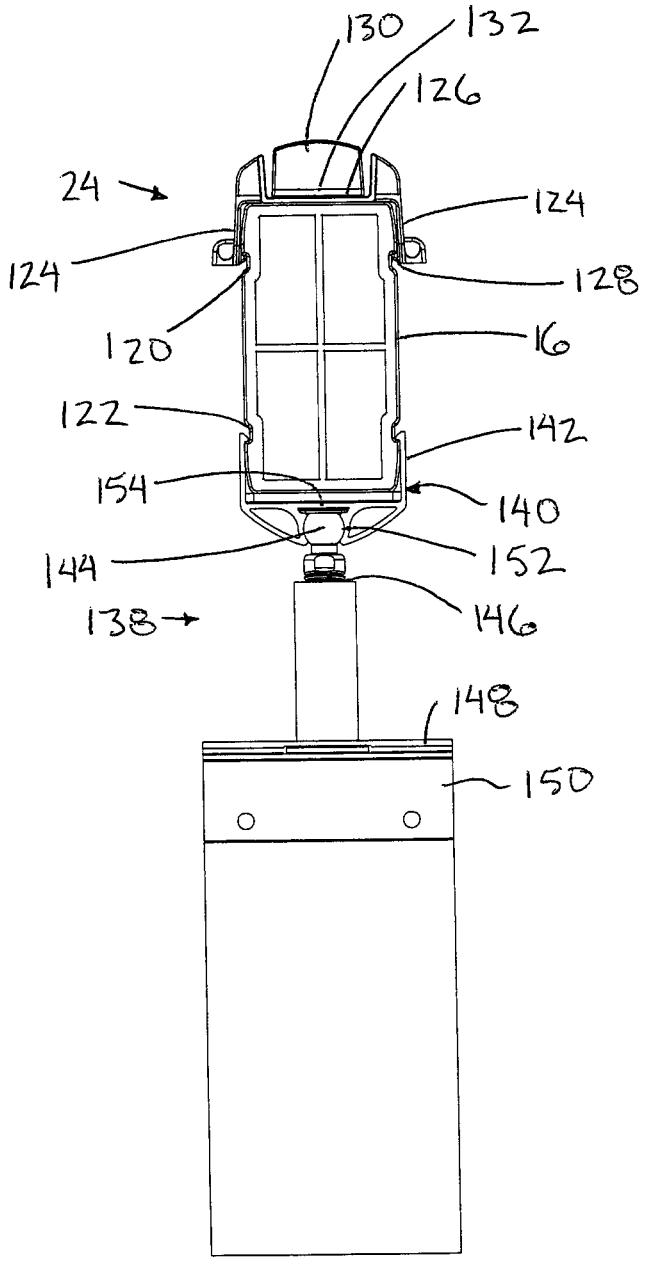
Figure 19:
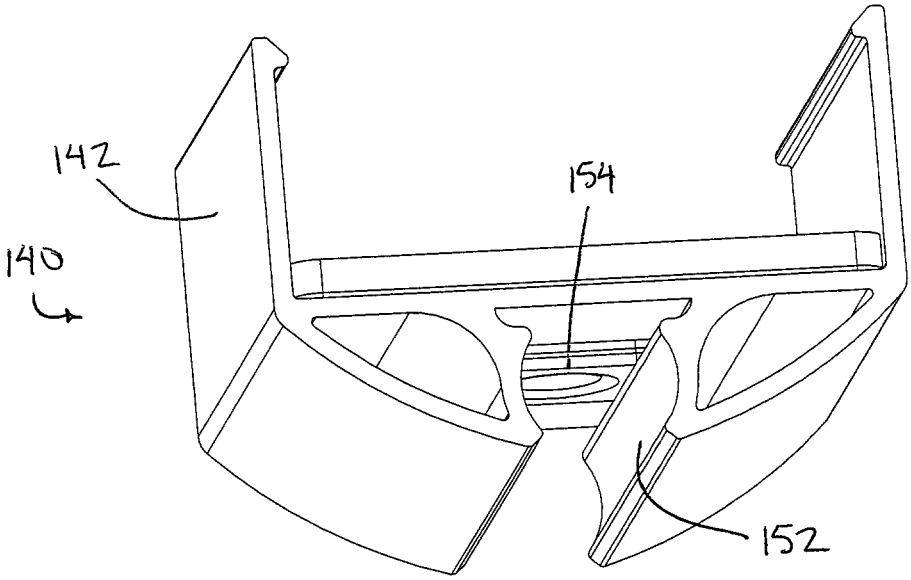
Figure 20:
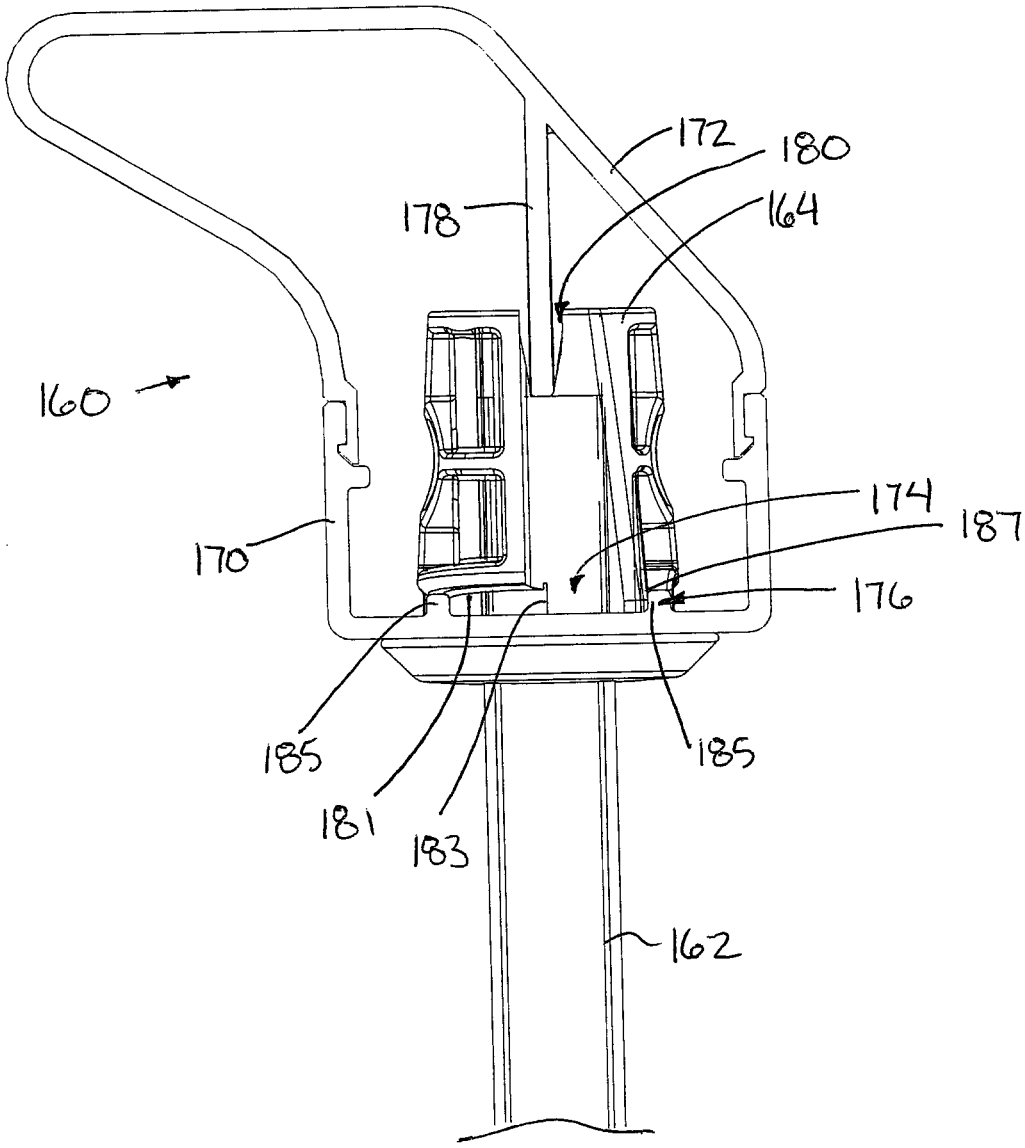
Figure 22:
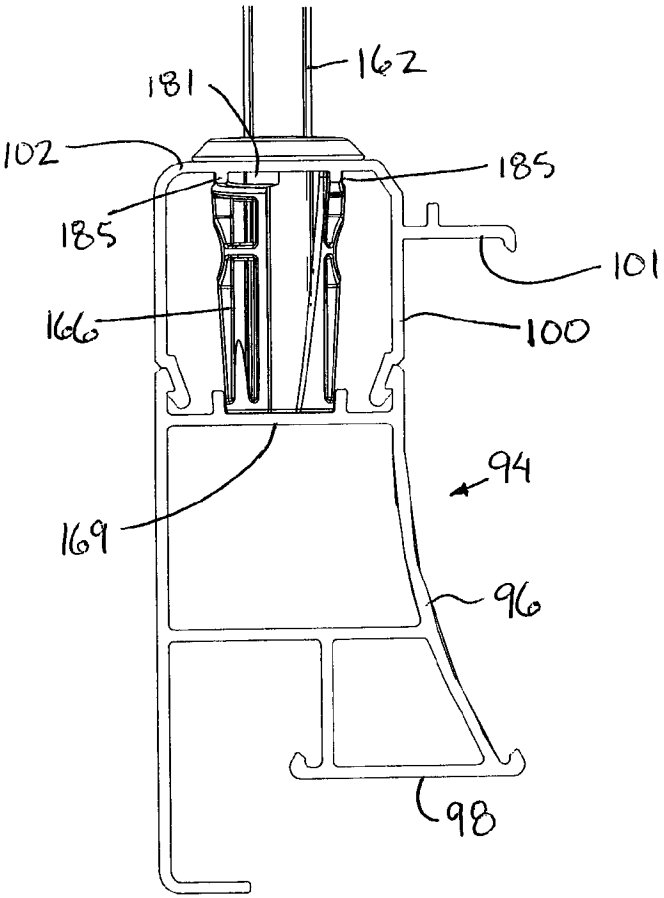
Figure 21:
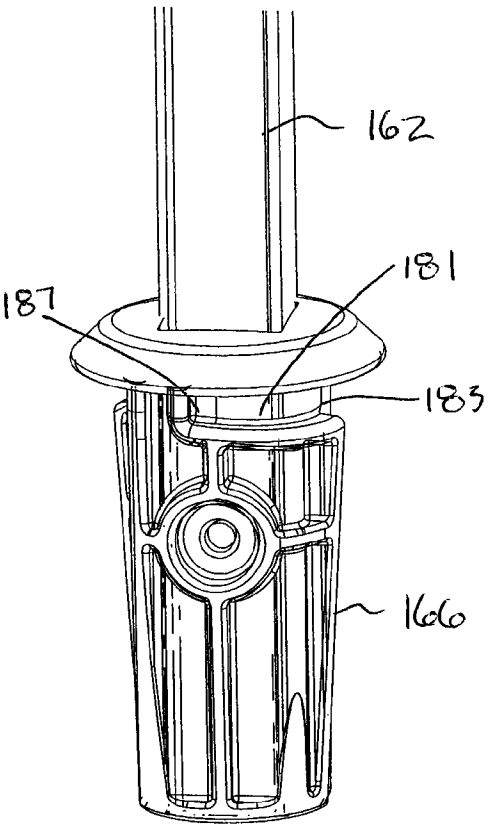
Figure 23:
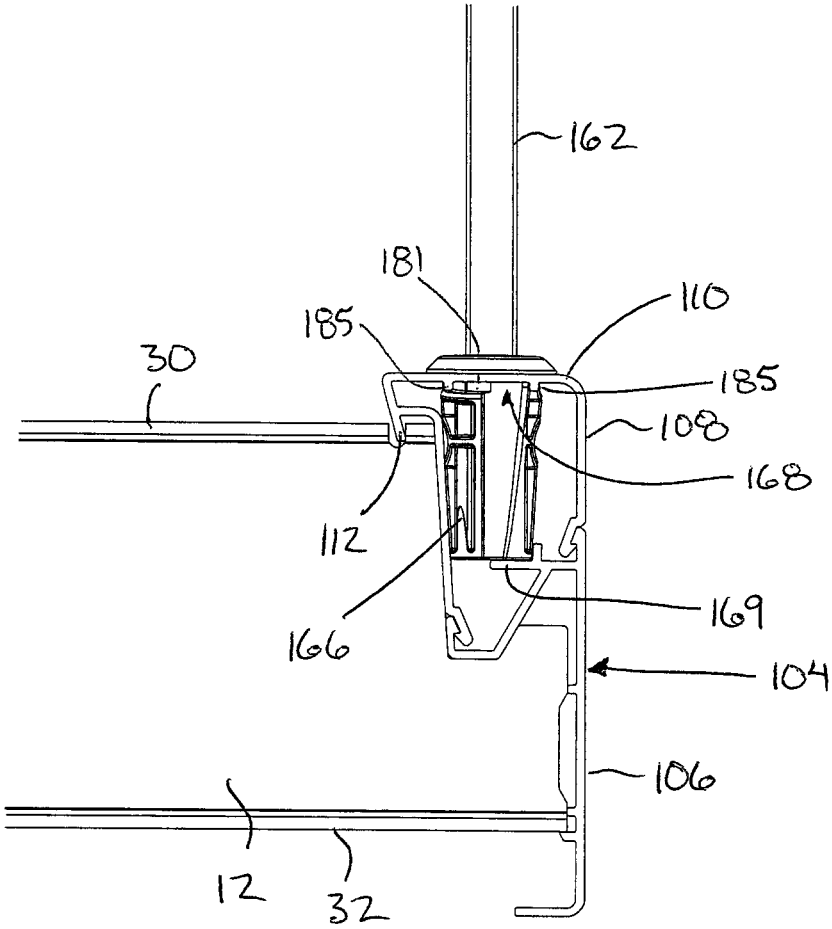
Figure 24:
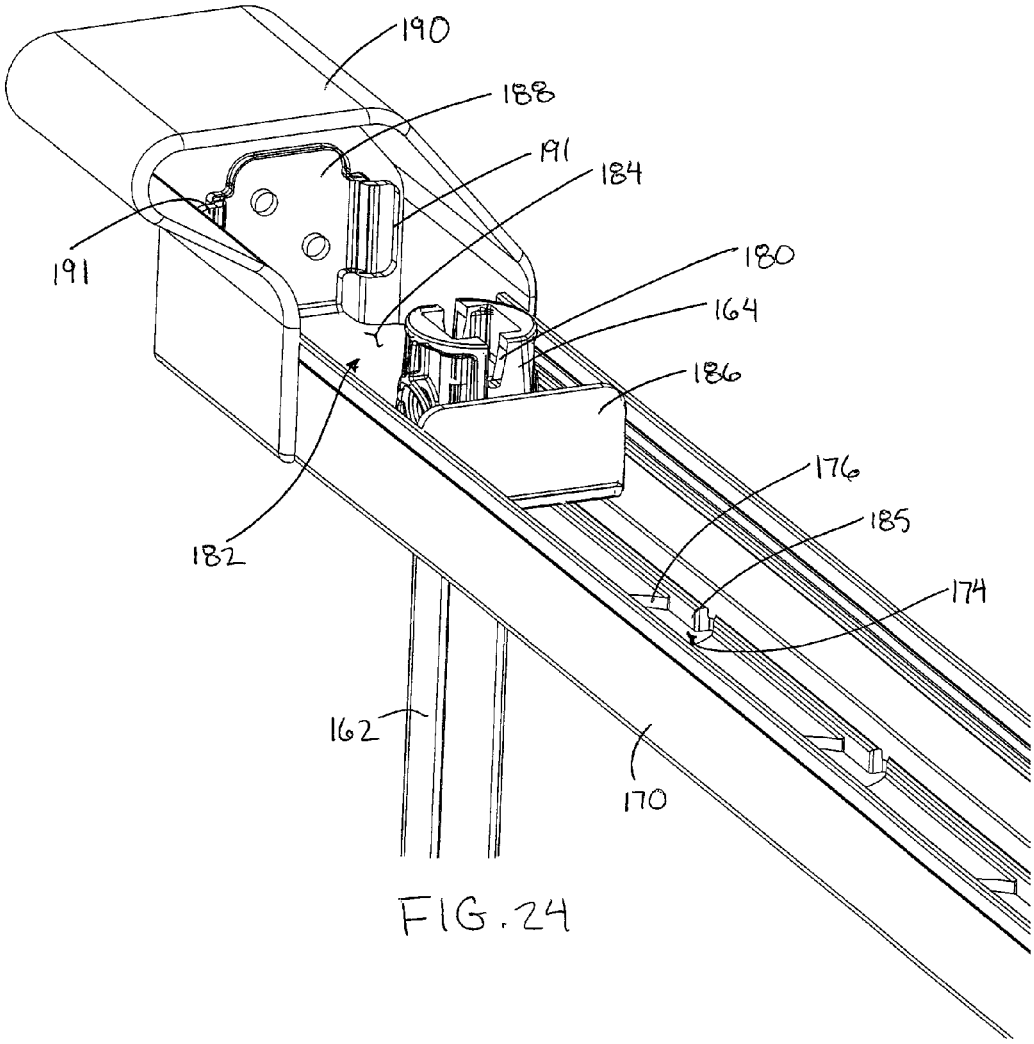
Figure 25:
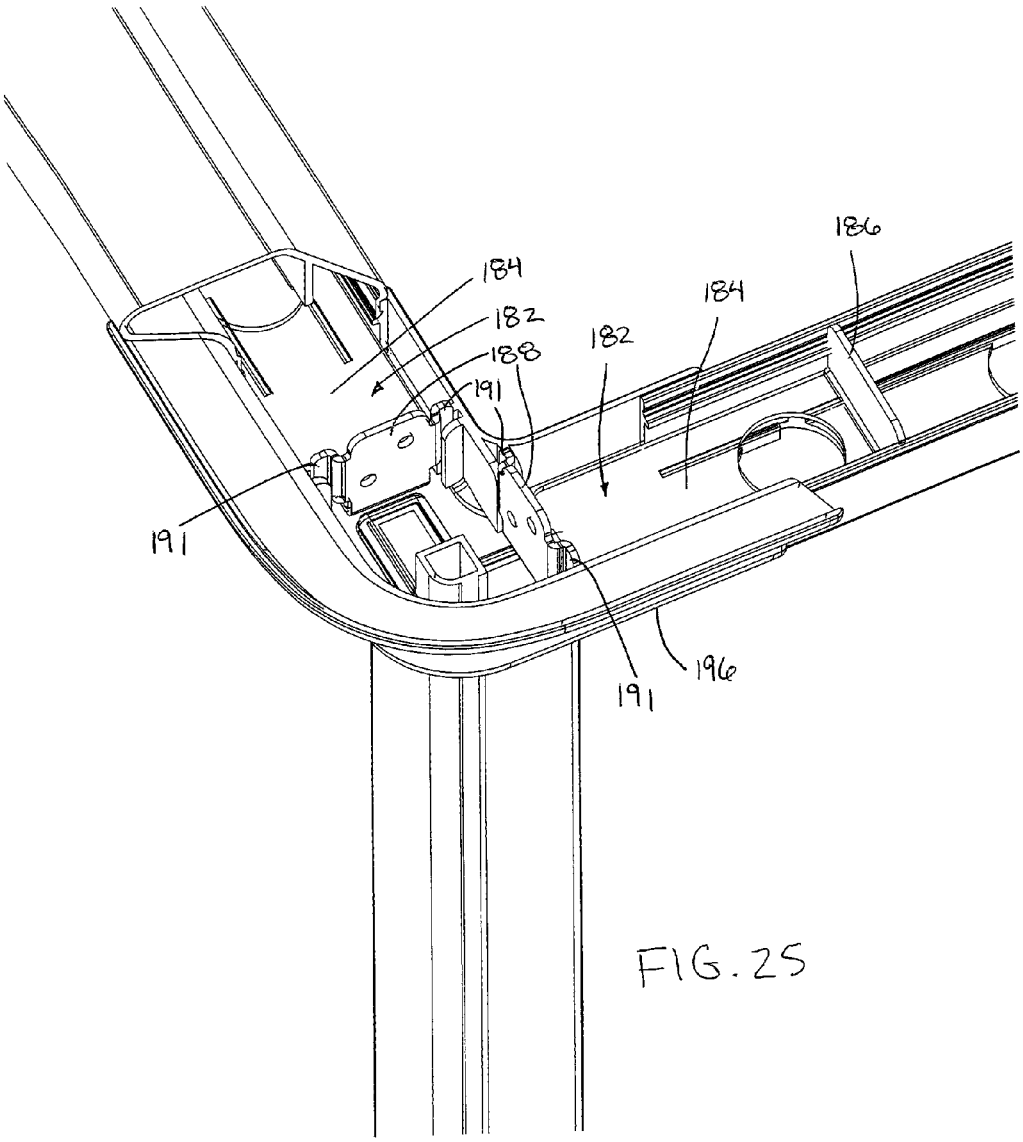
Figure 26:
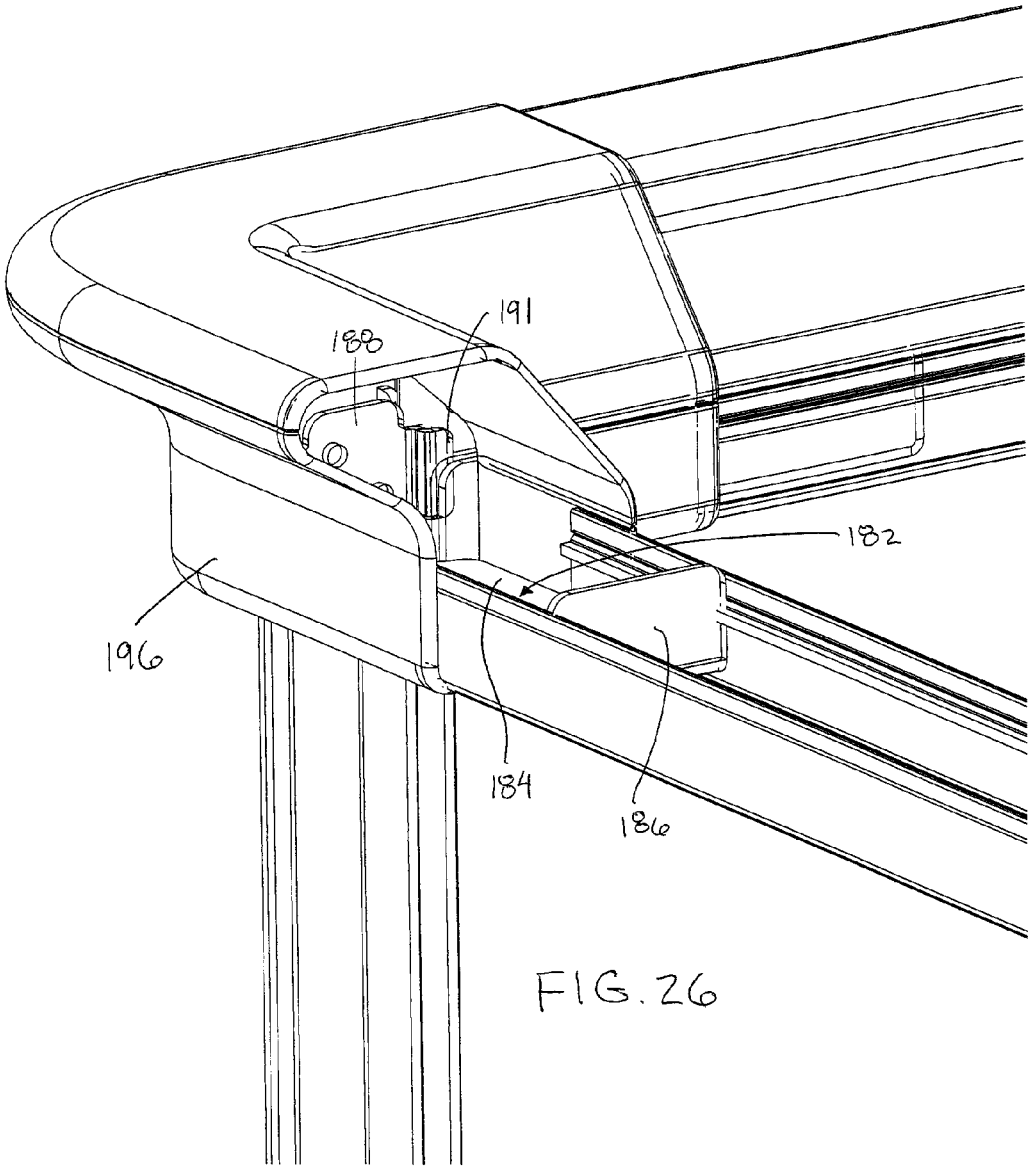
Figure 27:
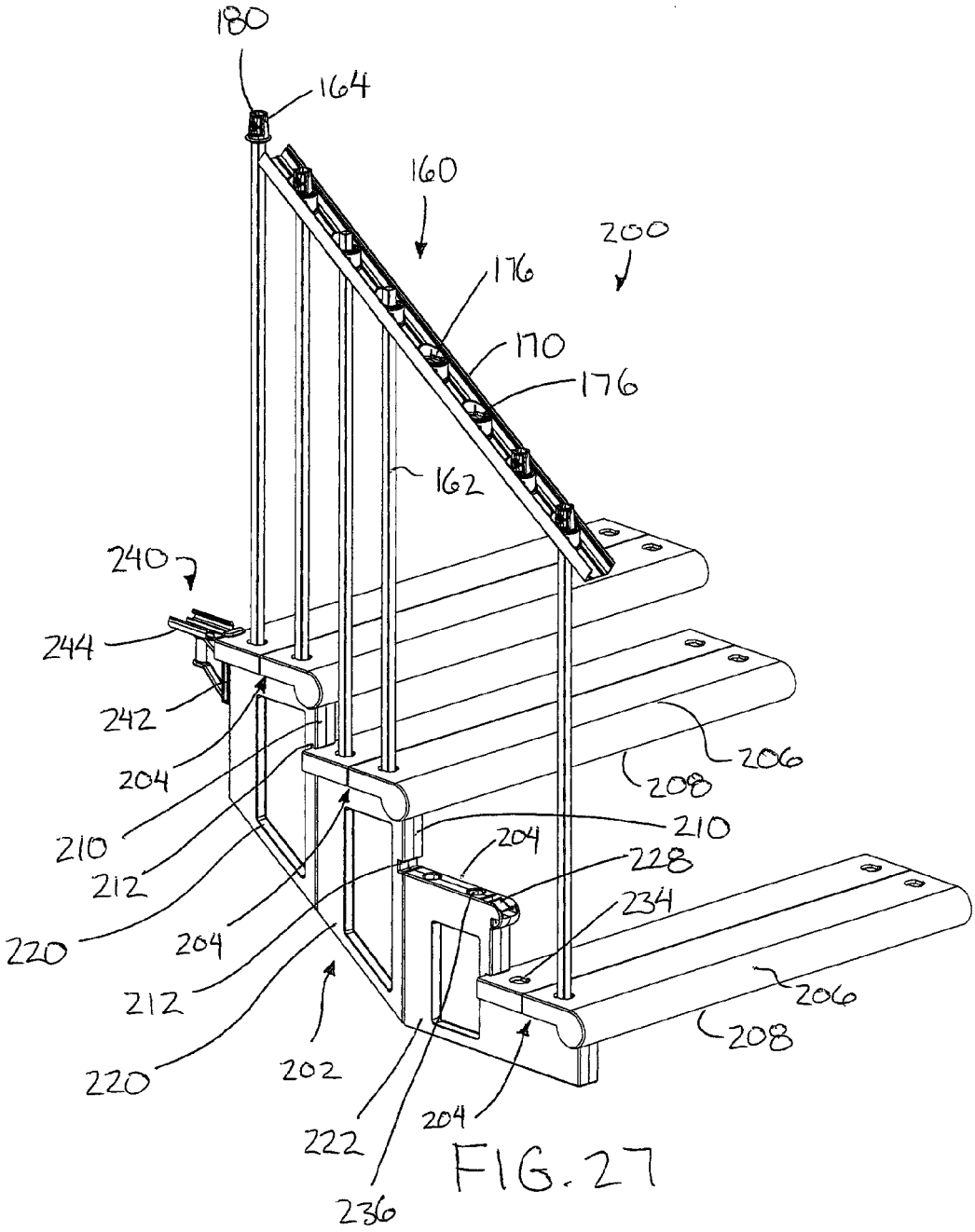
Figure 28:
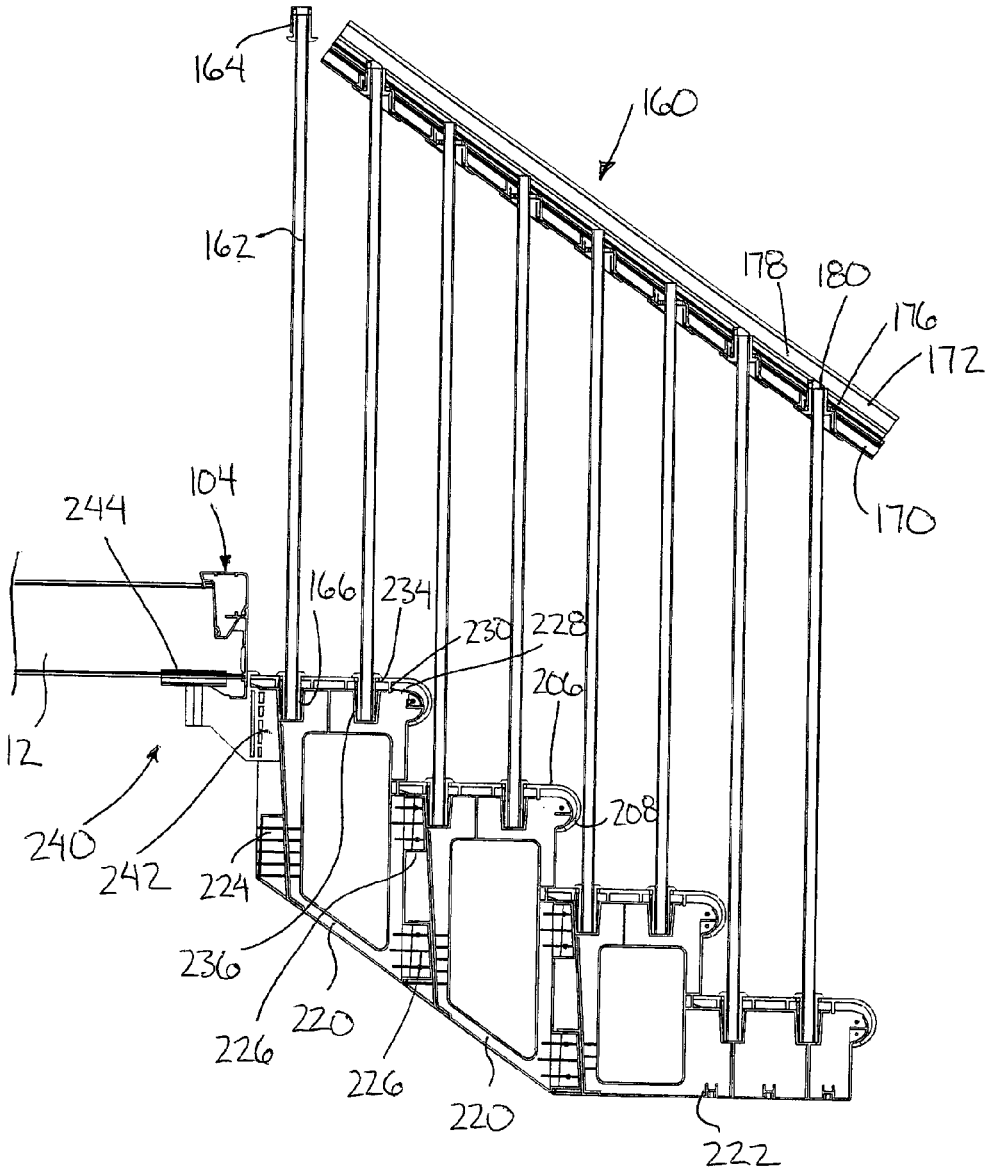
Figure 29:
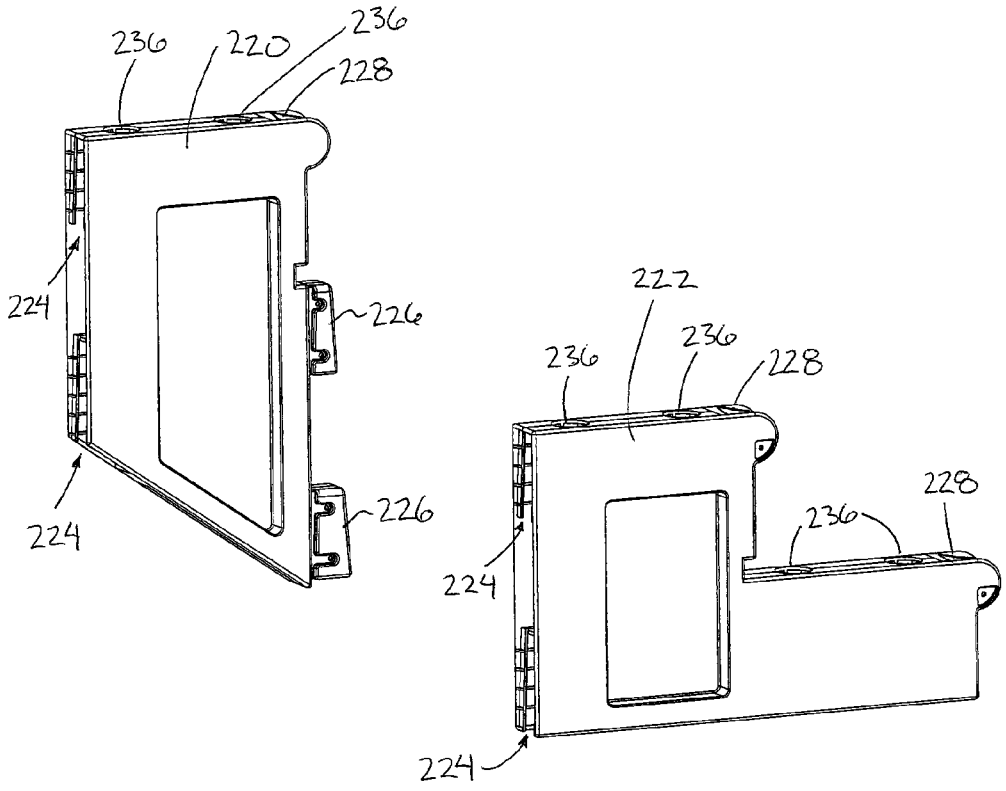
Figure 30:
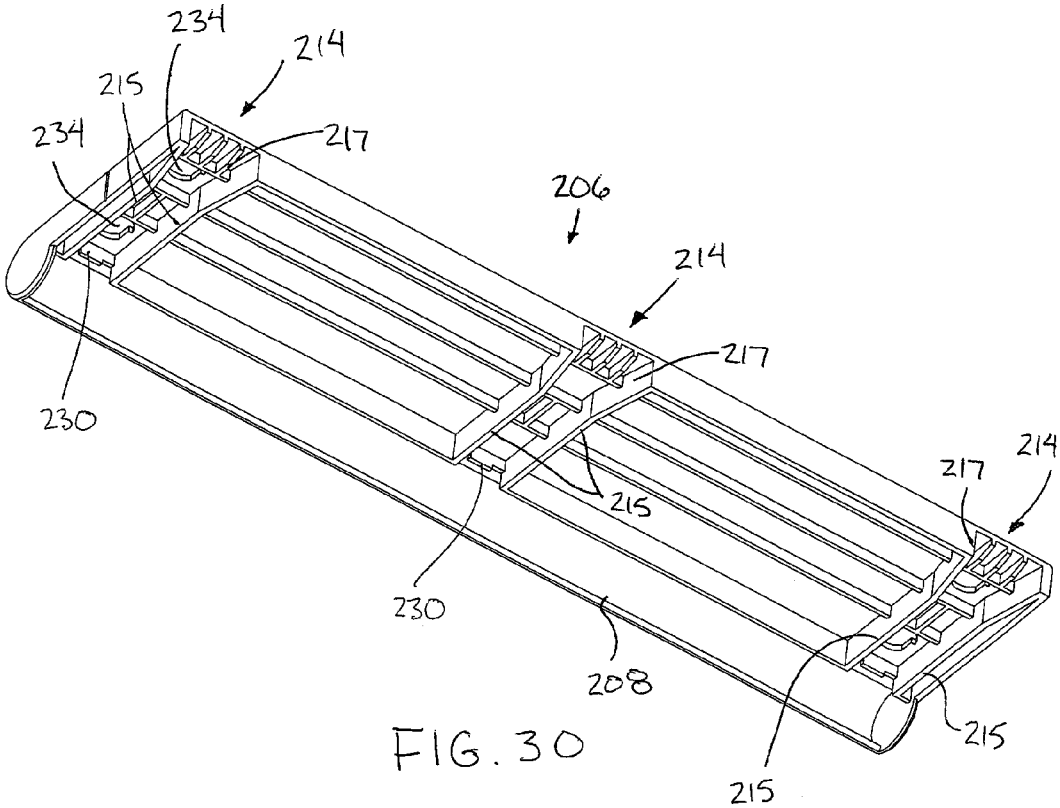
Figure 31:
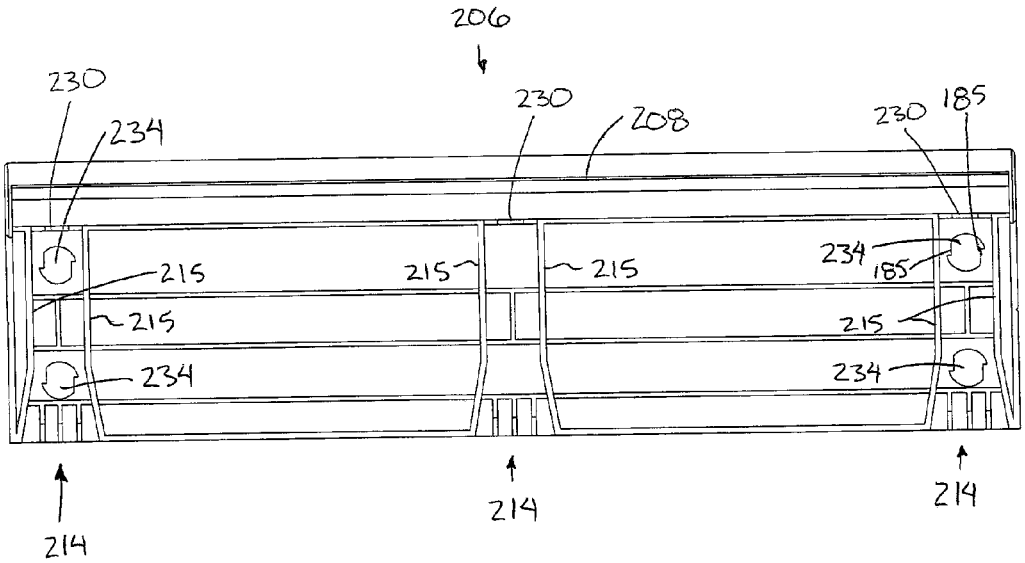
Figure 32:
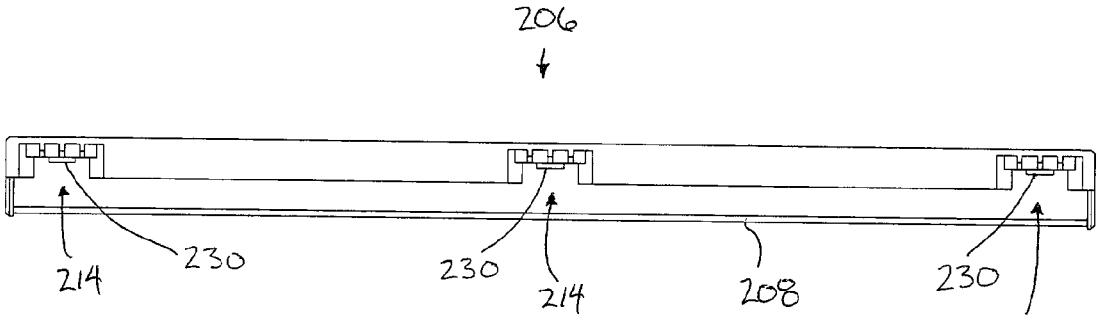
Figure 33:
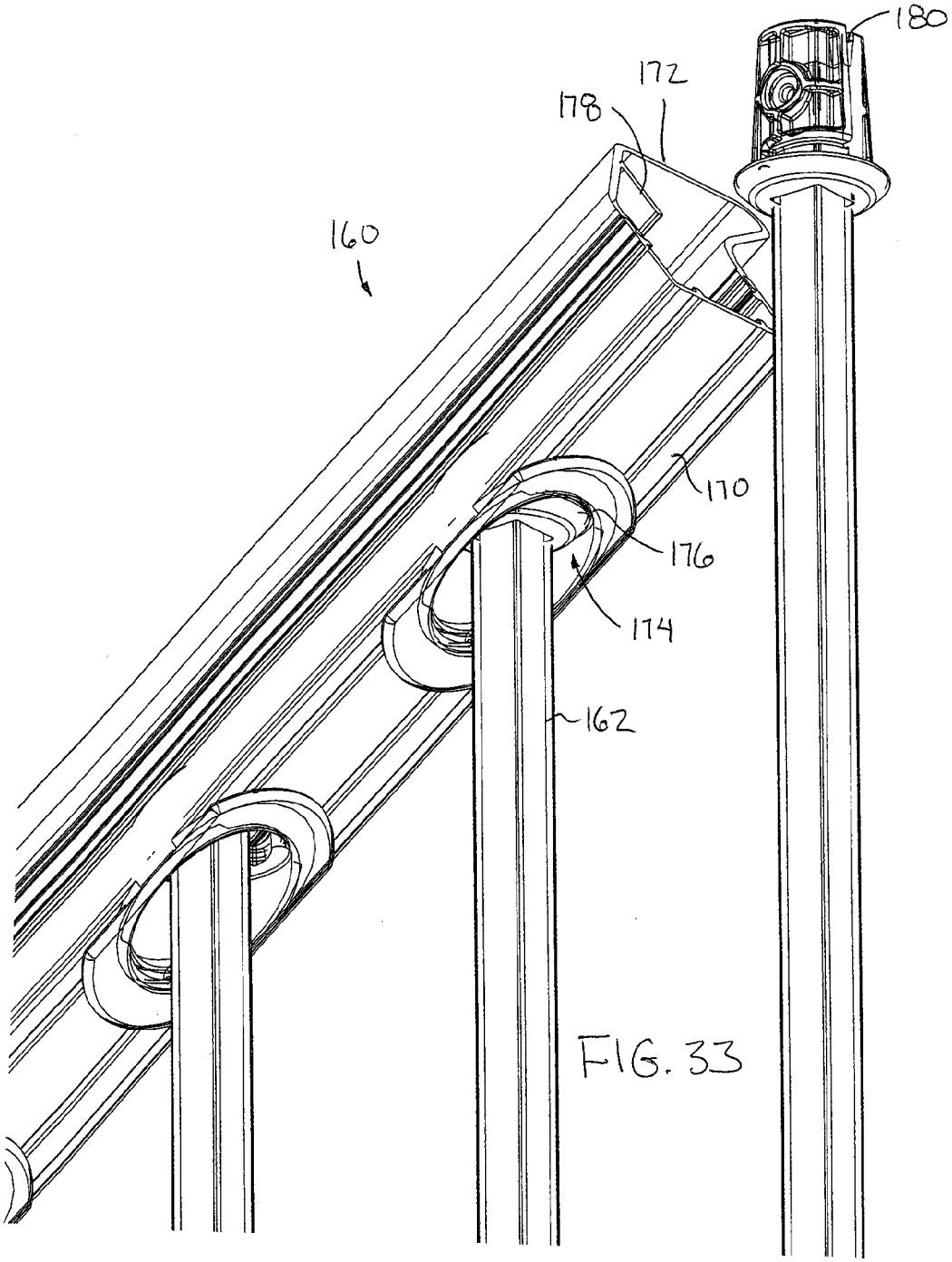
Figure 34:
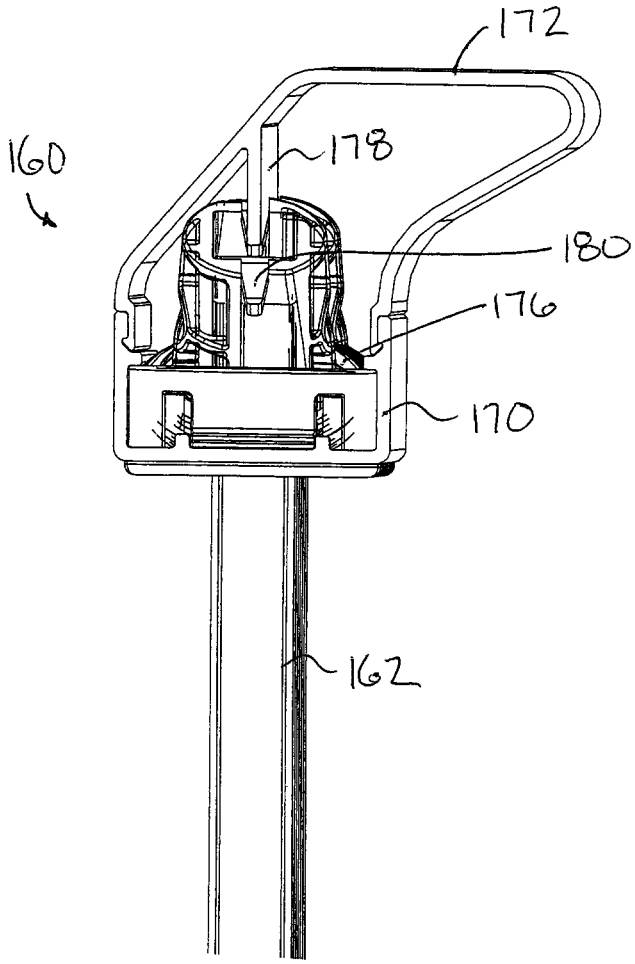
Figure 35:
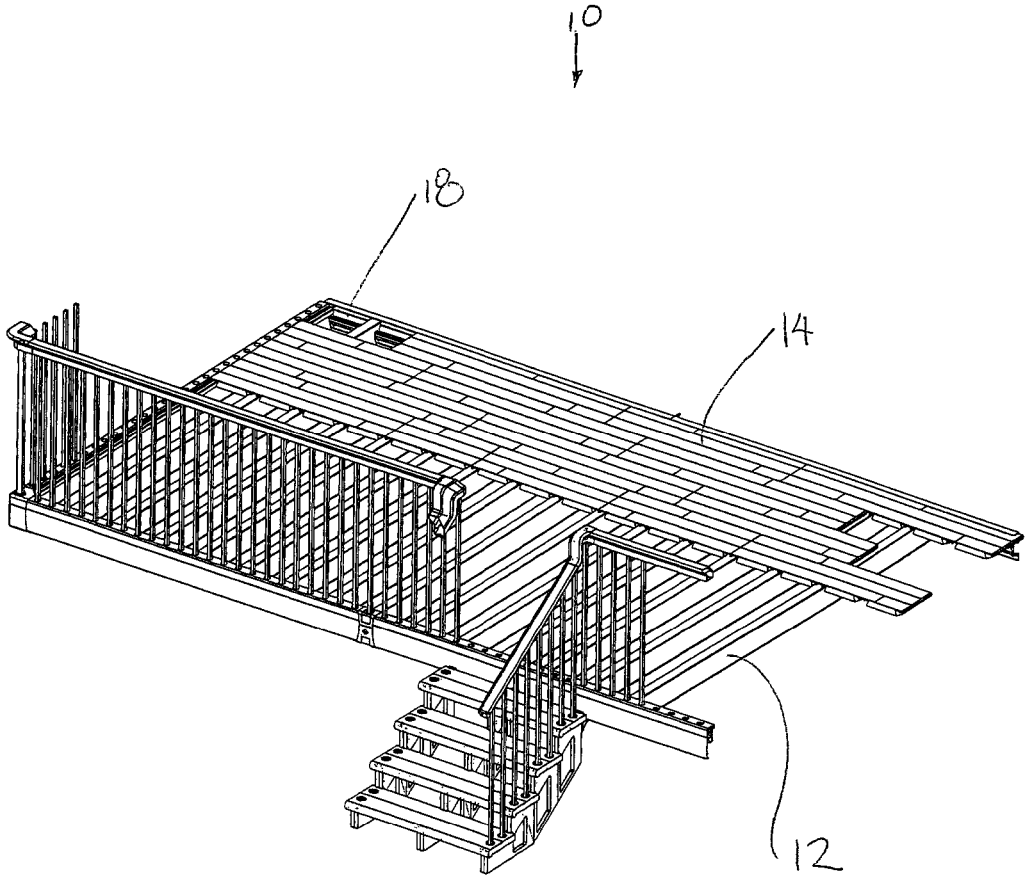
FIGS. 35 through 48 illustrate various components according to a second embodiment of the decking system.

Referring to the accompany figures, there is illustrated a decking system generally indicated by reference numeral 10. The decking system 10 includes joists 12, deckboards 14, beams 16, and a ledger board 18 arranged for assembly relative to one another wholly by interlocking engagement of the various components and substantially without any fasteners being required.

The joists 12 are arranged to be supported to lie parallel and spaced apart from one another by a suitable spacing corresponding to the spacing between adjacent floor joists in a floor system.

A plurality of the deck boards 14 are arranged to span transversely across the joists 12 perpendicularly thereto so that each deck board spans across several of the joists to be supported thereon. Joist connectors 22 are provided at spaced positions along a bottom side of each of the deck boards 14 and which are arranged for mating interlocking engagement with an upper portion of a respective one of the joists 12.

Each beam 16 spans in a respective longitudinal direction transversely across a plurality of the joists such that the joists are supported on the beam at spaced apart positions in the longitudinal direction of the beam. Joist connectors 24 are similarly spaced apart along each beam 16 for mating interlocking engagement with a lower portion of the respective joist therein.

The ledger board 18 also spans in a respective longitudinal direction transversely across a mounting end 20 of each of the joists 12 such that the joists are supported at spaced apart positions in a longitudinal direction of the ledger board. The ledger board 18 is suitable for mounting against a vertical supporting surface or wall against which the decking system is to be mounted. The ledger board 18 also includes a plurality of joists connectors 26 at spaced positions therealong for mating interlocking engagement with respective ones of the mounting ends of the joists.

All the joist connectors are spaced apart along the respective member at a plurality of intermediate positions evenly spaced between opposing ends of the members. The spacing between adjacent ones of the joist connectors in the longitudinal direction of the respective member forming the joist connectors therein corresponds to the space between floor joists for suitably spacing the joists for a decking system.

The joists and the beam are extruded from suitable materials so as to have a substantially constant cross section with a hollow core along the length thereof. Alternatively the deck boards 14 and the ledger board are typically injection molded to form a solid core member.

Turning now more particularly to the joists 12, each joist 12 comprises an extruded member having a continuous profile along its length. The cross section of each joist includes an upper flange 30 and a lower flange 32 which are substantially parallel and extend along opposing top and bottom sides of the joist. Each of the flanges includes a depending edge portion extending along the full length of the edge thereof where the flange is turned to project inwardly towards the opposing flange for strength and to form a catch arranged for interlocking engagement with various components of the decking system. A web comprised of two sides 34 spans between the upper and lower flanges spaced apart from one another. The two sides 34 of each joist join the upper and lower flanges adjacent the outer edges thereof and are arranged to taper inwardly towards one another towards a centre of the joist where spacing between the two sides 34 is narrowest. The overall lateral dimension of the web is narrower than the upper and lower flange portions of the joist so that the cross section of the joist is somewhat in the shape of an hourglass in cross section. In this manner the lateral dimension of the joist increases from the centre towards both of the top and bottom ends of the joist to form a shape which is suitable for mating with various components of the decking system.

In this manner an upper portion of the joist comprises an upper connector formed integrally with the profile of the joist to extend along a full length of the joist in which the upper connector is arranged for mating connection with the joist connectors 22 of the deck boards and the joist connectors 24 supported at spaced positions along each beam 16. By providing an upper portion of the joist which extends upwardly with increasing lateral dimension perpendicular to the long direction of the joist, the joist connectors on the deck boards can be suitably shaped for interlocking engagement for wholly supporting the boards on the joist by the mating cross section of the joist connectors of the deck boards with the upper connector of the joists.

Both a mounting end 20 of the joist, arranged for securement to the ledger board, and a free end 21 opposite the mounting end, are machined subsequent to the extrusion forming the cross section of the joist so that both ends are identical to one another but are reversed in orientation between the top and bottom sides of the joist so as to be also opposite one another. More particularly, each end of the joist includes an overhang portion 36 which extends in the longitudinal direction of the joist beyond a remainder of the cross section of the joist. The joist connectors on the ledger board are arranged to matingly receive the overhang portion of a respective joist therein. The overhang portion is arranged to be adjacent one of the top and bottom flanges so that the corresponding one of the flanges 30 and 32 extends in the longitudinal direction beyond the other flange along with a portion of the sides adjacent thereto. Each of the overhang portions is adjacent a respective one of the upper and lower flanges to be opposite one another so that the joist is reversible in orientation.

A central rib is formed to extend in the longitudinal direction of the joist spanning between the two sides parallel to the upper and lower flanges at a centre of the joist evenly spaced between the upper and lower flanges. Each overhang portion comprises a portion of the side walls which spans between the adjacent one of the upper and lower flanges and the central rib and which extends on the longitudinal direction beyond the remaining portion of the sides 34 of the joist.

Each overhang portion further comprises a hook portion 38 in which a recess is formed in the side walls 34 of the joist at a location within the overhang portion but spaced inwardly from the outer end of the joist to extend inwardly through the central rib partway towards the respective one of the flanges of the joist defining the overhang portion. At the mounting end, the hook portion effectively extends downward from the overhang portion at a position spaced outwardly from the remaining cross section of the joist so that mounting of the joist onto the joist connectors of the ledger board involves a vertically sliding movement of the hook portion downwardly into the joist connector on the ledger board. Thus the hook portion prevents sliding movement of the joist in the longitudinal direction of the joist away from the ledger board.

One of the upper and lower flanges of each joist includes a groove formed centrally therein which is continuous with the profile of the joist extending along a full length thereof. The groove is suitable for receiving a level bubble 40. The level bubble is of the type comprising a clear cylindrical container having fluid therein to define an air bubble moveable along the cylindrical casing as the inclination of the casing varies from horizontal. According the level bubble 40 when is received within the groove in a snug fit arrangement to retain the level bubble within the groove in the joist, the level bubble serves to indicate when the joist is in a horizontal orientation.

Turning now to the deck boards 14, each deck board comprises a molded member which is suitably shaped to define an upper deck surface 42 spanning a top side of the board between two opposed sides 44 extending in a longitudinal direction of the deck board and to longitudinally opposed ends 46. The joist connectors 22 are formed in the bottom side of the deck board at evenly spaced positions in the longitudinal direction thereof at a plurality of intermediate locations and at both ends of each deck board.

The two sides 44 are oriented parallel to one another at an inclination relative to the upper deck surface so as to be in a non-perpendicular configuration relative to the upper deck surface. In particular a first one of the sides 44 of each deck board extends upwardly and inwardly towards the other side from the bottom side of the deck board to the top side of the deck board. The second one of the sides 44 extends at an incline upwardly and outwardly away from the opposing side 44 from the bottom side towards the top side of the deck board so as to be parallel to the other side 44. In this manner when two deck boards are positioned adjacent one another of like configuration, the first one of the sides of one of the boards is arranged to partially overlap the second one of the sides of the adjacent deck board. In this manner even when a slight gap is maintained between the deck boards, there is no direct line of sight when the deck boards are viewed from above through the gap between the deck boards to the joists therebelow. The joists thus remain substantially hidden from view. This is particularly desirable when the joists are fabricated from aluminium or other metal which may be highly reflective.

The intermediate ones of the joists connectors 22 each comprise a channel spanning in a lateral direction perpendicular to the longitudinal direction of the joist between two mouths 48 located at the opposing sides 44 of the deck boards respectively. The two mouths together form a generally trapezoidal shaped channel extending laterally across the deck board including: a flat inner or bottom wall lying parallel to the upper deck surface and arranged for engagement upon the upper flange of the joists; and a pair of side walls which taper inwardly towards one another from the base portion of the channel to the open bottom side of the channel at the bottom side of the deck board. The narrowing cross sectional dimension as measured in the longitudinal direction of the deck board from the base portion to the open bottom of the channel is arranged for mating with the profile of the upper connector portion of the joist such that the narrowing shape of the connectors engages the joists in an interlocking manner which prevents lifting of the deck boards away from the joists.

At the two opposed sides 44 of each deck board, the mouths are formed so that the two side walls taper outwardly away from each other in the lateral direction towards the outer side of the deck board to be increasing in dimension for ease of insertion of the ends of the joists into the channels upon mounting the deck boards onto the joists. Similarly, a sloping surface is defined between the base portion of the mouth and the upper deck surface at the outer side of the deck board so that the mouth similarly increase in dimension towards the top side of the board for ease of insertion of the upper flange of the joist against the base portion of the channel. Similarly sloped surfaces may also be provided at the inner side of the mouths in the sides 44 of the deck boards for continuing guiding the joist fully through the deck board upon insertion of the deck boards onto the joists.

The joist connectors 22 at the ends 46 of each deck board comprises only a partial channel in the form of an end recess 50. Each end recess 50 comprises a recess which is open in each side wall both to the end of the deck board and to the bottom side of the deck board and which corresponds to only half of the width of the channel in the longitudinal direction at both the base portion and at the bottom side of the channels. In this manner the base portion of each end recess is arranged to overlap the upper flange of the corresponding joist only half way to the centre of the joist while the single side wall of the recess extending from the base portion to the open bottom side is sloped downwardly and outwardly for partially overlapping a corresponding edge of the upper flange of the joist received therein in a manner which resists lifting of the deck board relative to the joist at the ends of each deck board. Both end recess 50 are formed similarly to one another in cross section so that when two boards are abutted in an end to end configuration the two recess combined have a cross section which is substantially identical to each of the channels forming the intermediate ones of the joist connectors 22.

A plurality of stiffener ribs 51 are formed in the open bottom side of each deck board to extend from the upper deck surface downwardly towards the bottom side only part of the height of the deck board sides 44 so that a bottom side of all of the stiffener ribs 51 terminate in a common plane with the base portion of the mouths forming the channels of the joists connectors 22. The stiffener ribs are thus arranged for engagement upon the upper flange of the joists when the deck boards are supported on the joists. The stiffener ribs 51 are provided at a plurality of intermediate positions extending in the longitudinal direction between the opposed ends of the boards at spaced apart positions between the sides 44 and as well in alignment with the joist connectors 22 to extend in the lateral direction at longitudinally spaced positions.

Similarly to the sloping sides 44 of each deck board, the ends 46 are also configured to overlap one another when abutted in an end to end configuration. More particularly, at the upper deck surface 42, a first one of the ends of the deck board includes a protrusion 52 extending the full width the of deck board in the lateral direction and extending or projecting in the longitudinal direction beyond the remaining portion of the deck board. The protrusion 52 slopes upwardly and outwardly towards the upper deck surface. Alternatively the second one of the ends opposite the protrusion 52 includes a recess 54 at the upper deck surface 42 extending along the full width of the board in the lateral direction for matingly receiving the protrusions 52 therein. More particularly the end of the deck board is shaped to slope upwardly and inwardly towards the upper deck surface 42 at the second end for matingly receiving the similarly sloping protrusion 52 of an adjacent deck board abutted end to end therewith.

The deck boards are manufactured having a length corresponding to a standard centre to center measurement betweens joists in a conventional deck according to building codes, for example a 16 inch spacing. The width of the deck boards may vary.

Furthermore the upper deck surface is provided with indentations formed in the upper deck surface to represent the visual appearance of a plurality of deck boards adjacent one another and extending in the longitudinal direction. In the illustrated embodiment, each deck board is imprinted with the image of multiple different widths of boards and multiple different lengths of boards thereon to provide a random appearance to the deck surface. Indentations or other similar indicia representing fasteners are also provided on the upper deck surface to provide the appearance of wooden deck boards secured by fasteners as in a conventional deck configuration.

Turning now to the ledger board 18, according to the illustrated embodiment the ledger board is injection molded to be elongate in a longitudinal direction in which the joist connectors 26 are formed thereon at spaced positions in the longitudinal direction. The ledger board is formed to comprise a first upright side forming the joist connectors at spaced positions from one another therealong and a second upright side opposite the first upright side to similarly extend in the longitudinal direction of the ledger board between opposing ends of the board. The ledger board is formed to comprise a back wall 60 having a plurality of stiffener ribs spanning across the rear side thereof such that the second upright side of the ledger board is flat for mounting against a flat upright supporting surface such as a wall. The ledger board further comprises an upper flange 62 and a lower flange 64 extending in the longitudinal direction adjacent top and bottom sides of the ledger board respectively to project forwardly from the back wall 60 towards the first upright side or front side of the ledger board, parallel and spaced apart from one another.

Each of the joist connectors comprises a pair of upright side walls 66 extending forwardly from the back wall towards the front side of the ledger board. A front wall 68 spans between the two side walls and includes an opening in an upper portion thereof defining a suitable socket in the front wall and in the space between the front wall and the back wall 60 for receiving the overhang portion and hook portion of a respective one of the joists therein. At the bottom of the opening in the front wall 68 there is provided a ledge portion 70 comprising a generally horizontal supporting surface extending rearwardly from the front wall only partway towards the rear wall or back wall 60 so that a space remains between the ledge portion 70 and the back wall 60 of the ledger board. In additional the ledge portion 70 at the bottom of the opening in the front wall 68 defining each joist connector, two sides 72 span the sides of the opening between the front wall 68 of the joist connector and the back wall 60 of the ledger board in which the two sides 72 are sloped upwardly and away from each other from the ledge portion 70 upwardly towards the upper flange 62 to match the increasing lateral dimension of the joists towards the upper flange thereof. The opening forming each joist connector 26 extends through the upper flange 62 as well as to provide access for inserting the joist from above for vertically sliding the mounting ends of the joists downwardly into the respective joist connectors. Rearwardly and spaced below the ledge portion 70 there is provided a secondary ledge portion in the form of a similar horizontal surface which receives the free end of the hook portion of the joist engaged thereon in a mounted position.

At a location spaced below each ledge portion 70 at the first side of the ledger board, there is also provided a bottom portion 74 in the form of a bottom wall protruding forwardly from the front wall 68 of the joist connector to the front side of the joist to define a further ledge spaced below the ledge portion 70 upon which the bottom flange or bottom side of the joist is engaged when the overhang portion is engaged on the ledge portion 70 and the hook portion is engaged upon the secondary ledge portion below and rearward of the ledge portion 70. The bottom portion 74 is integrally molded and formed with the joist connector 26 and the remainder of the ledger board. In addition to the bottom wall, vertically extending gussets are provided both above and below the bottom portion 74 which join to the front wall 68 of the joist connectors for added structural support.

Each joist connector 26 of the ledger board further comprises a resiliently sprung retainer member 78 at a location below the ledge portion 70 and in alignment directly above the bottom portion 74 by a spacing corresponding to the thickness of the lower flange of the joist for selectively retaining the lower flange of the joist between the sprung retainer member 78 and the bottom wall of the bottom portion 74. The spring retainer member 78 is joined to the front wall 68 of the joist connector to extend downwardly therefrom to a free end which is biased forwardly into an overlapping configuration with the inner surface of the lower flange of the joist. A sloped outer surface of the sprung retainer member causes the member 78 to be automatically deflected rearward to allow the lower flange of the joist to pass by the member 78 to reach the bottom wall upon insertion of the mounting end of the joist into the joist connector. Upon passage of the lower flange beyond the free end of the retainer member downwardly onto the bottom portion 74 of the joist connector 26 however the resilient nature of the member 78 causes it to deflect forwardly and engage the inner surface of the lower flange to retain further upward movement and removal of the joist from the joist connectors.

Each joist connector 26 is open at the bottom side between the front wall 68 and the back wall 60 of the ledger board to provide access to the rear of the sprung retainer member to selectively release the retainer member from the mounting end of the joist when desired. A hook formation is provided to depend from the rear side of the retainer member 78 opposite the front side engaging the joist in which the hook is opened to the bottom side for access by a screwdriver or other similar tool to grip the retainer member 78 and urge the retainer member rearwardly into disengagement from the joist if it is desired to release the joist from the joist connector 26.

The ledger board includes a drip flange 80 which spans along the top of the ledger board horizontally at a location spaced above the upper flange 62 to define a slot 82 extending along the ledger board. The slot 82 is formed between the parallel top flange and drip flange and is open on the front to face forwardly to the first upright side. The slot 82 is suitably dimensioned to receive a portion of the deck boards therein which form the first row of deck boards mounted onto the joists. When the joists are inserted into the joist connectors on the ledger board, the drip flange 80 is spaced above the upper flange of the joists by a spacing which corresponds to a height of the deck boards between the base portion of the channels and the upper deck surface so that the drip flange 80 is closely fit above the upper deck surface of the deck boards in the assembled configuration of the deck.

The ledger board comprises a plurality of modular sections 84 which are arranged to extend in the longitudinal direction of the ledger board and be coupled in interlocking engagement with one another in an end to end configuration. The modular sections 84 comprise a plurality of intermediate sections and a pair of end sections. Each of the sections 84 are arrange to be coupled to adjacent sections by interlocking engagement for relative sliding movement between adjacent sections in an interlocking direction which is perpendicular to the longitudinal direction of the ledger board and perpendicular to the first and second upright sides. More particularly each of the modular sections includes a protrusion 86 in the form of a first mounting flange spaced outwardly beyond the end of the section 84, parallel and spaced from an end flange 88 defining that end of the section 84.

At the opposing end of each intermediate section, a suitable socket 90 is provided for receiving the protruding flange 86 of an adjacent modular section. The socket comprises spaced apart first and second mounting flanges 87 for engagement with the end flange 88 and protruding flange 86 of an adjacent modular section respectively. Guide members 93 are supported in the socket to receive the protruding flange 86 in the socket snugly between the guide members 93 and the second mounting flange 87 of the socket.

The first mounting flange includes a hook portion 89 thereon for engagement in a snap fit configuration into a corresponding aperture 91 in the end flange 88 while the second mounting flange includes an aperture 91 therein which receives a similar hook portion 89 on the protruding flange 86 so that when two adjacent modular sections are slid into a coplanar configuration, the hook portions are received within the respective apertures by mating connection between the protrusion on one section and the socket on the other section to retain the modular sections in an assembled and locked configuration. Effectively each end of each modular section 84 includes a sprung retainer member formed thereon for selective inter-engagement with a corresponding aperture on the opposing one of the modular sections. Access is provided to both apertures to release the hook members therefrom to release the two sprung retainer members. This may be desired to permit the modular sections to be slid relative to one another in the interlocking direction from the locked position to a released position separated from one another.

The two end modular sections 84 include only a single protrusion 86 or a single socket 90 for engagement to respective ones of the intermediate modular sections, however the opposing outer ends of the modular sections when all assembled into a single ledger board are configured to be free of any sliding interlock connectors. Alternatively there is provided a side flange 92 which forms an upright end flange at the end of the ledger board projecting outwardly from the back wall 60 at the second upright side beyond the first upright side so as to be arranged to overlap an outermost joist 94 connected to the joist connector 26 adjacent the end of the ledger board. The outermost joist 94 includes a flat outer side which is vertical in orientation in the mounted configuration and which is arranged to be closely overlapped by the side flange 92 which extends forwardly over the outer side of the outermost joist.

The outermost joist 94 comprises an extruded member having a continuous profile along the length thereof. The joist includes a lower portion 96 which is suitably arranged for mating connection with the joist connector at the end of the ledger board and is arranged to include a similar shaped lower flange 98 similar to the intermediate joists for engagement upon a similar bottom portion of the joist connector protruding forwardly from the ledger board and supporting the lower flange 98 of the joist directly thereon. A similar sprung retainer member is also provided to selectively retain the outermost joist engaged upon the joist connector. A similar overhang and hook portion is also provided to engage over a ledge portion of the joist connector spaced above the bottom portion. The outer side of the lower portion 96 of the outermost joist is flat and is arranged to depend downwardly to the bottom of the ledger board such that the assembled outermost joist spans the full height of the ledger board which is greater than a height of the joists and deck boards combined.

The upper portion 100 of the outermost joist also includes an upper flange 101 which spans along the length of the joist, spaced above the lower flange 98 by a similar distance as the height of the intermediate joists 12 between the upper and lower flanges thereof. The upper flange 101 on the upper portion of the joist is thus suitably located to support the ends of the deck boards 14 thereon.

The outermost joist is supported to span parallel to the intermediate joist with only the lower portion 96 being engaged in an interlocking manner with a corresponding one of the joist connectors on the ledger board. The outermost joist also includes an upper portion 100 which mounts onto the lower portion 96 using interlocking profiles which can be snap fit together so that the upper portion is arranged to be readily releasable from its mounted position along the top side of the lower portion. This permits the upper portion to be interchanged with other upper portions of varying configuration.

Each of the upper and lower portions comprises a hollow profile in which inter-engaging hooks are provided on both portions for mating connection in the mounted position. The upper portion includes a top wall 102 which is arranged to be substantially flush with the upper deck surface of the deck members to form a continuous deck surface therewith which is similarly overlapped by the drip flange of the ledger board. In some applications, the upper portion 100 of the outermost joist includes a plurality of picket mounting apertures at spaced positions therealong when a railing system is to be used with the assembled deck system.

A facer board 104 is provided for spanning the free ends of the joist opposite the ledger board. The facer board 104 comprises an extruded member of continuous profile along the length thereof. More particularly the facer board comprises a lower portion 106 arranged for interlocking engagement with the ends of the joists and an upper portion 108 arranged to be releasably mounted along the top side of the lower portion.

The lower portion is suitably formed to follow the shape of the recess in the overhang portion defining the hook portion to extend about the hook portion and form an outer side which is flat and arranged to be supported in a vertical orientation when mounted on the joists. A retainer flange extends along an inner side of the lower portion 106 for overlapping a bottom edge of the overhang portion of the free end of the joist. The flat outer side of the lower portion extends downwardly beyond the retainer flange to a bottom edge which is joined to a bottom flange projecting inwardly to provide strength and a finished bottom edge to the facer board.

The upper portion 108 is generally U-shaped in profile having two depending flanges which are suitably formed for interlocking snap fit engagement with corresponding flanges on the top of the lower portion to support a base portion of the upper portion of the facer board at the top side thereof to form a top panel which is spaced above the joist to be substantially flush with the upper deck surface of the deck boards and form a portion of the deck surface of the assembled deck. The upper flange of the joist opposite the overhang portion of the lower flange at the free end includes a transverse slot formed therein which extends laterally across the upper flange spaced inwardly from the end thereof to receive a depending flange 112 of the upper portion of the facer board therein. The mating connection of the depending flange inserted in the slot in the upper flange of the joist resists deflection of the top side of the facer board away from the joists in the longitudinal direction thereof.

Similar to the outermost joist, a plurality of different upper portions of the facer board may be provided which are similar in configuration with one another for being releasably mounted onto the lower portion, however one of the upper portions includes a smooth and continuous top panel 110 for use where no railing is required, whereas the other upper portion interchangeable with the first includes a plurality of picket mounting apertures 114 at spaced positions thereal-ong.

The beam 16 also comprises an extruded member having a continuous profile along the length thereof. More particularly the beam is generally rectangular in cross-section having flat top and bottom sides and parallel side walls extending vertically therebetween. An upper groove 120 is provided in each of the two opposed side walls adjacent the top end thereof but spaced slightly downwardly from the top side of the beam. Similarly a pair of lower grooves 122 are formed in the side walls respectively adjacent the bottom end of the beam but spaced slightly upwardly from the bottom sides. The grooves extend in the longitudinal direction of the beam so as to be formed by extrusion parallel to one another. The beam is substantially symmetrical so as to be reversible if desired.

The joists are supported on the beam by the joist connectors 24 which comprise separate structural components which are snap fit onto the beam. Each joist connector comprises two lower flanges 124 which are parallel and spaced apart from one another and which depend from a central plate 126 in a generally U-shaped configuration therewith for extending overtop of the top side of the beam with the two lower flanges 124 clamping the beam therebetween. Each of the lower flanges includes a catch member 128 adjacent the free end thereof for being selectively received within the two upper grooves 120 formed in the beam. The flanges are sufficiently resilient that the joist connectors 124 can be inserted by pushing downwardly over the top side of the beam with the catch members 128 being sloped to resiliently flex the lower flanges outwardly sufficient to align the catch members 128 with the grooves at which point the resilient nature of the flanges causes the catch members to enter into the grooves and thereby prevent upward movement of the joist connector away from the beam. Once mounted on the beam however the joist connectors can be slidably displaced in the longitudinal direction of the beam along the grooves. Suitable indicators are formed on the beam to indicate the appropriate placement or spacing of the joist connectors relative to one another.

Each joist connector also includes two upper flanges 130 extending upward from opposing sides of the central plate 126 at intermediate locations between the two lower flanges so as to receive a corresponding joist therebetween when the joist is oriented perpendicularly to the beam. The two upper flanges 130 are also in a generally U-shaped configuration with the central plate 126 and similarly include catch members 132 formed on the inner surfaces thereof for engagement over the formed edges of the lower flange of the joist received therein. The catch members are spaced from the central plate 126 by the thickness of the lower flange to snugly engage over the edges of the lower flange and retain the lower flange of the joist in snug engagement on the top of the central plate of the joist connector in use. The resilient nature of the upper flanges 130 and the sloped shape of the catch members 132 permits the upper flanges to be automatically deflected outwardly upon insertion of the joist downwardly into the joist connector until the lower flange of the joist is passed the catch members, at which point the catch members are permitted to return inwardly towards one another and thereby retain the joist in a snap fit configuration clamped therebetween. Once mounted on the joists, due to the continuous profile of the joist, the joist remains slidably in the longitudinal direction within the joist connector 24.

One of the lower flanges 124 includes an integrally molded receptacle 134 formed thereon when the joist connector is integrally molded in which the receptacle 134 is suitably shaped for inserting the cylindrical level bubble therein of similar configuration to the level bubble arranged to be snap fit into the groove in the joist. The level bubble serves to indicate horizontal orientation of the beam when the level bubble is snugly received in the receptacle 134 and the joist connector 24 is snap fit onto the top side of the beam.

The beam is arranged to be supported on a plurality of posts 136 at longitudinally spaced positions therealong respectively by a plurality of post connectors 138. Each post connector includes a bracket portion 140 forming a base and two upstanding flanges 42 which are spaced apart and form a generally U-shaped configuration with the base. The two flanges 142 are configured to the two lower flanges of the joist connectors 24 for insertion over the bottom end of the beam with catch members being provided for being received in the lower grooves of the beam upon snap fit of the bracket portion 140 over the bottom side of the beam similar to the joist connectors 24 over the top side of the beam. The interlocking connection of the bracket portion and the beam resiliently clamped therein permits longitudinal sliding movement of the bracket portion along the beam due to the continuous profile of the beam.

A ball and socket joint 144 is coupled beneath the base of the bracket portion for connection to a suitable stem 146 which is joined to a post mount 148 at the bottom end thereof. The post mount comprises a base plate and two depending flanges 150 with suitable apertures therein to permit the post mount to be inserted overtop of the top end of a generally square cross-section lumber post 136 for fastening to the post by suitable fasteners inserted through the apertures in the flanges 150. The ball and socket joist 144 permits some relative pivotal movement between the post 136 and the bracket portion 140 of the post connector. The stem 146 includes a threaded core threadably received within a cylindrical casing to permit the length of the stem to be adjusted by relative rotation between the two components of the stem.

The bottom of the bracket portion 140 includes a suitable channel 152 therein which slidably receives the ball of the ball and socket joint in a horizontal direction across the bracket portion. A central aperture in the base of the bracket portion locates a central socket member 154 centrally therein having a concave recess for engagement with an upper portion of the ball slidably received through the channel 152 to retain position of the ball along the channel when the ball is centered in the channel while not inhibiting relative pivotal movement therebetween. The ball is fixed to the stem 146 such that the stem is moveable with the ball for pivotal movement about plural axes relative to the bracket portion for adjustment between the post 136 and the beam.

A railing system is provided comprising a rail member 160 in the form of a hand rail arranged to be supported above the deck surface by a plurality of picket members 162 extending between the rail member 160 and the deck surface. Each of the pickets comprises an elongate post including a barrel member riveted onto the top end 164 and the bottom end 166 thereof.

A plurality of lower sockets 168 are provided in the deck surface in the form of picket mounting apertures along the outer periphery of the deck including the picket mounting apertures in the upper portion of the outermost joist and the upper portion of the facer board 104. The bottom ends 166 of the picket members and the lower sockets are suitably shaped so that the bottom ends can be inserted into the lower sockets by sliding movement in a vertical direction in a released orientation of the picket. However once inserted, a rotation of the picket member through 90° from the released position to a locked position causes inter-engagement between the bottoms of the pickets and the lower sockets in which the picket members are retained in the lower socket by interlocking engagement to prevent sliding movement in the longitudinal direction of the picket member and thereby retain the picket within the socket. The lower portion of the facer board and the lower portion of the outermost joist each include an internal support flange 169 arranged to engage the bottom end of the picket when the picket is received in the socket. At least one upward protrusion is provided on the internal support flange 169 to centrally locate the bottom end of the picket member relative to the support flange 169. Each picket is thus arranged to be supported at vertically spaced positions at the bottom end thereof for added structural stability.

The rail member 160 includes are lower portion 170 and an upper portion 172 which are arranged to be snap fit together to form a hollow extruded enclosure forming the hand rail of the deck. The lower portion includes a plurality of longitudinally spaced picket mounting apertures 174 therein which define upper sockets 176 for mating interlocking engagement with the top ends 164 of the pickets respectively. The top ends of the pickets and the upper sockets receiving them therein are suitably shaped relative to one another there such that in the released orientation, the picket member can be slidably inserted into and out of the socket in the longitudinal direction of the picket member. Once inserted, a quarter turn rotation of the picket member causes the picket member to be displaced from the released orientation to a locked orientation in which the picket member is retained in the upper socket by interlocking engagement to prevent further release in the longitudinal direction of the picket from the socket.

Upon insertion of the pickets into both the upper and lower socket, the upper portion 172 of the rail member can be mounted onto the lower portion thereof for concealing the top ends of the pickets when the rail member is assembled. The upper portion 172 of the rail member includes a common locking flange 178 extending in the longitudinal direction thereof to depend downwardly towards the lower portion of the rail within the hollow interior thereof. The locking flange is arranged for alignment with locking slots 180 formed in the top ends 164 of all of the picket members. The locking slots 180 each comprise a diametrically extending slot in the top end thereof which is oriented in a common longitudinal direction with all of the other locking slots 180 when in the locked position. In this manner the common lock flange 170 is arranged for interlocking engagement within all of the locking slots 180 commonly together upon mounting the upper portion 172 onto the lower portion of the railing. The locking flange inserted into the slots effectively prevents rotation of the picket members from the locked position back into the released position once the upper portion of the railing is attached to the lower portion.

The top and bottom ends of the pickets are formed to include a pair of circumferentially extending slots 181, each extending between an open end 183 arranged to receive a mating protrusion 185 on the periphery of the respective socket, and a terminal end 187 arranged to abut the protrusion to prevent further rotation of the picket in the locked position. The protrusions 185, the open ends 183 and the terminal ends 187 are all provided in diametrically opposed pairs for added strength.

For added strength the bottom ends of each picket member are arranged to extend through the top of the upper portions of the respective outermost joist and facer board to reach the lower portion thereof in engagement so that the bottom ends are supported at longitudinally spaced positions for increased strength. Supporting the bottom ends at vertically spaced positions within the respective lower sockets provides stability to the railing.

At the end of each rail section a suitable adapter bracket 182 is provided for joining the rail section to adjacent rail sections in an abutted end to end relationship, for mounting the end of a rail to an upright supporting surface such as a wall, or for mounting the rail member to a corner post for example. The adapter bracket 182 is arranged to be received within the end of the rail member in each instance. The adapter bracket comprises a horizontal base flange 184 including an aperture therein for receiving the top end of the last picket member therethrough which is nearest to the end of the rail. An inner flange 186 extends upward from an inner end of the base flange spaced inwardly from the end of the rail member to receive the last picket member between the inner flange and the end of the rail. Opposite the inner flange there is provided a vertical end flange 188 extending upward from the base flange 184 and including mounting apertures therein for receiving suitable fasteners for securement to an upright wall for example.

In a wall mounting application, a suitable wall bracket 190 surrounds the adapter bracket 182 and has a profile which matches the profile of the railing for receiving the railing therein to overlap the railing about the full periphery thereof. The wall bracket is mounted to the wall using the adapter bracket 182 by a set of mounting flanges 191 on the end flange 188 which overlap an end of the wall bracket to clamp the end of the wall bracket between the mounting flanges of the end flange and the wall. The railing can then be inserted into the wall bracket 190 to provide a finished appearance.

At a corner of the railing, a corner post 192 is provided which is larger in cross section than the pickets to provide greater stability. The corner where the outermost joist and the facer board meet includes a suitable corner bracket 194 for mounting the base of the corner post 192 therein. At the top end of the corner post, a railing corner bracket 196 is provided for connecting the ends of two rail members at right angles to one another. The corner bracket includes suitable slots therein for vertically slidably receiving the mounting flanges 191 on the inner flange of both adapter brackets 182 coupled to the two rail members respectively. Accordingly the rail corner bracket 196 is attached to the corner post which in turn connects to two internal adapter brackets 182 by interlocking engagement therewith. The adapter brackets 182 in turn locate mounting apertures in the base flanges thereof for receiving the last pickets adjacent the end of each rail member to in turn connect the rail members to the rail corner bracket 196. The rail corner bracket includes a lower portion mounting the adapter bracket 182 therein and forming a generally U-shaped trough to receive the lower portion of the rail members therein. After attachment of the upper portions of the rail members the corner bracket 196, an upper portion of the corner bracket which clamps down over top of the lower portion to define a hollow connector having a mating profile to the rail members to receive the rail members within each of the two opposed ends thereof and to fully surround the ends of the two rail members being joined.

At intermediate locations along the rail members, suitable couplers 198 are provided to connect two rail members in end to end abutment by similarly interlocking engagement with the end flanges of two adapter brackets 182 received internally within the rail members.

The decking system further comprises a stair system generally indicated by reference numeral 200. The stair system comprises a pair of stringers 202 which are arranged to be coupled to extend at a downward incline from joists of the decking system upon which they are supported at the top end to a bottom end at the ground or on another lower supporting surface. Each stringer 202 comprises a horizontal support ledge 204 corresponding to each step of the stair system. A tread member 206 is provided on each step extending horizontally between the stringers to be engaged on a corresponding pair of horizontal support ledges 204. The horizontal supporting ledges 204 of the stringers are joined by riser edges 210 extending therebetween. Each riser edge 210 includes a suitable slot 212 therein in alignment directly above the horizontal supporting ledge 204 to receive a rear edge of the tread member therein when the tread member is supported on the respective horizontal supporting ledge.

Each tread member comprises an injection molded member having a flat top surface forming the stepping surface. The top surface is integrally formed along a front edge with a hook portion 208 depending downwardly and curving inwardly to a bottom spaced below and rearwardly of the top front edge of the tread member.

At the bottom side, each tread member 206 includes a set of channels 214 each being defined by a pair of depending side members 215 extending between the front and rear edges of the tread member. The channels are spaced apart from one another for alignment with respective ones of the stringers to receive a portion of the stringer therein for sliding movement in a horizontal direction along the top of the respective horizontal support ledge of the stringer.

Each channel includes a mouth 217 at a rear edge of the tread member which becomes wider in lateral dimension between the opposing sides and which increases in height by slope surfaces extending from the mouth to the rear edge upwardly and rearwardly so that gradually sloped surfaces about the mouth ease insertion of the horizontal support ledge of the stringer therein upon horizontally sliding the tread members onto the stringers. The tread members are thus arranged for interlocking engagement with the stringers for relative horizontally sliding movement to support the tread members by the interlocking engagement of mating components therebetween.

Each of the stringers 202 is formed of a plurality of modular stringer sections 220 and a starter stringer section 222. Each intermediate section corresponds to a single step and forms a vertical section in alignment with a respective one of the horizontal support ledges 204 supporting one of the tread members on a top side thereof.

Each stringer section is arranged for sliding interlocking engagement in a vertical sliding movement with adjacent modular sections between a released position separated from one another and an engaged position in which the sections are interlocked with one another. The rear edge of each stringer section 220 extending vertically along the rear side thereof includes a suitable keyway 224 defining a vertical U-shaped channel or slot which is adapted to mate with the front edge of an adjacent stringer section. The front edge of each stringer section includes vertically spaced apart keys 226. The keys 226 include a mating cross section with the keyway 224 to permit relative vertical sliding movement from a released position to an engaged position.

The keyway 224 in the rear of each stringer section can be slidably displaced downwardly overtop of the keys of an adjacent section from the released position to the engaged position, however in the engaged position suitable stop members prevent further downward sliding movement of the stringer section keys relative to the keyway of an adjacent stringer section positioned rearwardly or upwardly thereof. In the engaged position the horizontal support ledge 204 defined by the top end of the modular section as in alignment with the corresponding slot 212 formed in the front side of the adjacent section to which it is coupled. Upon mounting of the tread member on the stringer section, the rear edge of the tread member is received in the slot 212 of the adjacent stringer section to limit relative vertical sliding movement therebetween and maintain the two adjacent stringer sections in the engaged position.

The tread member can be retained in its mounted position on a respective one of the modular sections by various means. A resiliently sprung retainer member 228 is mounted at the top of each modular section adjacent the front edge of the horizontal support ledge 204 thereof for suitable interaction with a depending flange within the corresponding channel in the tread member. Upon fully inserting the tread member into the slot of the adjacent modular section of the stringers, a depending flange 230 on the tread member adjacent the front edge thereof is slidably displaced over the sprung retainer member to displace the retainer member and cause the retainer member to be engaged over the flange and prevent return sliding of the tread member away from the stringer section.

Furthermore, in the engaged position of the tread member, the hook portion 208 mates with a protrusion at the front top edge of each stringer section corresponding to each horizontal supporting ledge 204 such that the protrusion 232 prevents upward displacement of the hook portion 208. In this manner each tread member is retained from upward movement at the rear edge by being received in the slots 212 in the adjacent stringer sections, while also being retained from upward deflection at the front edge of each tread member by the hook portion 208 engaged over the corresponding protrusions 232 at the front edge of each horizontal supporting ledge upon which the tread members are supported. Side to side displacement of the tread member is restricted by the channels defined in the bottom side of the tread member slidably receiving the top ends of the stringer sections therein. The sprung retainer member 228 then acts to prevent sliding movement of the tread members away from the engaged position on the stringer sections.

To further retain the tread members, picket mounting apertures 234 extend through the tread members at two spaced positions in alignment with each horizontal supporting ledge 204 which locates a pair of lower sockets 236 therein. The lower sockets 236 function identically to the lower sockets noted above for selectively retaining the bottom ends of the pickets by rotation of the pickets from a released position to a locked position. Upon insertion of the pickets through the stairs and into connection with the lower sockets in the stringer sections, further horizontal sliding of the tread members is prevented. Furthermore, a radially projecting flange about each picket, adjacent the bottom end thereof is arranged to overlap and engage a top side of the tread member receiving the picket therethrough to also retain upward movement of the tread member relative to the stringer sections when the pickets are secured in the lower sockets.

Each stringer section comprises two molded panels which are fastened together to form a hollow core interior. The two assembled sides of each stringer section assemble to form the two opposing sides of the keyway as well as two opposing sides of the protrusions or keys 226 received therein.

Each starter section 222 of the stringers includes a rear edge which is substantially identical to the intermediate stringer sections to include a keyway 224 therein which mates with the keys of the adjacent intermediate modular sections. The front edge of the starter sections however comprise two horizontal supporting ledges 204 suitably spaced apart so that one of the ledges is upward and rearward of the other by a suitable spacing corresponding to the spacing between steps of the intermediate sections of the stringers. Both ledges are configured identically to the ledges of the intermediate sections to slidably receive a tread member thereon and retain the tread member by a sprung retainer member or the pickets of the railing. The riser edge between the two horizontal support ledges 204 similarly includes a slot 212 for the lowermost tread member to be received therein.

The railing for the stair system functions substantially identically to the rail system noted above with the exception of the rail member extending at an incline so that the lower sockets formed in the lower portion of the rail member are inclined with respect to the longitudinal direction of the rail member. The upper portion however includes a similar lock flange for being received in the lock slots of the top ends of each picket in interlocking engagement with the lower sockets in the lower portion of the railing. The picket members are suitably spaced apart so that two picket members are aligned with each tread member with the picket members being different in length so that all of the top ends of the picket members are aligned along a common axis of the rail member joining the picket member top ends.

To support the stair system on the deck, a suitable joist connector is coupled to each stringer. Each joist connector comprises a key portion 242 which is substantially identical to the keys 226 of the modular section so that key portion can be interlocked in engagement with the keyway 224 along the rear edge of the rear or uppermost one of the modular sections of the stringer. The joist connector 240 is arranged to be coupled to the joists of the deck system with the stringers being coupled to the key portion 242 by a vertical sliding movement in a downward direction from the released position to the engaged position. In the engaged position further downward movement of the stairs relative to the joist connector is prevented so that the stairs are adequately suspended from the joists in use.

The joist connector further comprises a mounting portion 244 in the form of two opposed clamping members arranged to be fitted in mating engagement over the bottom flange of the joist. The mating profiles between the mounting portion 244 and the lower flange of the joist permits longitudinal sliding movement of the mounting portion along the length of the joist.

The orientation of the mounting portion 244 is pivotal about a vertical axis relative to the key portion so that the joist connectors 240 can mount the stringers to the joists along a side of the deck where the stringers extend parallel to the joists or along a side of the deck where the stringers extend perpendicularly to the joists. An optional bracket may be provided to span between a pair of adjacent joists for connection to the mounting portion 244 of the joist connector where the width of the stairs does not correspond to the width between an even number of joists when the stringer sections and joists are supported parallel to one another.

The various components of the decking system are manufactured of suitable materials for strength and resistance against the weather. The joists for example may be extruded of aluminum or other suitable strong and light weight material. Alternatively the ledger board, the deck boards or the tread members of the stairs may be injection molded of plastics or composite materials. The railing members and the facer board for example may be similarly extruded, typically of more light weight finishing materials including plastics or composites and the like.

In order to assemble the deck adjacent an upright supporting surface such as a wall of a building, the ledger board is first mounted by a first selecting the appropriate length of the ledger board and assembling the ledger board from multiple ledger sections which are snap fit together. Once assembled, the ledger board is secured by inserting fasteners through suitable fastener apertures 250 formed in the ledger at the time of molding.

The apertures include round apertures for closely fitting nails for initial tacking and positioning of the ledger board as well as a combination of vertical and horizontal oriented slots to accommodate the fasteners with some adjustability. Typical fasteners to be secured in the slots for more permanent mounting include bolts or lugs which are fastened at both vertically and horizontally spaced positions relative to one another along the full length of the ledger board between each adjacent pair of joists.

A level bubble receptacle integrally molded in the ledger board receives a level bubble therein to provide an indication of the horizontal orientation of the ledger board when mounting. For convenience in mounting, suitable fasteners including lugs or bolts are provided in respective fastener holders 252 integrally molded in the front face of the back wall of the ledger board in which the fasteners are arranged to be snap fit into the fastener holders. Accordingly for use, the user removes the fasteners from the fastener holders and inserts them through the apertures in the ledger board for fastening to the wall.

Once the ledger board is secured, the beam 16 is supported parallel to the ledger at a location spaced outwardly from the wall and spaced above the ground at a similar elevation as the ledger board. The post connectors are used to support the beam on posts at a plurality of positions spaced along the beam. The joists connectors are also mounted on the beam including integral level bubbles supported thereon. The plurality of joists are then mounted parallel to one another to span between the joist connectors on the ledger board and the joist connectors on the beam all by snap fit configuration so that all of the components are held together by interlocking engagement therebetween.

The height and inclination of the posts is then adjusted to ensure that the beam is level and to ensure that the joists have a common gradual slope which is near horizontal from the ledger board downwardly towards the beam. The level bubbles integrally supported on the joists serve to indicate when the joists are level or near level.

Once the joists are mounted in position, including the outermost joists, the plurality of deck boards are slid onto the joists by receiving the upper portion of the joist within the joist connectors in the bottom side of the deck boards. The deck boards are slid towards the ledger board from the free end of the joists until the deck boards closest to the ledger board are received in the slot formed therein so that the drip flange of the ledger board overlaps the deck surface of the deck boards.

Upon insertion of all of the deck boards, a facer board is snug fit onto the free ends of the joist. The upper portions of the outermost joist and the facer board are selected depending upon whether a railing is provided or not. If a railing is provided upper portions are provided with picket mounting apertures formed therein. Upon locating the corner brackets and wall brackets of the railing the pickets are inserted into the lower sockets and the lower portions of the railings are mounted onto the top ends for insertion of the top ends into the upper sockets. A quarter turn of all the pickets effectively locks the lower portion of the rail to the pickets and the pickets to the deck surface. Insertion of the upper portion of the railing then permits the lock flange to be received into the lock slots of the pickets to prevent their further rotation back into the released position. The rail corner brackets enclose the ends of the rail members which meet at corners of the deck.

Subsequently the user assembles the stairs by assembling the modular sections relative to one another by sliding interlocking engagement. Sliding the tread members horizontally onto the respective modular sections of the stairs prevents further release of the modular sections relative to one another. The spring retainer member and the picket members of the stairs then in turn further prevent sliding removal of the tread members from the modular sections of the stringer. Similarly mounting the lower portion of the railing, turning the pickets and then mounting the upper portion of the rail member locks all of the pickets in place. The use of the joist connectors 240 then serve to suspend the stringer sections at the rear top end thereof from the joists of the deck.

While some glue and fasteners may be provided and used for additional assurances, as described above substantially all of the components of the deck system including the stair system can be assembled together in a modular configuration in which the components are supported wholly by interlocking engagement therebetween without additional fasteners being required. Suitable retainers in the form of sprung retainer members or rotatable locking members are provided at various locations for additional locking of the components together.

The present decking system completely eliminates the need for tools and fasteners. All the components are designed in a fashion where one piece clicks easily into the next. For example the deck joists fit into slots or grooves in the ledger and on the beam, all the measuring are done for the consumer. They simply have to pick up a joist and click it in place. The decking is applied with the same ease. What used to take hours laying out and nailing down the decking can now be done in minutes by simply sliding the decking into place.

Other advantages of the decking system of the present invention include:

Wood expands and contracts and deteriorates in the weather. When fastening the decking from the top with screws or nails, this allows water to seep into the hole alongside the fastener and accelerates wood decay. Components of the present deck are made from wood thermoplastic composite material or other suitable material which can be molded or extruded and which does not absorb water and will not rot. Furthermore, the material may be recycled or recyclable and will be more fire and water resistant than wood.

Typical wood decks require maintenance with respect to painting or staining. Even decks constructed with composite decking have a wood sub structure that will rot. The components from the beam to the decking are all made from water resistant resin.

Wood products outside typically don't age well, the ends of the decking check and cracks and can splinter, the boards shrink over time and the boards fade and look undesirable. Some of the components of the decking system may be made from wood fibre and plastic mixed together giving it a real wood look but with all the positive weather resistant characteristics offered with this thermoplastic resin selection.

Home owners, because of the simplicity of the installation process can install the deck themselves without hiring a contractor or having to purchasing tools.

Contractors in the deck building business can offer there customers a superior product which take less time during the construction process.

There is very little waste if any in building a deck according to the present invention.

Turning now to FIGS. 35 through 49, a second embodiment of the decking system 10 is illustrated. Like characters of reference are used to indicate corresponding parts in the different embodiments. Except as otherwise indicated in the following, the configuration of the various components of the second embodiment of the decking system is substantially identical to the previous embodiment.

Figure 36:
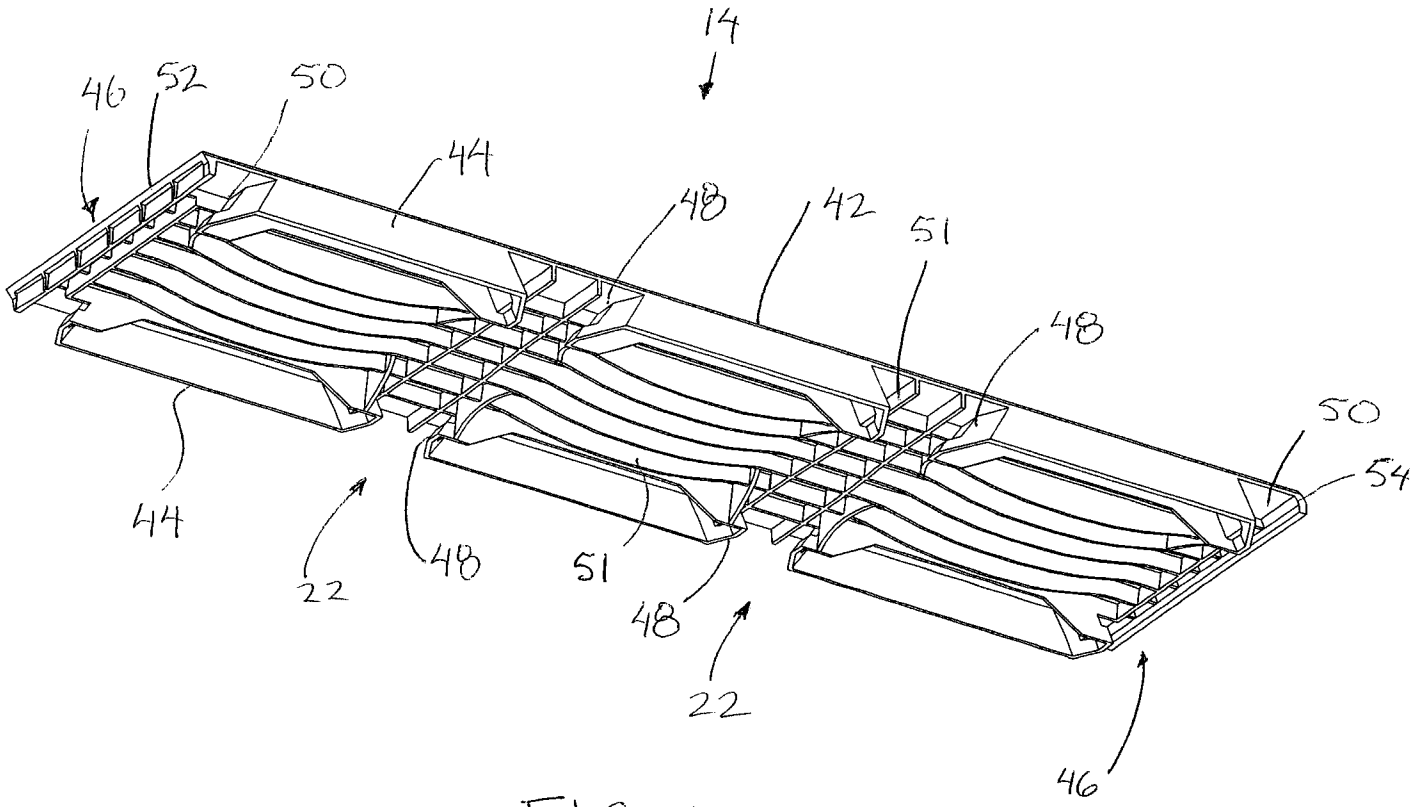
Figure 38:
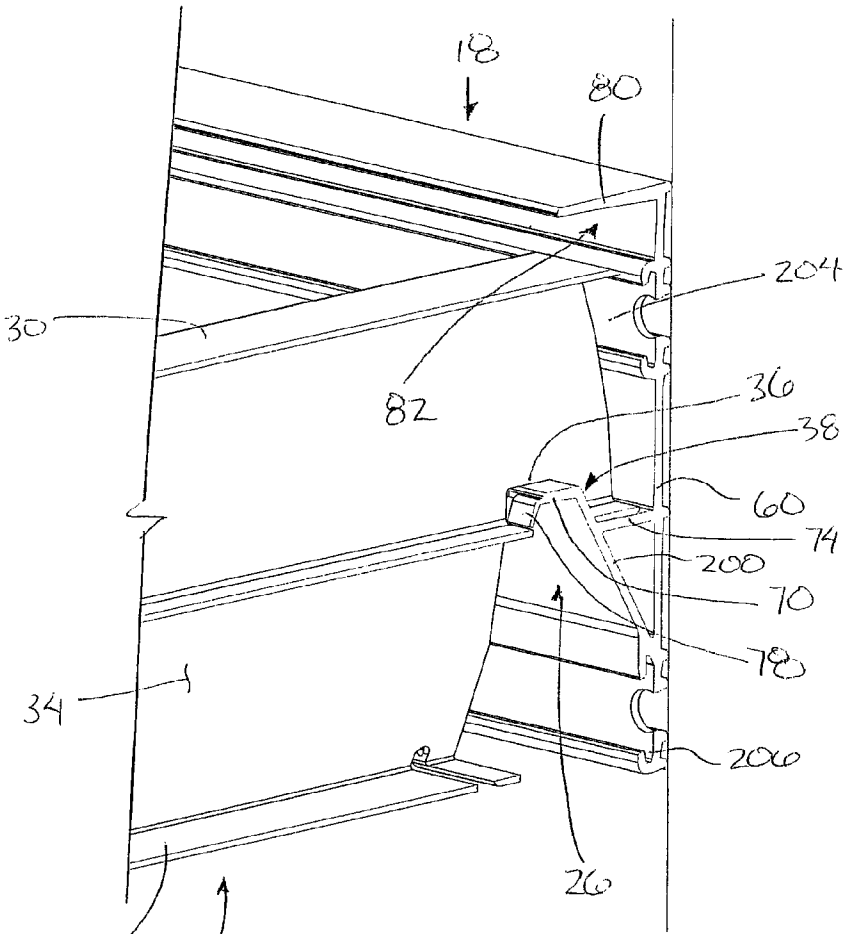
Figure 37:
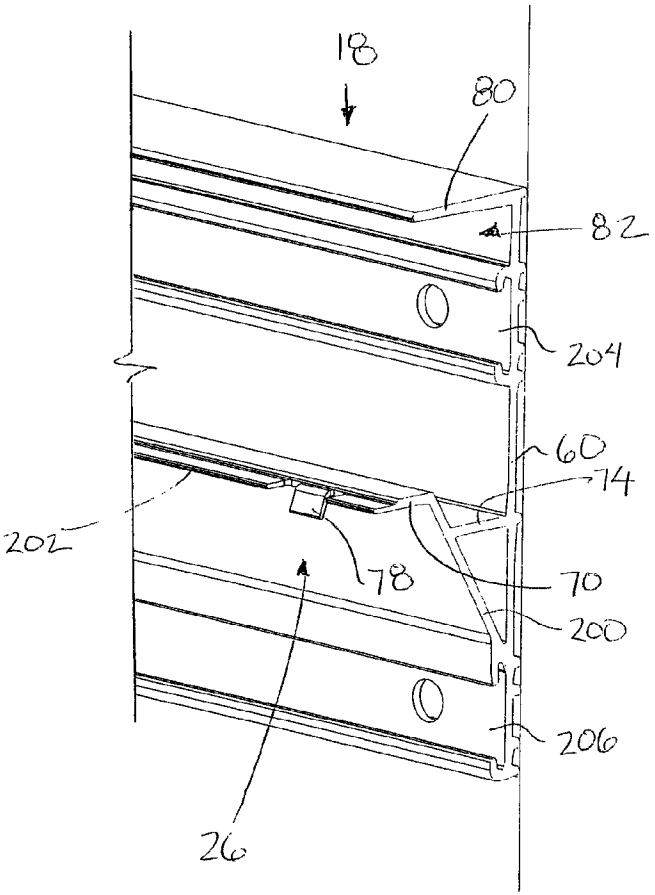

As shown in FIG. 36, the deck boards 14 are substantially identical to the previous embodiment with the exception of the configuration of the stiffener ribs 51. In alignment with each of the joist connectors, a pair of stiffener ribs are provided extending laterally across the board between opposing longitudinally extending side edges so that the two stiffener ribs 51 associated with each joist connector extends vertically between the upper surface of the deck board and the respective joist therebelow to which the deck board is supported. In addition to the stiffener ribs 51 extending laterally across the board, as in the previous embodiment stiffener ribs are also provided which extend longitudinally the length of the deck boards. The stiffener ribs 51 according to FIG. 36 are shown to increase in height from the upper deck surface to the bottom end thereof between the joists connectors so as to be greatest in height at a central location between each adjacent pair of joist connectors. The height gradually increases from the minimum height at the joist connectors to the maximum height centered between the joists such that the height of the stiffener ribs 51 can be said to be increasing with increasing distance from the joist connectors.

The ledger board 18 in the second embodiment comprises an extruded member having a continuous profile along the length thereof. The profile generally comprises a back wall 60 defining upright front and rear sides of the ledger board. Similarly to the previous embodiment a plurality of stiffener ribs extend in the longitudinal direction of the ledger board along the rear side thereof of equal thickness so that the ledger board is arranged for securement to a vertical supporting surface similarly to the previous embodiment.

The joist connectors 26 of the ledger board are formed by machining notches at spaced apart locations along the ledger board which serve to receive respective joists therein. At each joist connector location, similarly to the previous embodiment, there is provided a ledge portion 70 spaced forwardly and outwardly from the upright side of the ledger board upon which a corresponding overhang portion of the joist is arranged to be engaged. Furthermore at each joist connector there is provided a bottom portion 74 comprising a similar horizontal wall for supporting a portion of the corresponding joist thereon. The bottom portion 74 is located downwardly and inwardly in relation to the ledge portion 70 so as to be nearer to the upright side of the ledger board. The ledge portion 70 and the bottom portion 74 of the joist connectors are all formed continuously with one another so as to be integral with the back wall 60 by extrusion thereof. An angular support of material 200 is provided which extends from the ledger portion, across the bottom portion of each joist connector to be connected to the back wall 60 at a location spaced below the ledge portion to provide additional structural support to the overhang portion of the joists supported thereon. Similarly to the previous embodiment, the ledge portion supports an intermediate portion of the respective joist thereon at a location which is spaced below the top side of the joist and above the bottom side of the joist at the location of the central rib of the joist.

In the second embodiment, the notches defining the joist connectors, which are formed into the ledger board transversely to the longitudinal direction thereof, are located in a locator flange 202 which extends outwardly from the free edge of the ledge portion 70 away from the back wall 60 of the ledger board. The notches are formed into the edge of the locator flange such that each joist is arranged to be snugly received between the opposing edges of the flange at each notch to locate the joist in the longitudinal direction of the ledger board.

Within each notch, a portion of the locator flange 202 is bent downwardly after formation of the notches to define a retainer flange 78 which is resiliently sprung relative to the main body of the ledger board and ledge portion 70 upon which it is supported. A joist is slidably inserted vertically downward overtop of the ledge portion as in the previous embodiment. The central rib of the joist slides along the retainer flange to deflect the flange outward into a released position automatically upon insertion of the joist into the respective joist connector. Once the central rib of the joist passes the bottom free edge of the retainer flange, the resiliently sprung nature of the flange causes the flange to protrude outwardly and overlap the central rib thus preventing the joist from being raised upwardly back into a released position until the retainer flange is manually released. Suitable space is provided between the bottom of the joist and the bottom of the ledger board portion to provide a suitable opening for access to the retainer flange for releasing as may be desired.

The ledger board similarly comprises a drip flange 80 as described in the previous embodiment which projects forwardly from the back wall 60 along the full length of the ledger board in the longitudinal direction thereof. The drip flange extends outwardly in a horizontal orientation at a location spaced above the joist connectors by a suitable height such that when the joist are supported in the joist connectors the drip flange 80 remains spaced above the joist by a suitable gap corresponding to the thickness of the deck boards. Accordingly a slot 82 is defined along the top of the ledger board which faces outwardly similarly to the previous embodiment for receiving an edge portion of the deck boards between the drip flange 80 and the joists therebelow supported on the ledger board. In this manner the drip flange 80 overlaps a portion of the top side of the deck boards to provide a finished edge to the deck boards and to prevent moisture from readily penetrating between the joists and ledger board from above.

The ledger board according to the second embodiment further comprises a top mounting channel 204 and a bottom mounting channel 206 formed integrally into the front upright side of the back wall 60 to extend continuously along the ledger board in the longitudinal direction thereof. Each of the mounting channels is continuous in profile comprising two opposed edges which are spaced outwardly from the back wall and which project inwardly towards one another such that the channel is generally C-shaped in cross section so as to be suitable for receiving various mounting plates retained therein which remain slidable in the longitudinal direction of the ledger board. The top mounting channel 204 is situated below the drip flange 80 in alignment with a top end of the joists to be overlapped by an upper portion of the joists. The bottom mounting channel 206 is located adjacent the bottom end of the ledger board to be overlapped by a bottom portion of the joists.

A plurality of mounting apertures for receiving suitable lag bolts for anchoring to an upright supporting surface are located at spaced positions along the length of the ledger board in two rows in alignment with the top and bottom mounting channels respectively. At each joist connector location, a mounting aperture is provided in both the top and bottom mounting channels in vertical alignment with one another and with the joist connector. To provide additional reinforcing at each mounting aperture location, a plurality of single fastener anchor plates 28 are slidably received in the top and bottom mounting channels with respective apertures therein for alignment with the mounting apertures formed through the back wall of the ledger board. The lag bolts are then inserted through both the anchor plates 208 and the mounting apertures in the back wall of the ledger board to anchor the ledger board to the upright supporting surface.

Similarly to the previous embodiment, the ledger board is formed in a plurality of modular sections 84 which are arranged to be interconnected in an end to end configuration. Each section 84 includes a male formation on one end and a female formation at the opposing end in which the male and female formations are arranged for interlocking engagement with one another by relative sliding in an interlocking direction which is perpendicular to the longitudinal direction of the boards as described in the first embodiment.

Figure 40:
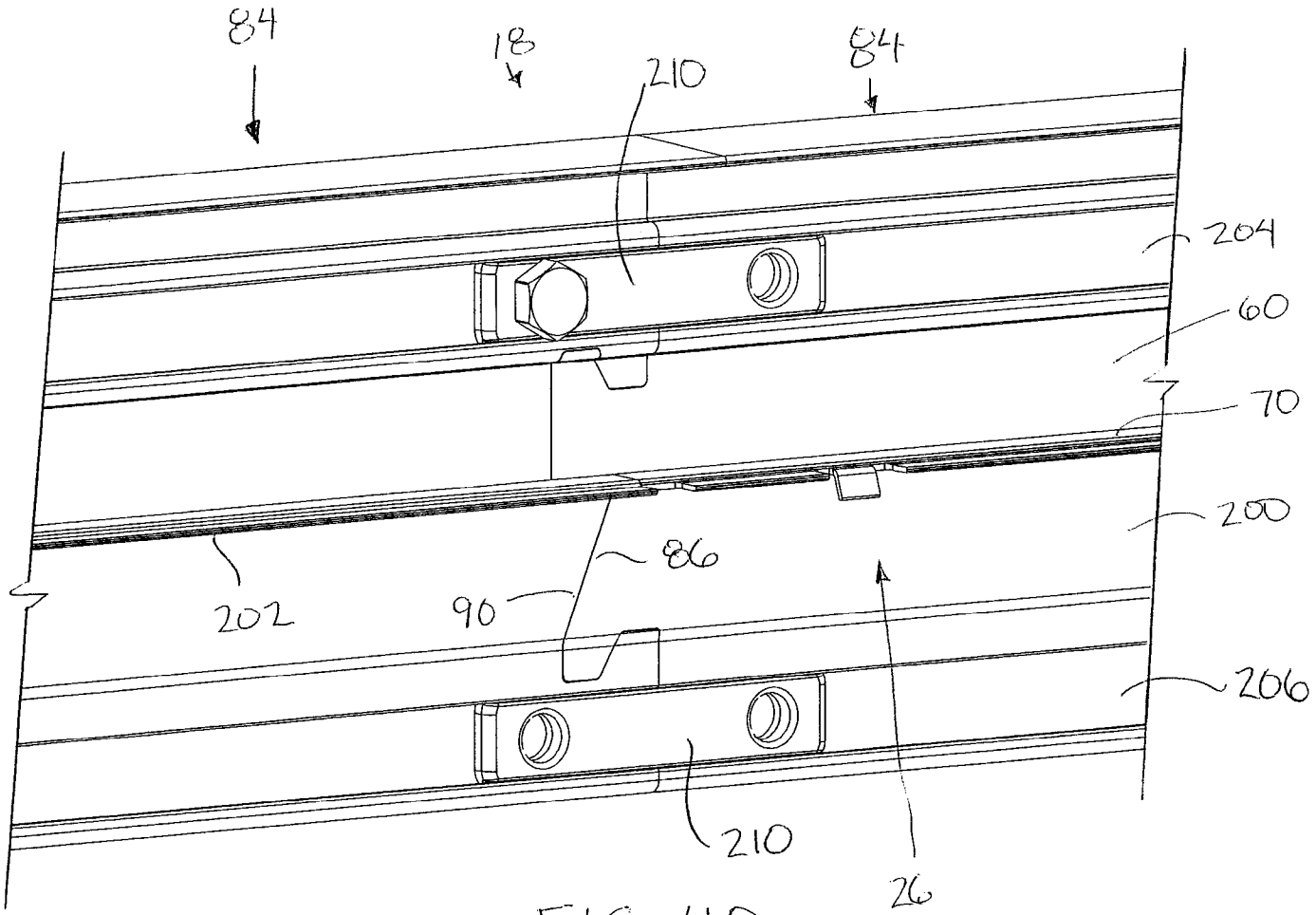
Figure 41:
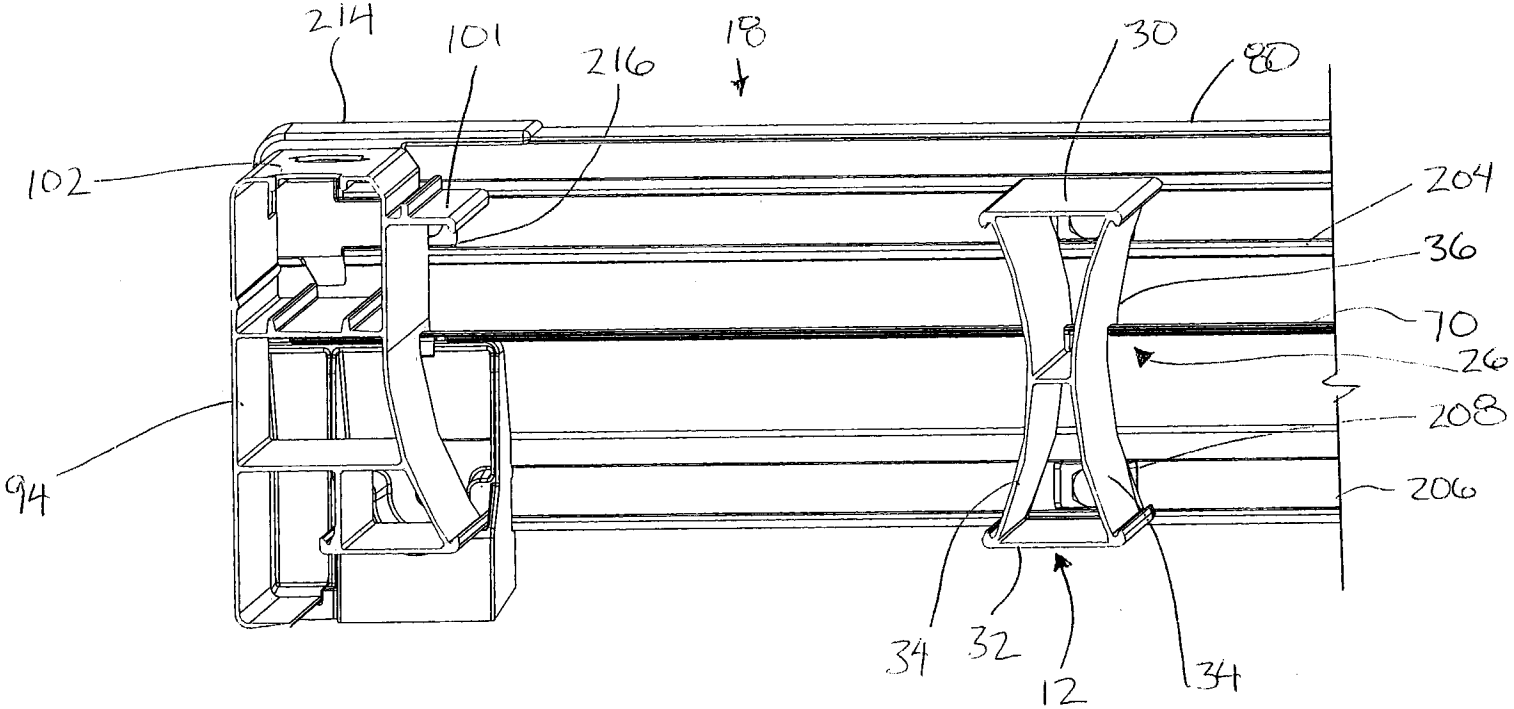

As shown in FIG. 40, fastener apertures are located adjacent both ends of each modular section 84 such that at the interconnection of respective male and female formations of two adjacent modular sections, mounting apertures are provided in both top and bottom channels at the end of both modular sections.

A suitable retainer member 210 is used to retainer the two adjacent modular sections in an interlocked configuration. The retainer member comprises a fastener anchor plate having two corresponding fastener apertures therein which are suitably positioned so that the retainer member can overlap an adjacent pair of fastener apertures located at the respective ends of the adjacent modular sections of the ledger board within each of the top and bottom mounting channels. Each retainer member 210 is slidable in the longitudinal direction of the ledger board along the respective top and bottom channel from a released position overlapping only one of the modular sections so that the modular sections are slidable in the interlocking direction relative to one another and a second position in which the retainer member overlaps both modular sections at the interconnection thereof to further prevent relative sliding movement in the interlocking direction. In the second position the fastener apertures of the retainer member 210 align with fastener apertures in both modular sections for receiving suitable lag bolts therethrough for anchoring to the upright supporting surface at the ends of each modular section in addition to being mounted at plural intermediate locations corresponding to the joist connectors.

Figure 39:
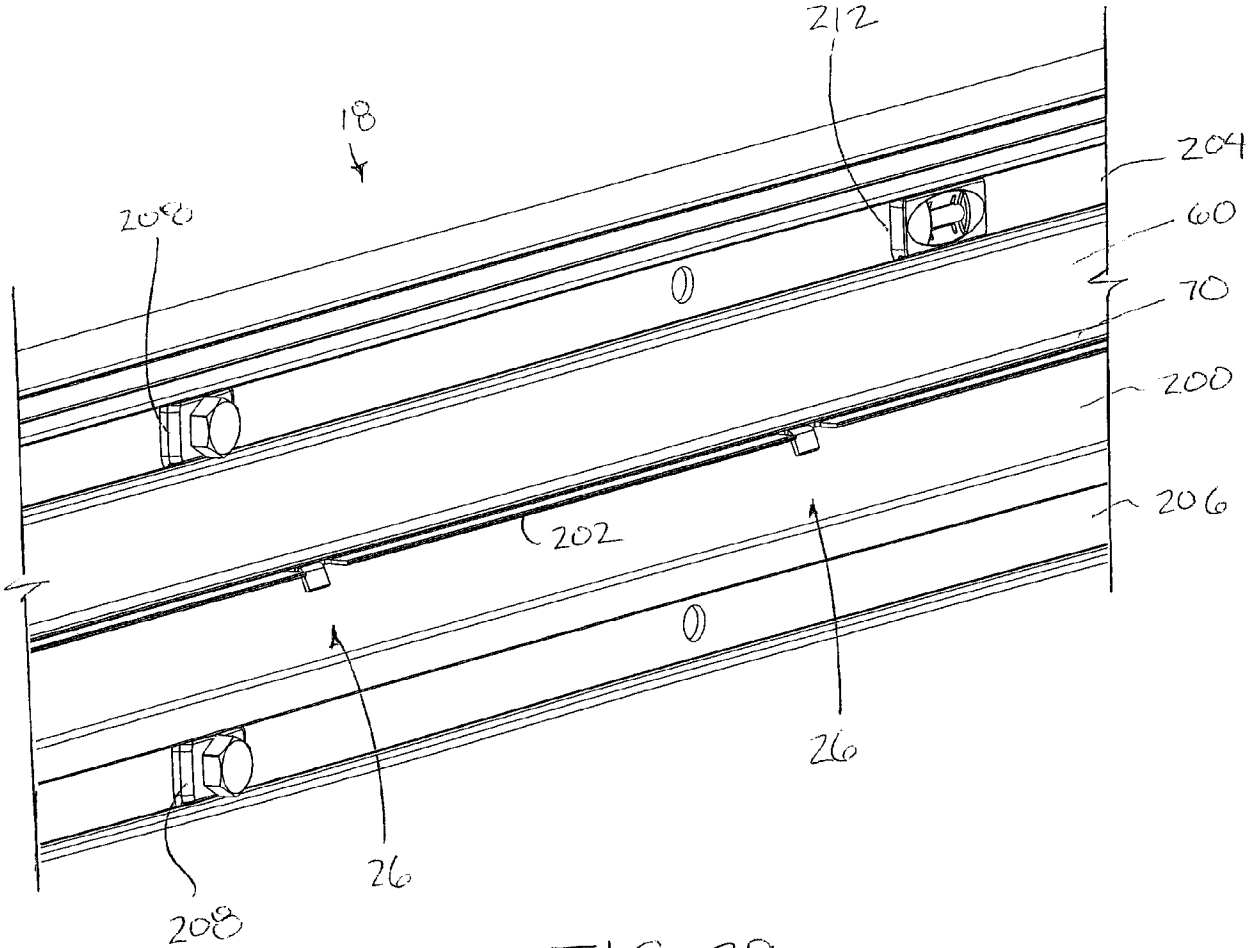

As shown in FIG. 39, the mounting channels 204 and 206 are also suitably arranged for receiving a level bubble element 212 having a mounting plate portion slidably received between the confronting edges of the channel such that the level bubble remains slidable along the channel similar to the mounting plates.

Similarly to the previous embodiment, an outermost joist 94 is provided for being mounted in interlocking engagement at the ends of the ledger board and in which the outermost joist 94 comprises a flat outer side for forming an outer finished edge of the decking assembly. The joist 94 of the second embodiment differs in that the joist is formed as a single piece extrusion including both the upper and lower portions thereof. In the second embodiment the outermost joist 94 is supported on the ledger board by an end bracket 214 mounted onto the end of the ledger board. The end bracket includes mounting portions 216 slidably received within the respective mounting channels of the ledger board and which include fastener apertures therein for alignment with the apertures in the back wall of the ledger board at the end thereof. The end bracket is thus retained on the ledger board by the lag bolts extending through the apertures in the mounting portions of the end bracket and the aligned apertures in the ledger board. The end bracket includes an end flange for overlapping the outer flat side of the outermost joist 94 as well as a top flange which overlaps overtop of the drip flange of the ledger board to provide a finished appearance.

Figure 42:
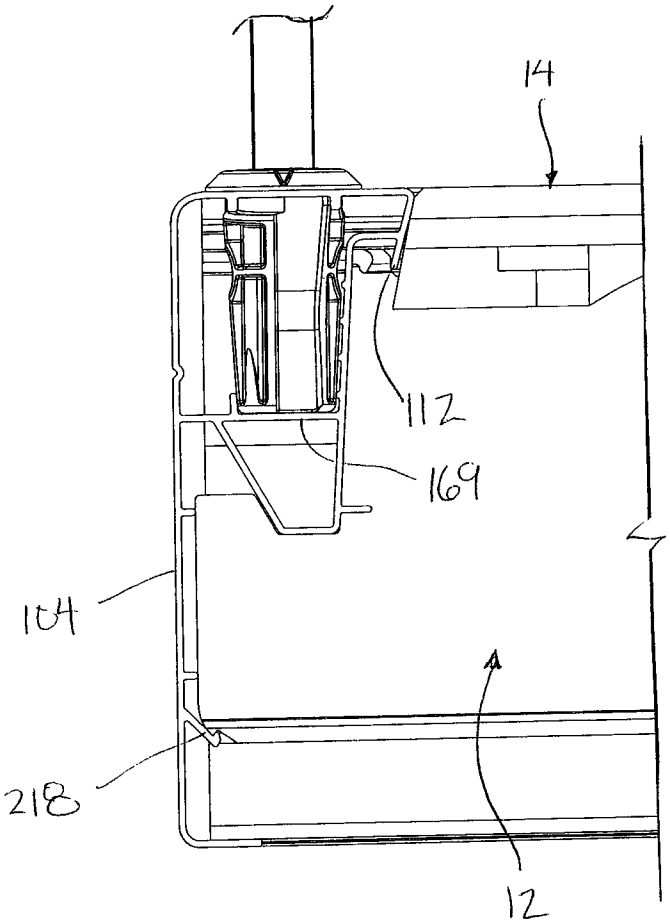

In the second embodiment the facer board 104 is arranged to be similarly mounted in interlocking engagement over the ends of the joist by interlocking over the hook and overlap portions at the end of the joist. Contrary to the first embodiment however the facer board 104 as shown in FIG. 42 comprises a one piece extrusion including both upper and lower portions anchored onto the joists and locating the sockets for the railing therein.

More particularly according to the second embodiment, the facer board 104 comprises a first portion which interlocks with and overlaps overtop of an upward facing upper surface at both the top side and at an intermediate location of the joist. Adjacent the bottom of the facer board 104 there is provide a second portion spaced below the first portion which comprises a retainer flange 218 which is resiliently sprung relative to the first portion and the remaining body of the facer board. The flange 218 includes a hook at the free edge thereof which is arranged for interlocking engagement to overlap beneath a downward facing lower surface of the joist for retaining the facer board in interlocking engagement within the hook and overlap portions of the joists.

Figure 43:
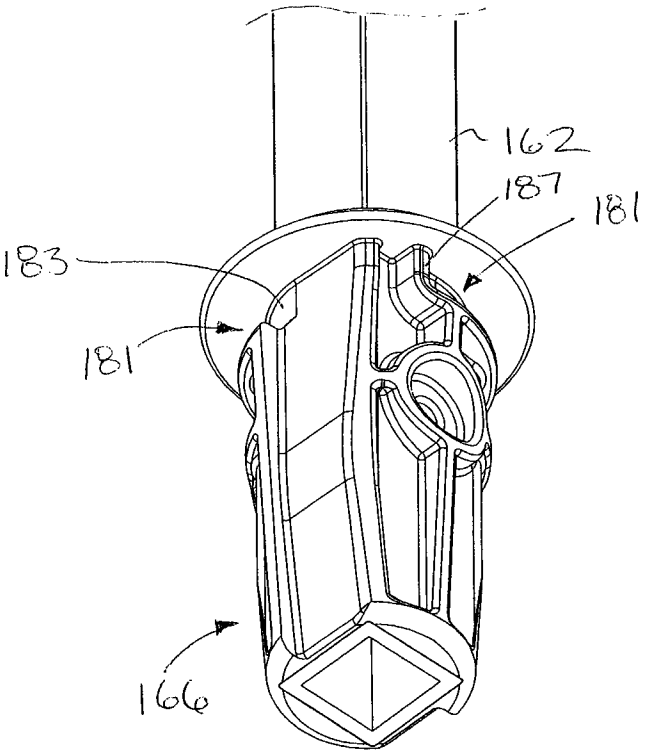

As shown in FIG. 43, the bottom ends of the pickets are formed similarly to the previous embodiment to include diametrically opposed retainer portions which are arranged for interlocking engagement in the locked position with the corresponding pair of diametrically opposed retainer portions formed on each of the lower sockets. Insertion of the bottom ends of the pickets within the respective sockets and then rotation therein serves to lock the pickets into the respective lower sockets as described above with regard to the first embodiment.

Figure 45:
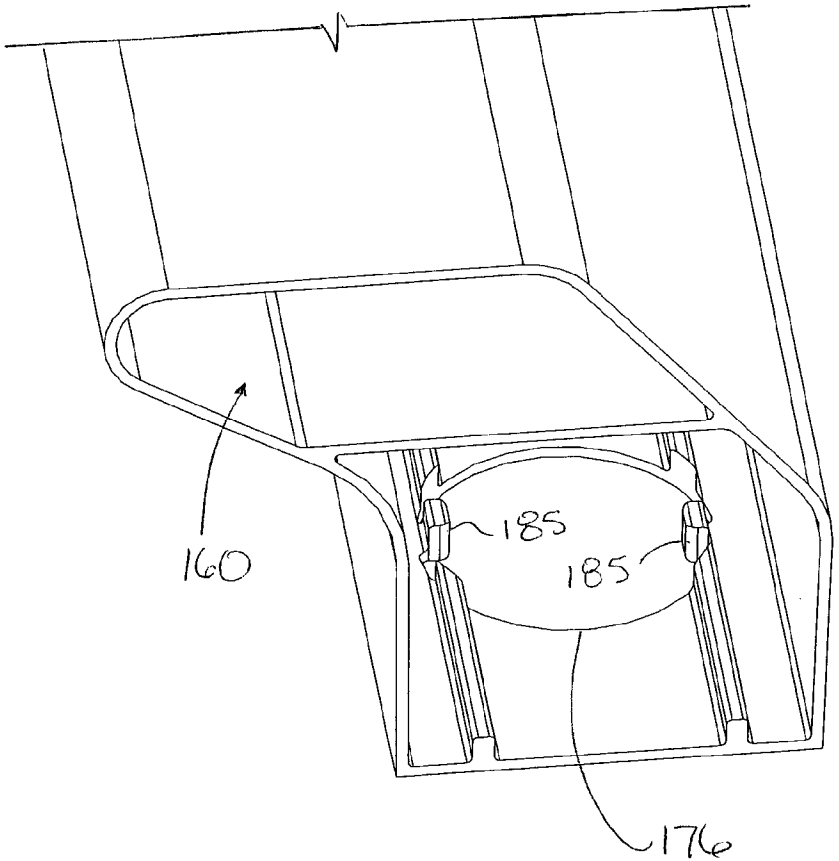
Figure 44:
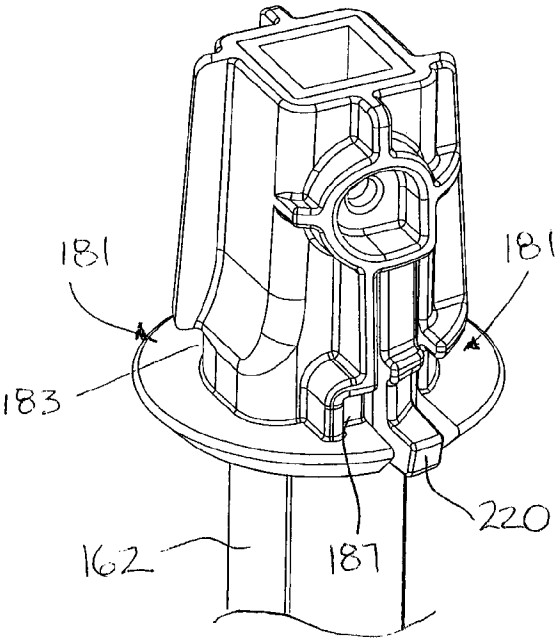
Figure 46:
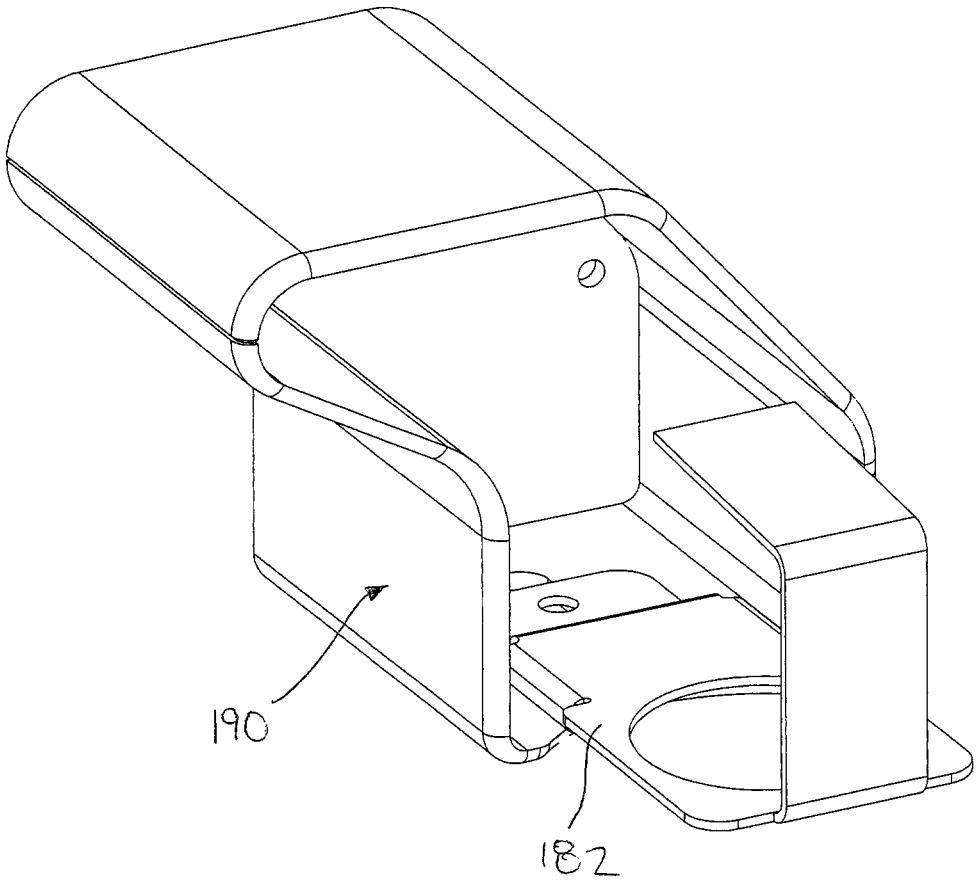
Figure 47:
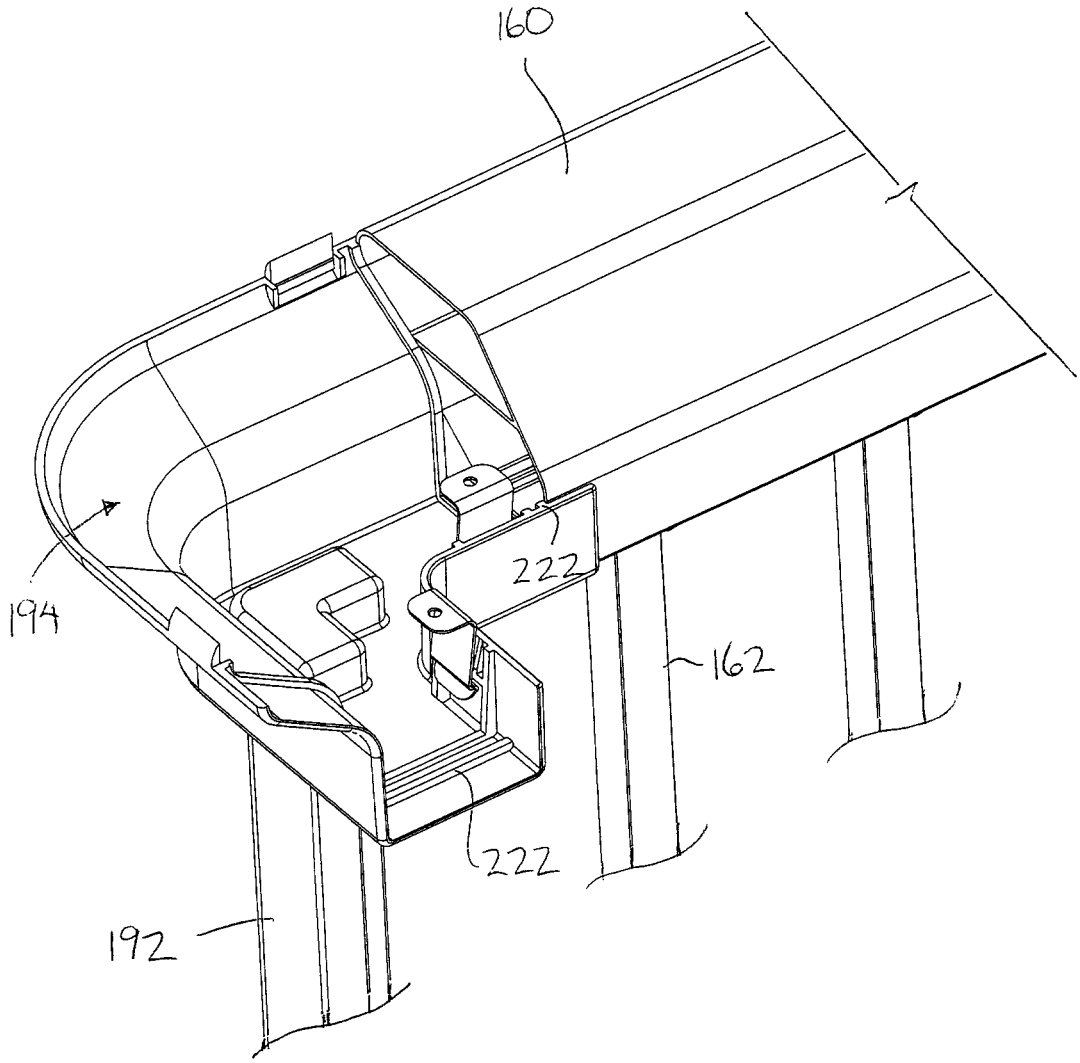

As shown in FIGS. 44 and 45, according to the second embodiment the top ends of the pickets and the upper sockets formed in the railing members also both include diametrically opposed retainer portions arranged for interlocking engagement with one another at diametrically opposed locations when the pickets are rotated relative to the railing member.

The second embodiment differs from the first embodiment in the method of retaining the pickets in the locked position within the respective sockets. More particularly one of the two retainer portions formed at diametrically opposed locations on each top end of each picket comprises a locking element 220 which is resiliently spring relative to the picket member. A camming face on the locking element causes the locking element to be automatically resiliently deformed into a released position upon rotating engagement with the respective upper socket, however upon reaching the locked position, the locking element 220 is permitted to return to an unbiased and locked position which overlaps a corresponding mating surface on the upper socket which prevents rotation back into the released position until the locking element is manually deflected into the released position thereof. This configuration permits the railing member as shown in FIG. 45 to be formed as a one piece extrusion mounted overtop of the top ends of all of the picket members simultaneously.

Similarly to the previous embodiment a wall bracket 190 is provided for anchoring the ends of the railing members to the upright supporting surface against which the deck system is assembled. The wall bracket comprises a two piece construction including a lower portion integrally formed with an end wall having fastener apertures therein for anchoring to the upright supporting surface. An upper portion is arranged to be snap fit overtop of the lower portion so that together the two portions are arranged to full surround the profile of the railing member.

To secure the railing member in the longitudinal direction of the railing member relative to the wall bracket, an adapter bracket 182 is fixed within the railing member and attached to the wall bracket internally at one of numerous longitudinal positions therealong to permit some adjustment of the wall bracket relative to the railing member. More particularly the adapter bracket 82 includes a horizontal flange including a mounting aperture therein for alignment with a longitudinally extending slot in the bottom wall of the wall bracket. A fastener can be located to extend through the aperture and slot to fix the longitudinal position of the adapter bracket relative to the wall bracket 190. An inner end of the adapter bracket includes a socket formed therein for alignment with one of the upper sockets at the end of the railing member. By inserting the adapter bracket into the end of the railing member and aligning the socket therein with the upper socket at the end of the rail member, insertion of the picket member at the end of the rail member into the socket thereof fixes the rail member relative to the adapter bracket which can in turn be fixed relative to the wall bracket and the upright supporting surface for anchoring the end of the railing member to the upright supporting surface.

Also similar to the previous embodiment, at the corners of the deck, a corner post 192 is provided which mounts within a unique corner bracket joining the facer board to the outermost joist at the corner of the deck surface. A top end of the corner post 192 is received within a corner bracket 194 of the railing member which joins the ends of two rails oriented perpendicularly to one another together at the corner of the deck. The corner bracket is a two piece construction including a lower portion and an upper portion arranged to be snap fit downwardly onto the lower portion with the ends of the two railing members received therebetween. A locator ridge 222 is located in the bottom wall of the corner bracket at both ends thereof for being matingly received within a corresponding groove formed in the bottom wall of the two railing members. The interlocking arrangement of the locator ridge 222 and the groove formed in the end of the railing prevents longitudinal sliding of the railing out of the corner bracket once the upper and lower portions of the bracket are fastener together using snap connections or hidden fasteners as may be desired.

Figure 48:
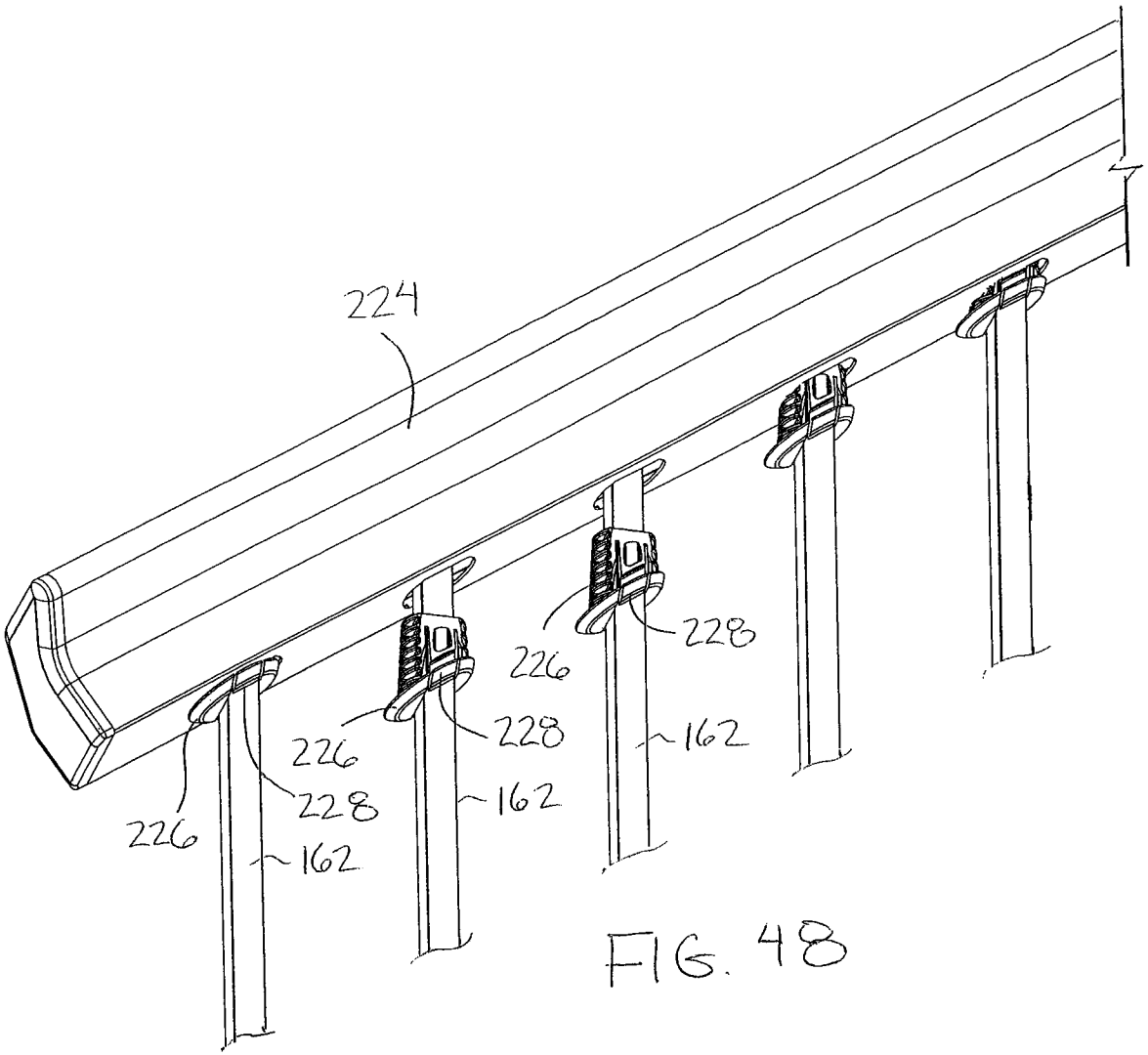

In the second embodiment, a stair system is similarly provided which is substantially identical in function to the previous embodiment. As shown in FIG. 48 however the railing on the stairs differs from the previous embodiment in that the rail member 224 comprises a single body integral extrusion with the upper sockets for receiving the top ends of the pickets therein comprising apertures cut into the bottom wall of the railing. The bottom ends of the pickets are inserted into the lower sockets in the tread members as in the previous embodiment such that the rotation about the upright axis of the pickets causes the picket members to be rotated into the locked position relative to the treads. The top ends of the pickets are not interlocked with the railing member 224 until after the pickets are already rotated into the locked position relative to the tread member.

In the second embodiment, a locking element 226 is provided for longitudinal sliding along each picket member from a released position at an intermediate position along the length of the picket to a locked position at the top end of the picket received within the respective upper socket in the railing 224. The upper sockets in the railing 224 and the locking elements 226 received therein are both elongate in the longitudinal direction of the railing so that the locking elements cannot be aligned and inserted into the respective sockets until the picket members are already rotated at the bottom ends thereof into the respective locked position relative to the lower sockets. The mating square cross section of the picket members and the apertures within the locking elements through which the picket members are received ensures that the locking elements are rotated with the picket members about the respective vertical longitudinal axis thereof.

In order to interlock the top ends of the pickets with the rail member, the locking elements are slid vertically upward into the respective upper sockets in the railing member and then are retained in place by respective retainer elements 228 on each locking element. The retainer elements comprise a resiliently sprung member relative to the body of the locking element and the picket member having an outer face comprising a sloped camming face which automatically displaces the retainer element into a sprung position by engagement with the upper socket upon insertion of the locking element into the socket. Once fully inserted into the upper socket, the majority of the retainer element 228 is received within the hollow interior of the railing member so that the retainer element is permitted to be returned to an unsprung position in overlapping engagement over the edge of the upper socket within the interior of the railing member. The overlap of the retainer element with the interior surface of the rail member prevents vertical sliding removal of the locking element from the upper socket until the retainer element 228 is manually released from below.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A decking system comprising:

a plurality of joists spanning in parallel, spaced apart from one another so as to be arranged to support a plurality of deck boards spanning transversely across the plurality of joists; and a ledger board spanning in a longitudinal direction transversely across a mounting end of each of the plurality of joists such that the plurality of joists are supported on the ledger board at spaced apart positions in the longitudinal direction of the ledger board;

the ledger board comprising:

a first side and a second side opposite one another and extending in the longitudinal direction of the ledger board between respective ends of the ledger board;

an upright portion formed at the second side which is arranged for mounting against an upright supporting surface; and a plurality of ledger board joist connectors formed at the first side of the ledger board including at least one ledge portion which protrudes from the upright portion;

the mounting end of each joist comprising:

an overhang portion extending in the longitudinal direction of the joist beyond a remainder of the joist, the overhang portion being supported on said at least one ledge portion of the ledger board; and a hook portion which is hooked onto the ledger board between the first and second sides of the ledger board by interlocking engagement with a respective one of the ledger board joist connectors so as to prevent movement of the joist in the longitudinal direction of the joist away from the ledger board;

wherein the hook portion of each joist extends downwardly from the overhang portion of the joist and the ledge portion is spaced outwardly from the upright portion at the second side of the ledger board such that the hook portion is received between the ledge portion and the upright portion at the second side of the ledger board.

2. The system according to claim 1 wherein each joist comprises an extruded member having a continuous profile along a length thereof and wherein the system further comprises:

a beam comprising an extruded member having a continuous profile along a length thereof, the beam supporting the joists thereon parallel to one another at spaced apart positions along the beam; and a plurality of beam joist connectors arranged to connect the joists to the beam solely by interlocking engagement with both the beam and the joists.

3. The system according to claim 1 further comprising a beam supporting the joists at spaced apart positions thereon, at least one of the beam, the ledger board and the joists comprising a structural member having a main body arranged to provide structural support to the deck and a level bubble integrally supported on the main body, the level bubble being arranged to indicate when the main body is supported in a horizontal orientation.

4. The system according to claim 1 wherein the ledger board comprises an extruded member having a longitudinally extending profile along a length thereof, the ledger board joist connectors being spaced apart from one another in the longitudinal direction and comprising notches formed into the longitudinally extending profile transversely to the longitudinal direction of the ledger board such that each notch is arranged to receive a respective one of the joists therein.

5. The system according to claim 1 wherein each joist comprises an upper flange, a lower flange parallel and opposite to the upper flange, and a web portion spanning between the upper and lower flanges and which is narrower than the upper and lower flanges.

6. The system according to claim 1 wherein an end of each joist which is opposite the mounting end of the joist further comprises an overhang portion extending in the longitudinal direction of the joist beyond a remainder of the joist, the overhang portions at opposing ends of each joist being located adjacent opposing top and bottom sides of the joist respectively.

7. The system according to claim 6 wherein there is provided a facer board spanning the ends of the joists opposite the ledger board, the facer board being supported on the overhang portions of the joists.

8. A decking system comprising:

a plurality of joists spanning in parallel, spaced apart from one another;

a plurality of deck boards spanning transversely across the plurality of joists; and a ledger board spanning in a longitudinal direction transversely across a mounting end of each of the plurality of joists such that the plurality of joists are supported on the ledger board at spaced apart positions in the longitudinal direction of the ledger board;

the ledger board comprising:

a first side and a second side opposite one another and extending in the longitudinal direction of the ledger board between respective ends of the ledger board;

an upright portion formed at the second side which is arranged for mounting against an upright supporting surface; and a plurality of ledger board joist connectors formed at the first side of the ledger board including at least one ledge portion which protrudes from the upright portion;

the mounting end of each joist comprising:

an overhang portion extending in the longitudinal direction of the joist beyond a remainder of the joist, the overhang portion being supported on said at least one ledge portion of the ledger board; and a hook portion which is hooked onto the ledger board between the first and second sides of the ledger board by interlocking engagement with a respective one of the ledger board joist connectors so as to prevent movement of the joist in the longitudinal direction of the joist away from the ledger board;

an upper deck surface at least partially defined by the plurality of deck boards;

a railing comprising a rail member and a plurality of picket members spanning between the rail member and the upper deck surface; and a plurality of lower sockets formed in the upper deck surface receiving bottom ends of the picket members therein respectively;

the bottom end of each picket member being rotatable in the respective lower socket relative to the upper deck surface between a released position in which the picket member is slidable in a longitudinal direction of the picket member into and out of the respective lower socket and a locked position in which the picket member is retained in the lower socket by interlocking engagement between the bottom end of the picket member and the lower socket.

9. The decking system according to claim 8 wherein there is provided a readily releasable locking element adjacent a top end of each picket member which is arranged to be selectively engaged with the rail member so as to selectively prevent rotation of the picket member from the locked position to the released position to retain the picket member in the locked position.

10. A decking system comprising:

a plurality of joists spanning in parallel, spaced apart from one another;

a plurality of deck boards spanning transversely across the plurality of joists; and a ledger board spanning in a longitudinal direction transversely across a mounting end of each of the plurality of joists such that the plurality of joists are supported on the ledger board at spaced apart positions in the longitudinal direction of the ledger board;

the ledger board comprising:

a first side and a second side opposite one another and extending in the longitudinal direction of the ledger board between respective ends of the ledger board;

an upright portion formed at the second side which is arranged for mounting against an upright supporting surface; and a plurality of ledger board joist connectors formed at the first side of the ledger board including at least one ledge portion which protrudes from the upright portion;

the mounting end of each joist comprising:

an overhang portion extending in the longitudinal direction of the joist beyond a remainder of the joist, the overhang portion being supported on said at least one ledge portion of the ledger board; and a hook portion which is hooked onto the ledger board between the first and second sides of the ledger board by interlocking engagement with a respective one of the ledger board joist connectors so as to prevent movement of the joist in the longitudinal direction of the joist away from the ledger board wherein the ledger board comprises a horizontal flange member extending in the longitudinal direction of the ledger board along a top side of the ledger board spaced above the ledger board joist connectors so as to be arranged to overlap a top side of a portion of the deck boards supported on the joists.

11. A decking system comprising:

a plurality of joists spanning in parallel, spaced apart from one another; and an upper deck surface at least partially defined by a plurality of deck boards spanning transversely across the plurality of joists;

a railing comprising a rail member and a plurality of picket members spanning between the rail member and the upper deck surface;

a plurality of lower sockets formed in the upper deck surface receiving bottom ends of the picket members therein respectively;

the bottom end of each picket member being rotatable in the respective lower socket relative to the upper deck surface between a released position in which the picket member is slidable in a longitudinal direction of the picket member into and out of the respective lower socket and a locked position in which the picket member is retained in the lower socket by interlocking engagement between the bottom end of the picket member and the lower socket;

wherein the joists include a plurality of intermediate joists and at least one outermost joist spanning parallel to the intermediate joists at one end of the plurality of deck boards, the upper deck surface being at least partially defined by said at least one outermost joist, and at least some of the lower sockets being formed in said at least one outermost joist.

12. The system according to claim 11 further comprising a facer board spanning across the joists at one end of the joists such that the upper deck surface is at least partially defined by the facer board, at least some of the lower sockets being formed in the facer board.

13. The system according to claim 11 further comprising a readily releasable locking element adjacent a top end of each picket member which is arranged to be selectively engaged with the rail member so as to selectively prevent rotation of the picket member from the locked position to the released position to retain the picket member in the locked position.

* * * * *